US010131457B2

(12) United States Patent
Bourgeois et al.

(10) Patent No.: US 10,131,457 B2
(45) Date of Patent: Nov. 20, 2018

(54) FLEXIBLE CONTAINERS AND METHODS OF MAKING THE SAME

(71) Applicant: The Procter & Gamble Company, Cincinnati, OH (US)

(72) Inventors: Marc Richard Bourgeois, Liberty Township, OH (US); Benjamin Jacob Clare, Cincinnati, OH (US); Joseph Craig Lester, Liberty Township, OH (US); Tadayoshi Ishihara, West Chester, OH (US); Scott Kendyl Stanley, Mason, OH (US); Jun You, West Chester, OH (US); Donald Joseph Cox, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 582 days.

(21) Appl. No.: 14/534,214

(22) Filed: Nov. 6, 2014

(65) Prior Publication Data

US 2015/0121810 A1 May 7, 2015

Related U.S. Application Data

(60) Provisional application No. 61/900,810, filed on Nov. 6, 2013.

(51) Int. Cl.
*B65B 1/02* (2006.01)
*B65B 3/02* (2006.01)
(Continued)

(52) U.S. Cl.
CPC ..... *B65B 31/006* (2013.01); *B65B 9/2049* (2013.01); *B65B 31/00* (2013.01);
(Continued)

(58) Field of Classification Search
CPC ..... B65D 75/525; B67C 3/223
(Continued)

(56) References Cited

U.S. PATENT DOCUMENTS 2,612,738 A 10/1952 Salfisberg
4,044,867 A 8/1977 Fisher
(Continued)

FOREIGN PATENT DOCUMENTS

CN 1640777 7/2005
DE 3721303 1/1989
(Continued)

OTHER PUBLICATIONS

U.S. Appl. No. 29/526,409, filed May 8, 2015, McGuire et al.
(Continued)

*Primary Examiner* — Thanh Truong
*Assistant Examiner* — Patrick Fry
(74) *Attorney, Agent, or Firm* — David M Weirich; Jason J Camp

(57) ABSTRACT

A method of expanding a structural support volume of a flexible container can include dispensing a cryogenic fluid into at least one structural support volume and sealing the at least one structural support volume such that it has a closed volume prior to complete conversion of the cryogenic fluid into a gas and expansion of the structural support volume to a pressurized state. The flexible container includes a product volume and at least a portion of the structural support volume extends into the product volume when the structural support volume is expanded.

16 Claims, 36 Drawing Sheets

(51) Int. Cl.

| | |
|---|---|
| ***B65B 5/02*** | (2006.01) |
| ***B65B 31/00*** | (2006.01) |
| ***B65B 39/00*** | (2006.01) |
| ***B65D 75/00*** | (2006.01) |
| ***B65D 75/52*** | (2006.01) |
| ***B65D 75/58*** | (2006.01) |
| ***B65B 9/20*** | (2012.01) |

(52) U.S. Cl.
CPC ..... *B65B 39/007* (2013.01); *B65D 75/008* (2013.01); *B65D 75/525* (2013.01); *B65B 1/02* (2013.01); *B65B 3/02* (2013.01); *B65B 5/02* (2013.01); *B65D 75/5872* (2013.01)

(58) Field of Classification Search
USPC ..... 53/434; 206/522; 383/3
See application file for complete search history.

(56) References Cited

U.S. PATENT DOCUMENTS

| | | | | | |
|---|---|---|---|---|---|
| 4,155,453 | A * | 5/1979 | Ono | B65D 81/052 | 206/522 |
| 4,597,244 | A * | 7/1986 | Pharo | B65B 31/06 | 206/522 |
| 4,721,396 | A | 1/1988 | Sengewald | | |
| 4,926,613 | A * | 5/1990 | Hansen | B65B 3/022 | 53/433 |
| 4,949,530 | A | 8/1990 | Pharo | | |
| 5,137,154 | A | 8/1992 | Cohen | | |
| 5,169,031 | A * | 12/1992 | Miller | B65B 31/006 | 222/146.5 |
| 5,378,065 | A | 1/1995 | Tobolka | | |
| 5,755,328 | A * | 5/1998 | DeLuca | F16K 15/202 | 206/522 |
| 5,960,975 | A | 10/1999 | Lenartsson | | |
| 6,244,466 | B1 * | 6/2001 | Naslund | B65D 33/02 | 141/114 |
| 6,276,532 | B1 * | 8/2001 | Sperry | B29C 65/342 | 206/522 |
| 6,520,491 | B2 | 2/2003 | Timlick | | |
| 6,776,307 | B1 * | 8/2004 | Hagihara | B65D 75/48 | 222/107 |
| 7,207,717 | B2 | 7/2007 | Steele | | |
| 7,410,057 | B2 * | 8/2008 | Yoshifusa | B65D 81/075 | 206/522 |
| 7,584,593 | B2 * | 9/2009 | Murray | B65B 43/30 | 493/309 |
| 7,585,528 | B2 | 9/2009 | Ferri | | |
| 8,181,428 | B2 | 5/2012 | Gustafsson | | |
| 8,413,846 | B2 | 4/2013 | Kasa | | |
| 8,590,574 | B2 * | 11/2013 | Jian | B65D 81/052 | 137/223 |
| 8,661,772 | B2 | 3/2014 | Yasuhira | | |
| 8,662,751 | B2 | 3/2014 | Forss | | |
| 9,327,867 | B2 | 5/2016 | Stanley et al. | | |
| 9,469,088 | B2 | 10/2016 | Stanley et al. | | |
| 9,586,744 | B2 | 3/2017 | Arent et al. | | |
| 2003/0094394 | A1 | 5/2003 | Anderson et al. | | |
| 2004/0035865 | A1 | 2/2004 | Rosen | | |
| 2004/0149618 | A1 | 8/2004 | Otaki | | |
| 2005/0126941 | A1 | 6/2005 | Ferri | | |
| 2007/0053615 | A1 * | 3/2007 | Liu | B65D 31/04 | 383/3 |
| 2007/0092164 | A1 | 4/2007 | Yasuhira | | |
| 2008/0035519 | A1 * | 2/2008 | Swartz | B65D 31/145 | 206/522 |
| 2008/0205801 | A1 | 8/2008 | Alaux | | |
| 2008/0264970 | A1 | 10/2008 | Kasai | | |
| 2010/0290722 | A1 | 11/2010 | Desmedt | | |
| 2010/0308062 | A1 | 12/2010 | Helou | | |
| 2012/0097634 | A1 | 4/2012 | Riedl | | |
| 2013/0248540 | A1 | 9/2013 | Darby | | |
| 2013/0292287 | A1 | 11/2013 | Stanley et al. | | |
| 2013/0292353 | A1 | 11/2013 | Stanley et al. | | |
| 2013/0292395 | A1 | 11/2013 | Stanley et al. | | |
| 2013/0292413 | A1 | 11/2013 | Stanley et al. | | |
| 2013/0292415 | A1 | 11/2013 | Stanley et al. | | |
| 2013/0294711 | A1 | 11/2013 | Stanley et al. | | |
| 2013/0337244 | A1 | 12/2013 | Stanley et al. | | |
| 2014/0033654 | A1 | 2/2014 | Stanley et al. | | |
| 2014/0033655 | A1 | 2/2014 | Stanley et al. | | |
| 2014/0187401 | A1 | 7/2014 | Totani | | |
| 2014/0250834 | A1 | 9/2014 | Yoshikane et al. | | |
| 2015/0028057 | A1 | 1/2015 | Arent et al. | | |
| 2015/0033671 | A1 | 2/2015 | Stanley et al. | | |
| 2015/0034670 | A1 | 2/2015 | Stanley et al. | | |
| 2015/0036950 | A1 | 2/2015 | Stanley et al. | | |
| 2015/0121810 | A1 | 5/2015 | Bourgeois et al. | | |
| 2015/0122373 | A1 | 5/2015 | Bourgeois et al. | | |
| 2015/0122840 | A1 | 5/2015 | Cox et al. | | |
| 2015/0122841 | A1 | 5/2015 | McGuire et al. | | |
| 2015/0122842 | A1 | 5/2015 | Berg et al. | | |
| 2015/0122846 | A1 | 5/2015 | Stanley et al. | | |
| 2015/0125099 | A1 | 5/2015 | Ishihara et al. | | |
| 2015/0125574 | A1 | 5/2015 | Arent et al. | | |
| 2015/0126349 | A1 | 5/2015 | Ishihara et al. | | |
| 2016/0176578 | A1 | 6/2016 | Stanley et al. | | |
| 2016/0176582 | A1 | 6/2016 | McGuire et al. | | |
| 2016/0176583 | A1 | 6/2016 | Ishihara et al. | | |
| 2016/0176584 | A1 | 6/2016 | Ishihara et al. | | |
| 2016/0176597 | A1 | 6/2016 | Ishihara et al. | | |
| 2016/0221727 | A1 | 8/2016 | Stanley et al. | | |
| 2016/0297569 | A1 | 10/2016 | Berg et al. | | |
| 2016/0297589 | A1 | 10/2016 | You et al. | | |
| 2016/0297590 | A1 | 10/2016 | You et al. | | |
| 2016/0297591 | A1 | 10/2016 | You et al. | | |
| 2016/0325518 | A1 | 11/2016 | Ishihara et al. | | |
| 2016/0362228 | A1 | 12/2016 | McGuire et al. | | |
| 2017/0001782 | A1 | 1/2017 | Arent et al. | | |

FOREIGN PATENT DOCUMENTS

| | | | | |
|---|---|---|---|---|
| DE | 102005002301 | | 7/2006 | |
| EP | 0306207 | | 8/1988 | |
| JP | U-S59-145594 | | 8/1984 | |
| JP | 7-232744 | | 9/1995 | |
| JP | A-H107159 | | 1/1998 | |
| JP | 2003-45413 | | 2/2003 | |
| JP | 2005343492 | | 12/2005 | |
| JP | 2006027697 | | 2/2006 | |
| JP | 2006-123931 | | 5/2006 | |
| JP | 2006240651 | | 9/2006 | |
| JP | 2009184690 | | 8/2009 | |
| JP | 2010-275018 | | 12/2010 | |
| JP | 4639677 | | 2/2011 | |
| JP | 2012025394 | | 2/2012 | |
| RU | 2038815 | | 7/1995 | |
| WO | WO1996001775 | | 1/1996 | |
| WO | WO2005063589 | | 7/2005 | |
| WO | WO2008064508 | | 6/2008 | |
| WO | WO2012073004 | | 6/2012 | |
| WO | WO 2012073004 | A2 * | 6/2012 | ..... B65D 37/00 |
| WO | WO2013124201 | | 8/2013 | |

OTHER PUBLICATIONS

U.S. Appl. No. 15/094,118, filed Apr. 8, 2016, Stanley et al.
U.S. Appl. No. 15/466,898, filed Mar. 27, 2017, Arent et al.
U.S. Appl. No. 15/466,901, filed Mar. 27, 2017, McGuire et al.
"The Rigidified Standing Pouch—A Concept for Flexible Packaging", Phillip John Campbell, A Thesis Written in Partial Fulfillment of the Requirements for the Degree of Master of Industrial Design, North Carolina State University School of Design Raleigh, 1993, pp. 1-35.
All Office Actions, U.S. Appl. No. 13/957,158, date of filing Aug. 1, 2013.
All Office Actions, U.S. Appl. No. 13/957,187, date of filing Aug. 1, 2013.
All Office Actions, U.S. Appl. No. 14/534,197, date of filing Nov. 6, 2014.

(56) References Cited

OTHER PUBLICATIONS

All Office Actions, U.S. Appl. No. 14/534,210, date of filing Nov. 6, 2014.
All Office Actions, U.S. Appl. No. 14/534,213, date of filing Nov. 6, 2014.
All Office Actions, U.S. Appl. No. 15/148,395, date of filing May 6, 2016.
All Office Actions, U.S. Appl. No. 15/198,472, date of filing Jun. 30, 2016.
International Search Report and Written Opinion, PCT/US2014/064210, dated Jan. 20, 2015.

* cited by examiner

FLEXIBLE CONTAINERS AND METHODS OF MAKING THE SAME

FIELD

The present disclosure relates in general to containers, and in particular, to containers made from flexible material and methods of making such containers.

BACKGROUND

Fluent products include liquid products and/or pourable solid products. In various embodiments, a container can be used to receive, contain, and dispense one or more fluent products. And, in various embodiments, a container can be used to receive, contain, and/or dispense individual articles or separately packaged portions of a product. A container can include one or more product volumes. A product volume can be configured to be filled with one or more fluent products. A container receives a fluent product when its product volume is filled. Once filled to a desired volume, a container can be configured to contain the fluent product in its product volume, until the fluent product is dispensed. A container contains a fluent product by providing a barrier around the fluent product. The barrier prevents the fluent product from escaping the product volume. The barrier can also protect the fluent product from the environment outside of the container. A filled product volume is typically closed off by a cap or a seal. A container can be configured to dispense one or more fluent products contained in its product volume(s). Once dispensed, an end user can consume, apply, or otherwise use the fluent product(s), as appropriate. In various embodiments, a container may be configured to be refilled and reused or a container may be configured to be disposed of after a single fill or even after a single use. A container should be configured with sufficient structural integrity, such that it can receive, contain, and dispense its fluent product(s), as intended, without failure.

A container for fluent product(s) can be handled, displayed for sale, and put into use. A container can be handled in many different ways as it is made, filled, decorated, packaged, shipped, and unpacked. A container can experience a wide range of external forces and environmental conditions as it is handled by machines and people, moved by equipment and vehicles, and contacted by other containers and various packaging materials. A container for fluent product(s) should be configured with sufficient structural integrity, such that it can be handled in any of these ways, or in any other way known in the art, as intended, without failure.

A container can also be displayed for sale in many different ways as it is offered for purchase. A container can be offered for sale as an individual article of commerce or packaged with one or more other containers or products, which together form an article of commerce. A container can be offered for sale as a primary package with or without a secondary package. A container can be decorated to display characters, graphics, branding, and/or other visual elements when the container is displayed for sale. A container can be configured to be displayed for sale while laying down or standing up on a store shelf, while presented in a merchandising display, while hanging on a display hanger, or while loaded into a display rack or a vending machine. A container for fluent product(s) should be configured with a structure that allows it to be displayed in any of these ways, or in any other way known in the art, as intended, without failure.

A container can also be put into use in many different ways, by its end user. A container can be configured to be held and/or gripped by an end user, so a container should be appropriately sized and shaped for human hands; and for this purpose, a container can include useful structural features such as a handle and/or a gripping surface. A container can be stored while laying down or standing up on a support surface, while hanging on or from a projection such as a hook or a clip, or while supported by a product holder, or (for refillable or rechargeable containers) positioned in a refilling or recharging station. A container can be configured to dispense fluent product(s) while in any of these storage positions or while being held by the user. A container can be configured to dispense fluent product(s) through the use of gravity, and/or pressure, and/or a dispensing mechanism, such as a pump, or a straw, or through the use of other kinds of dispensers known in the art. Some containers can be configured to be filled and/or refilled by a seller (e.g. a merchant or retailer) or by an end user. A container for fluent product(s) should be configured with a structure that allows it to be put to use in any of these ways, or in any other way known in the art, as intended, without failure. A container can also be configured to be disposed of by the end user, as waste and/or recyclable material, in various ways.

One conventional type of container for fluent products is a rigid container made from solid material(s). Examples of conventional rigid containers include molded plastic bottles, glass jars, metal cans, cardboard boxes, etc. These conventional rigid containers are well-known and generally useful; however their designs do present several notable difficulties.

First, some conventional rigid containers for fluent products can be expensive to make. Some rigid containers are made by a process shaping one or more solid materials. Other rigid containers are made with a phase change process, where container materials are heated (to soften/melt), then shaped, then cooled (to harden/solidify). Both kinds of making are energy intensive processes, which can require complex equipment.

Second, some conventional rigid containers for fluent products can require significant amounts of material. Rigid containers that are designed to stand up on a support surface require solid walls that are thick enough to support the containers when they are filled. This can require significant amounts of material, which adds to the cost of the containers and can contribute to difficulties with their disposal.

Third, some conventional rigid containers for fluent products can be difficult to decorate. The sizes, shapes, (e.g. curved surfaces) and/or materials of some rigid containers, make it difficult to print directly on their outside surfaces. Labeling requires additional materials and processing, and limits the size and shape of the decoration. Overwrapping provides larger decoration areas, but also requires additional materials and processing, often at significant expense.

Fourth, some conventional rigid containers for fluent products can be prone to certain kinds of damage. If a rigid container is pushed against a rough surface, then the container can become scuffed, which may obscure printing on the container. If a rigid container is pressed against a hard object, then the container can become dented, which may look unsightly. And if a rigid container is dropped, then the container can rupture, which may cause its fluent product to be lost.

Fifth, some fluent products in conventional rigid containers can be difficult to dispense. When an end user squeezes a rigid container to dispense its fluent product, the end user must overcome the resistance of the rigid sides, to deform the container. Some users may lack the hand strength to easily overcome that resistance; these users may dispense less than their desired amount of fluent product. Other users may need to apply so much of their hand strength, that they cannot easily control how much they deform the container; these users may dispense more than their desired amount of fluent product.

SUMMARY

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to print and/or decorate, because they are made from flexible materials, and flexible materials can be printed and/or decorated as conformable webs, before they are formed into containers. Fourth, these flexible containers can be less prone to scuffing, denting, and rupture, because flexible materials allow their outer surfaces to deform when contacting surfaces and objects, and then to bounce back. Fifth, fluent products in these flexible containers can be more readily and carefully dispensed, because the sides of flexible containers can be more easily and controllably squeezed by human hands. Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed and put into use, as intended, without failure.

In accordance with an embodiment, a method of filling a product volume of a flexible container comprising the product volume and at least one structural support volume that at least partially extends into the product volume when expanded can include filling the product volume with a product to a first fill height, wherein the product volume has a first product receiving volume during filling. The method can further include applying an external force to the flexible container to reduce the volume of the product volume from the first product receiving volume to a second product receiving volume and optionally raise a fill height of the product to a second fill height. The at least one structural support member is in an unexpanded state during filling and application of the external force.

In accordance with an embodiment, a method of expanding at least one structural support volume of a flexible container can include dispensing a cryogenic fluid into the at least one structural support volume and sealing the at least one structural support volume such that it has a closed volume before complete conversion of the cryogenic fluid to a gaseous state and expansion of the structural support volume to the expanded state.

In accordance with an embodiment, a nozzle assembly for dispensing a cryogenic fluid can include a guide having an opening through which a nozzle can be disposed. The nozzle can actuate through the opening from a non-dispensing position in which a dispensing tip of the nozzle is disposed within the guide and a dispensing position in which the dispensing tip of the nozzle is extended from the guide.

DETAILED DESCRIPTION

Figure 1A:
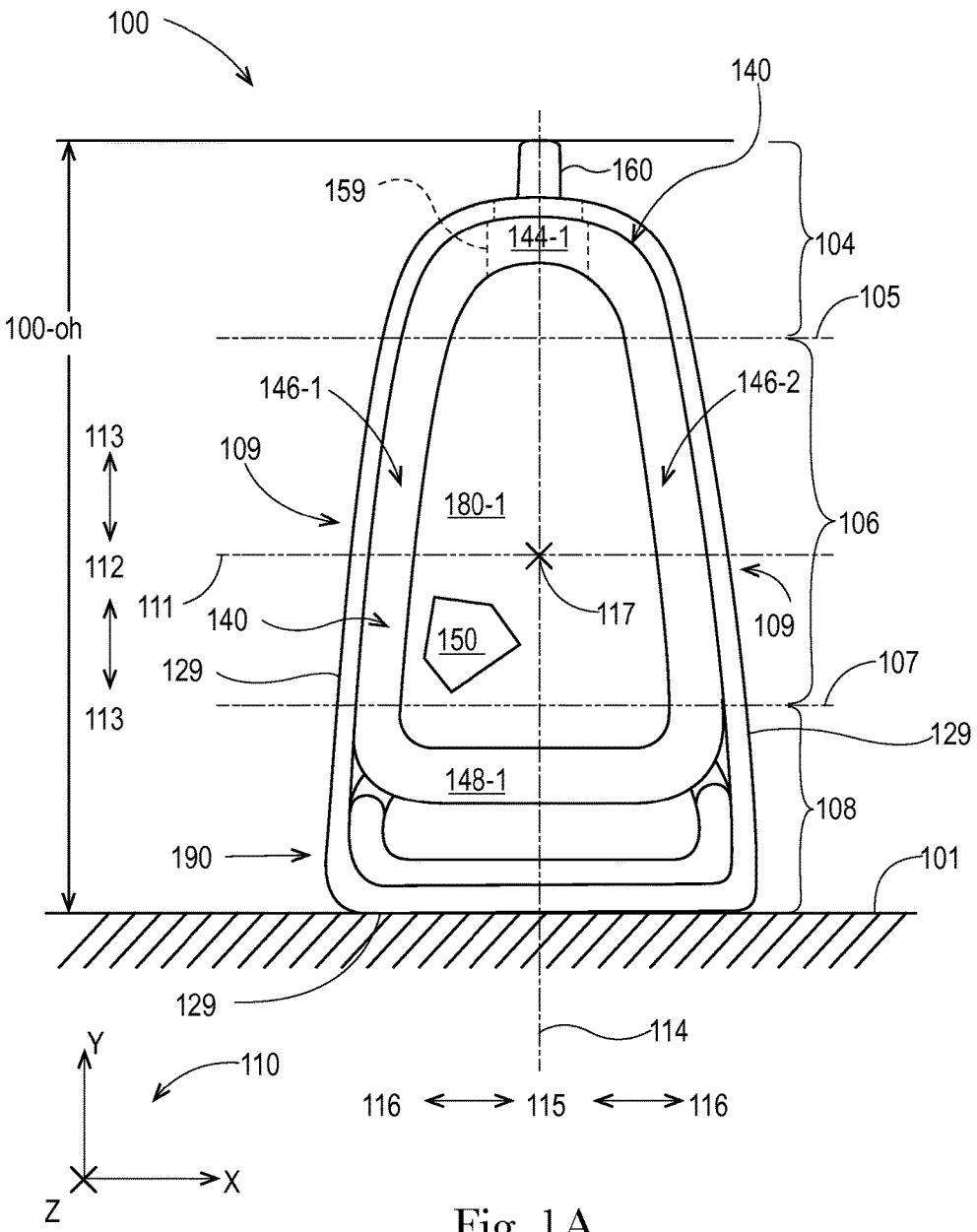
FIG. 1A illustrates a front view of an embodiment of a stand up flexible container.

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to decorate, because their flexible materials can be easily printed before they are formed into containers. Fourth, these flexible containers can be less prone to scuffing, denting, and rupture, because flexible materials allow their outer surfaces to deform when contacting surfaces and objects, and then to bounce back. Fifth, fluent products in these flexible containers can be more readily and carefully dispensed, because the sides of flexible containers can be more easily and controllably squeezed by human hands. Alternatively, any embodiment of flexible containers, as described herein, can be configured to dispense fluent products by pouring the fluent products out of its product volume.

Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed for sale and put into use, as intended, without failure.

As used herein, the term "about" modifies a particular value, by referring to a range equal to the particular value, plus or minus twenty percent (+/−20%). For any of the embodiments of flexible containers, disclosed herein, any disclosure of a particular value, can, in various alternate embodiments, also be understood as a disclosure of a range equal to about that particular value (i.e. +/−20%).

As used herein, the term "ambient conditions" refers to a temperature within the range of 15-35 degrees Celsius and a relative humidity within the range of 35-75%.

As used herein, the term "approximately" modifies a particular value, by referring to a range equal to the particular value, plus or minus fifteen percent (+/−15%). For any of the embodiments of flexible containers, disclosed herein, any disclosure of a particular value, can, in various alternate embodiments, also be understood as a disclosure of a range equal to approximately that particular value (i.e. +/−15%).

As used herein, when referring to a sheet of material, the term "basis weight" refers to a measure of mass per area, in units of grams per square meter (gsm). For any of the embodiments of flexible containers, disclosed herein, in various embodiments, any of the flexible materials can be configured to have a basis weight of 10-1000 gsm, or any integer value for gsm from 10-1000, or within any range formed by any of these values, such as 20-800 gsm, 30-600 gsm, 40-400 gsm, or 50-200, etc.

As used herein, when referring to a flexible container, the term "bottom" refers to the portion of the container that is located in the lowermost 30% of the overall height of the container, that is, from 0-30% of the overall height of the container. As used herein, the term bottom can be further limited by modifying the term bottom with a particular percentage value, which is less than 30%. For any of the embodiments of flexible containers, disclosed herein, a reference to the bottom of the container can, in various alternate embodiments, refer to the bottom 25% (i.e. from 0-25% of the overall height), the bottom 20% (i.e. from 0-20% of the overall height), the bottom 15% (i.e. from 0-15% of the overall height), the bottom 10% (i.e. from 0-10% of the overall height), or the bottom 5% (i.e. from 0-5% of the overall height), or any integer value for percentage between 0% and 30%.

As used herein, the term "branding" refers to a visual element intended to distinguish a product from other products. Examples of branding include one of more of any of the following: trademarks, trade dress, logos, icons, and the like. For any of the embodiments of flexible containers, disclosed herein, in various embodiments, any surface of the flexible container can include one or more brandings of any size, shape, or configuration, disclosed herein or known in the art, in any combination.

As used herein, the term "character" refers to a visual element intended to convey information. Examples of characters include one or more of any of the following: letters, numbers, symbols, and the like. For any of the embodiments of flexible containers, disclosed herein, in various embodiments, any surface of the flexible container can include one or more characters of any size, shape, or configuration, disclosed herein or known in the art, in any combination.

As used herein, the term "closed" refers to a state of a product volume, wherein fluent products within the product volume are prevented from escaping the product volume (e.g. by one or more materials that form a barrier, and by a cap), but the product volume is not necessarily hermetically sealed. For example, a closed container can include a vent, which allows a head space in the container to be in fluid communication with air in the environment outside of the container.

As used herein, the term "deflation feature" refers to one or more structural features provided with a flexible container and configured for use in deflating some or all of the expanded structural support volume(s) of the flexible container, by allowing expansion material(s) inside of the structural support volume to escape into the environment, so that the structural support volume is no longer expanded. A deflation feature can be used when the flexible container is ready to be disposed of (i.e. as waste, compost, and/or recyclable material). Any of the flexible containers disclosed herein can be configured with any number of any kind of deflation feature, configured in any way disclosed herein or known in the art.

One kind of deflation feature is a cutting device, which is a rigid element that includes a point or edge configured to cut and/or pierce through flexible material(s) that form at least part of a structural support volume. As an example, a cutting device can be included with a flexible container by attaching the device to any portion of the outside (e.g. top, middle, side, bottom, etc.) of the container with adhesive, or under a label, or any other way known in the art, for externally attaching rigid elements to a container. As another example, a cutting device can be included with a flexible container by including the device with other packaging material, such as attached to an outer carton, inside of an overwrap layer, in between containers provided together, etc. As still another example, a cutting device can be included with a flexible container by including the device inside of any portion of the container, such as in a product volume, in a structural support volume, in a mixing chamber, in a dedicated space for the device, in a base structure, or any other way known in the art, for internally including rigid elements within a container. As yet another example, a cutting device can be included with a flexible container, by making the cutting device integral with or detachable from another rigid element that is part of the container, such as a rigid base structure, cap, dispenser, fitment, connecting element, reinforcing element, or any other rigid element for containers disclosed herein or known in the art. A cutting device can be configured to be any convenient size and any workable shape and can be used manually or through use of a tool. In addition to rigid elements, flexible materials that can be turned into a rigid cutting device through rolling up or folding flexible materials are also envisioned.

Another kind of deflation feature is an exit channel, which can be configured to be opened in material(s) that border or define at least a portion of the fillable space of a structural support volume. An exit channel can be an existing connection (e.g. seam, seal, or joint) in the container, which is configured to fail (e.g. separate and at least partially open) when exposed to opening forces. An exit channel can also be formed with one or more points, lines, and/or areas of weakness (e.g. thinned, scored, perforated, frangible seal, etc.), which are configured to fail or to otherwise be breached, when exposed to opening forces. An exit channel can be protected by another material, such as an adhesive label, to ensure the exit channel remains closed until the user wishes to deflate. An exit channel can further be formed by configuring the container with one or more tear initiation sites (such as a notch in an edge, a pull-tab, etc.) such that a tear propagating from the site(s) can open the flexible material. An exit channel can be configured to be any convenient size and any workable shape and can be opened manually (by grasping and pulling, by poking with a finger or fingernail, or any other way) or through use of a tool or by overpressurizing a structural support volume (through application of compressive force or controlled environmental conditions) such that the structural support volume fails when its expansion material(s) burst out.

Still another kind of deflation feature is a valve, connected to the fillable space of a structural support volume, wherein the valve can be opened to the container's environment. Embodiments of the present disclosure can use as a deflation feature, any and all embodiments of valves (including materials, structures, and/or features for valves, as well as any and all methods of making and/or using such valves), as disclosed in the following patent documents: U.S. nonprovisional patent application Ser. No. 13/379,655 filed Jun. 21, 2010, entitled "Collapsible Bottle, Method Of Manufacturing a Blank For Such Bottle and Beverage-Filled Bottle Dispensing System" in the name of Reidl, published as US2012/0097634; U.S. nonprovisional patent application Ser. No. 10/246,893 filed Sep. 19, 2002, entitled "Bubble-Seal Apparatus for Easily Opening a Sealed Package" in the name of Perell, et al., published as 20040057638; and U.S. Pat. No. 7,585,528 filed Dec. 16, 2002, entitled "Package having an inflated frame" in the name of Ferri, et al., granted on Sep. 8, 2009; each of which is hereby incorporated by reference.

As used herein, the term "directly connected" refers to a configuration wherein elements are attached to each other without any intermediate elements therebetween, except for any means of attachment (e.g. adhesive).

As used herein, when referring to a flexible container, the term "dispenser" refers to a structure configured to dispense fluent product(s) from a product volume and/or from a mixing volume to the environment outside of the container. For any of the flexible containers disclosed herein, any dispenser can be configured in any way disclosed herein or known in the art, including any suitable size, shape, and flow rate. For example, a dispenser can be a push-pull type dispenser, a dispenser with a flip-top cap, a dispenser with a screw-on cap, a rotatable type dispenser, dispenser with a cap, a pump type dispenser, a pump spray type dispenser, a trigger spray type dispenser, a straw dispenser, a flip up straw dispenser, a straw dispenser with bite valve, a dosing dispenser, etc. A dispenser can be a parallel dispenser, providing multiple flow channels in fluid communication with multiple product volumes, wherein those flow channels remain separate until the point of dispensing, thus allowing fluent products from multiple product volumes to be dispensed as separate fluent products, dispensed together at the same time. A dispenser can be a mixing dispenser, providing one or more flow channels in fluid communication with multiple product volumes, with multiple flow channels combined before the point of dispensing, thus allowing fluent products from multiple product volumes to be dispensed as the fluent products mixed together. As another example, a dispenser can be formed by a frangible opening. As further examples, a dispenser can utilize one or more valves and/or dispensing mechanisms disclosed in the art, such as those disclosed in: published US patent application 2003/0096068, entitled "One-way valve for inflatable package"; U.S. Pat. No. 4,988,016 entitled "Self-sealing container"; and U.S. Pat. No. 7,207,717, entitled "Package having a fluid actuated closure"; each of which is hereby incorporated by reference. Still further, any of the dispensers disclosed herein, may be incorporated into a flexible container either directly, or in combination with one or more other materials or structures (such as a fitment), or in any way known in the art. In some alternate embodiments, dispensers disclosed herein can be configured for both dispensing and filling, to allow filling of product volume(s) through one or more dispensers. In other alternate embodiments, a product volume can include one or more filling structure(s) (e.g. for adding water to a mixing volume) in addition to or instead of one or more dispenser(s). Any location for a dispenser, disclosed herein can alternatively be used as a location for a filling structure. In some embodiments, a product volume can include one or more filling structures in addition to any dispenser(s). And, any location for a dispenser, disclosed herein can alternatively be used as a location for an opening, through which product can be filled and/or dispensed, wherein the opening may be reclosable or non-reclosable, and can be configured in any way known in the art of packaging. For example, an opening can be: a line of weakness, which can be torn open; a zipper seal, which can be pulled open and pressed closed (e.g. a press seal), or opened and closed with a slider; openings with adhesive-based closures; openings with cohesive-based closures; openings with closures having fasteners (e.g. snaps, tin tie, etc.), openings with closures having micro-sized fasteners (e.g. with opposing arrays of interlocking fastening elements, such as hook, loops, and/or other mating elements, etc.), and any other kind of opening for packages or containers, with or without a closure, known in the art.

As used herein, when referring to a flexible container, the term "disposable" refers to a container which, after dispensing a product to an end user, is not configured to be refilled with an additional amount of the product, but is configured to be disposed of (i.e. as waste, compost, and/or recyclable material). Part, parts, or all of any of the embodiments of flexible containers, disclosed herein, can be configured to be disposable.

As used herein, when referring to a flexible container, the term "durable" refers to a container that is reusable more than non-durable containers.

As used herein, when referring to a flexible container, the term "effective base contact area" refers to a particular area defined by a portion of the bottom of the container, when the container (with all of its product volume(s) filled 100% with water) is standing upright and its bottom is resting on a horizontal support surface. The effective base contact area lies in a plane defined by the horizontal support surface. The effective base contact area is a continuous area bounded on all sides by an outer periphery.

The outer periphery is formed from an actual contact area and from a series of projected areas from defined cross-sections taken at the bottom of the container. The actual contact area is the one or more portions of the bottom of the container that contact the horizontal support surface, when the effective base contact area is defined. The effective base contact area includes all of the actual contact area. However, in some embodiments, the effective base contact area may extend beyond the actual contact area.

The series of projected area are formed from five horizontal cross-sections, taken at the bottom of the flexible container. These cross-sections are taken at 1%, 2%, 3%, 4%, and 5% of the overall height. The outer extent of each of these cross-sections is projected vertically downward onto the horizontal support surface to form five (overlapping) projected areas, which, together with the actual contact area, form a single combined area. This is not a summing up of the values for these areas, but is the formation of a single combined area that includes all of these (projected and actual) areas, overlapping each other, wherein any overlapping portion makes only one contribution to the single combined area.

The outer periphery of the effective base contact area is formed as described below. In the following description, the terms convex, protruding, concave, and recessed are understood from the perspective of points outside of the combined area. The outer periphery is formed by a combination of the outer extent of the combined area and any chords, which are straight line segments constructed as described below.

For each continuous portion of the combined area that has an outer perimeter with a shape that is concave or recessed, a chord is constructed across that portion. This chord is the shortest straight line segment that can be drawn tangent to the combined area on both sides of the concave/recessed portion.

For a combined area that is discontinuous (formed by two or more separate portions), one or more chords are constructed around the outer perimeter of the combined area, across the one or more discontinuities (open spaces disposed between the portions). These chords are straight lines segments drawn tangent to the outermost separate portions of the combined area. These chords are drawn to create the largest possible effective base contact area.

Thus, the outer periphery is formed by a combination of the outer extent of the combined area and any chords, constructed as described above, which all together enclose the effective base area. Any chords that are bounded by the combined area and/or one or more other chords, are not part of the outer periphery and should be ignored.

Any of the embodiments of flexible containers, disclosed herein, can be configured to have an effective base contact area from 1 to 50,000 square centimeters ($cm^2$), or any integer value for $cm^2$ between 1 and 50,000 $cm^2$, or within any range formed by any of the preceding values, such as: from 2 to 25,000 $cm^2$, 3 to 10,000 $cm^2$, 4 to 5,000 $cm^2$, 5 to 2,500 $cm^2$, from 10 to 1,000 $cm^2$, from 20 to 500 $cm^2$, from 30 to 300 $cm^2$, from 40 to 200 $cm^2$, or from 50 to 100 $cm^2$, etc.

As used herein, when referring to a flexible container, the term "expanded" refers to the state of one or more flexible materials that are configured to be formed into a structural support volume, after the structural support volume is made rigid by one or more expansion materials. An expanded structural support volume has an overall width that is significantly greater than the combined thickness of its one or more flexible materials, before the structural support volume is filled with the one or more expansion materials. Examples of expansion materials include liquids (e.g. water), gases (e.g. compressed air), fluent products, foams (that can expand after being added into a structural support volume), co-reactive materials (that produce gas), or phase change materials (that can be added in solid or liquid form, but which turn into a gas; for example, liquid nitrogen or dry ice), or other suitable materials known in the art, or combinations of any of these (e.g. fluent product and liquid nitrogen). In various embodiments, expansion materials can be added at atmospheric pressure, or added under pressure greater than atmospheric pressure, or added to provide a material change that will increase pressure to something above atmospheric pressure. For any of the embodiments of flexible containers, disclosed herein, its one or more flexible materials can be expanded at various points in time, with respect to its manufacture, sale, and use, including, for example: before or after its product volume(s) are filled with fluent product(s), before or after the flexible container is shipped to a seller, and before or after the flexible container is purchased by an end user.

As used herein the term "fill height" refers to a height of the product in the product volume as measured from a lower end of the product volume in the filling arrangement to a top line of the product. For example, the product volume can be filled from the bottom of the container, such that the lower end of the product volume in the filling arrangement is the top wall of the product volume when the flexible container is standing upright. The product volume can be filled from the top of the container, such that the lower end of the product volume is the bottom wall of the product volume when the flexible container is standing upright.

As used herein, when referring to a product volume of a flexible container, the term "filling" refers to the introduction of a product into the product volume, and the terms "fill" or "filled" refers to a condition of the product volume wherein product has been introduced thereto. The product volume need not be fully occupied by product in order for the product volume to be considered "filled", as there may, for example, be head space within the product volume in addition to product. As used herein, the term filled can be modified by using the term filled with a particular percentage value, wherein 100% filled represents the maximum capacity of the product volume. Alternately, the term "filled" can be modified by using the term filled with a qualitative or less-precise quantitative term that indicates an approximate degree of fill of the product volume, such as partially filled, fractionally filled, or mostly filled.

As used herein, the term "flat" refers to a surface that is without significant projections or depressions.

As used herein, the term "flexible container" refers to a container configured to have a product volume, wherein one or more flexible materials form 50-100% of the overall surface area of the one or more materials that define the three-dimensional space of the product volume. For any of the embodiments of flexible containers, disclosed herein, in various embodiments, the flexible container can be configured to have a product volume, wherein one or more flexible materials form a particular percentage of the overall area of the one or more materials that define the three-dimensional space, and the particular percentage is any integer value for percentage between 50% and 100%, or within any range formed by any of these values, such as: 60-100%, or 70-100%, or 80-100%, or 90-100%, etc. One kind of flexible container is a film-based container, which is a flexible container made from one or more flexible materials, which include a film.

For any of the embodiments of flexible containers, disclosed herein, in various embodiments, the middle of the flexible container (apart from any fluent product) can be configured to have an overall middle mass, wherein one or more flexible materials form a particular percentage of the overall middle mass, and the particular percentage is any integer value for percentage between 50% and 100%, or within any range formed by any of the preceding values, such as: 60-100%, or 70-100%, or 80-100%, or 90-100%, etc.

For any of the embodiments of flexible containers, disclosed herein, in various embodiments, the entire flexible container (apart from any fluent product) can be configured to have an overall mass, wherein one or more flexible materials form a particular percentage of the overall mass, and the particular percentage is any integer value for percentage between 50% and 100%, or within any range formed by any of the preceding values, such as: 60-100%, or 70-100%, or 80-100%, or 90-100%, etc.

As used herein, when referring to a flexible container, the term "flexible material" refers to a thin, easily deformable, sheet-like material, having a flexibility factor within the range of 1,000-2,500,000 N/m. For any of the embodiments of flexible containers, disclosed herein, in various embodiments, any of the flexible materials can be configured to have a flexibility factor of 1,000-2,500,000 N/m, or any integer value for flexibility factor from 1,000-2,500,000 N/m, or within any range formed by any of these values, such as 1,000-1,500,000 N/m, 1,500-1,000,000 N/m, 2,500-800,000 N/m, 5,000-700,000 N/m, 10,000-600,000 N/m, 15,000-500,000 N/m, 20,000-400,000 N/m, 25,000-300,000 N/m, 30,000-200,000 N/m, 35,000-100,000 N/m, 40,000-90,000 N/m, or 45,000-85,000 N/m, etc. Throughout the present disclosure the terms "flexible material", "flexible sheet", "sheet", and "sheet-like material" are used interchangeably and are intended to have the same meaning. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, and in any combination, as described herein or as known in the art.

As examples, flexible materials such as films and nonwovens, can be made from one or more thermoplastic polymers, as described herein and/or as known in the art. Thermoplastic polymers can include polyolefins such as polyethylene and/or copolymers thereof, including low density, high density, linear low density, or ultra low density polyethylenes. Polypropylene and/or polypropylene copolymers, including atactic polypropylene; isotactic polypropylene, syndiotactic polypropylene, and/or combinations thereof can also be used. Polybutylene is also a useful polyolefin.

Other suitable polymers include polyamides or copolymers thereof, such as Nylon 6, Nylon 11, Nylon 12, Nylon 46, Nylon 66; polyesters and/or copolymers thereof, such as maleic anhydride polypropylene copolymer, polyethylene terephthalate; olefin carboxylic acid copolymers such as ethylene/acrylic acid copolymer, ethylene/maleic acid copolymer, ethylene/methacrylic acid copolymer, ethylene/vinyl acetate copolymers or combinations thereof; polyacrylates, polymethacrylates, and/or their copolymers such as poly (methyl methacrylates).

Other nonlimiting examples of polymers include polyesters, polycarbonates, polyvinyl acetates, poly(oxymethylene), styrene copolymers, polyacrylates, polymethacrylates, poly(methyl methacrylates), polystyrene/methyl methacrylate copolymers, polyetherimides, polysulfones, and/or combinations thereof. In some embodiments, thermoplastic polymers can include polypropylene, polyethylene, polyamides, polyvinyl alcohol, ethylene acrylic acid, polyolefin carboxylic acid copolymers, polyesters, and/or combinations thereof.

Biodegradable thermoplastic polymers also are contemplated for use herein. Biodegradable materials are susceptible to being assimilated by microorganisms, such as molds, fungi, and bacteria when the biodegradable material is buried in the ground or otherwise contacts the microorganisms Suitable biodegradable polymers also include those biodegradable materials which are environmentally-degradable using aerobic or anaerobic digestion procedures, or by virtue of being exposed to environmental elements such as sunlight, rain, moisture, wind, temperature, and the like. The biodegradable thermoplastic polymers can be used individually or as a combination of biodegradable or non-biodegradable polymers. Biodegradable polymers include polyesters containing aliphatic components. Among the polyesters are ester polycondensates containing aliphatic constituents and poly(hydroxycarboxylic) acid. The ester polycondensates include diacids/diol aliphatic polyesters such as polybutylene succinate, polybutylene succinate co-adipate, aliphatic/aromatic polyesters such as terpolymers made of butylenes diol, adipic acid and terephthalic acid. The poly(hydroxycarboxylic) acids include lactic acid based homopolymers and copolymers, polyhydroxybutyrate (PHB), or other polyhydroxyalkanoate homopolymers and copolymers. Such polyhydroxyalkanoates include copolymers of PHB with higher chain length monomers, such as C6-C12, and higher, polyhydroxyalkanaotes, such as those disclosed in U.S. Pat. No. RE 36,548 and 5,990,271, polyglycolic acid, and polycaprolactone.

Non-limiting examples of suitable commercially available polymers include Basell Profax PH-835 (a 35 melt flow rate Ziegler-Natta isotactic polypropylene from Lyondell-Basell), Basell Metocene MF-650W (a 500 melt flow rate metallocene isotactic polypropylene from Lyondell-Basell), Polybond 3200 (a 250 melt flow rate maleic anhydride polypropylene copolymer from Crompton), Exxon Achieve 3854 (a 25 melt flow rate metallocene isotactic polypropylene from Exxon-Mobil Chemical), Mosten NB425 (a 25 melt flow rate Ziegler-Natta isotactic polypropylene from Unipetrol), Danimer 27510 (a polyhydroxyalkanoate polypropylene from Danimer Scientific LLC), Dow Aspun 6811A (a 27 melt index polyethylene polypropylene copolymer from Dow Chemical), and Eastman 9921 (a polyester terephthalic homopolymer with a nominally 0.81 intrinsic viscosity from Eastman Chemical), any biosourced materials for example, from Braskem, and acrylonitrile-methyl acrylate polymers, such as Barex.

A thermoplastic polymer component of a flexible material can be a single polymer species as described above or a blend of two or more thermoplastic polymers as described above.

Also as examples, flexible materials can further include one or more additives, as described herein and/or as known in the art. Non-limiting examples of classes of such additives include perfumes, dyes, pigments, nanoparticles, antistatic agents, fillers, photoactives, and other classes of additives known in the art, and combinations. The films disclosed herein can contain a single additive or a mixture of any number of additives.

Contemplated fillers include, but are not limited to inorganic fillers such as, for example, the oxides of magnesium, aluminum, silicon, and titanium. These materials can be added as inexpensive fillers or processing aides. Other inorganic materials that can function as fillers include hydrous magnesium silicate, titanium dioxide, calcium carbonate, clay, chalk, boron nitride, limestone, diatomaceous earth, mica glass quartz, and ceramics. Additionally, inorganic salts, including alkali metal salts, alkaline earth metal salts, phosphate salts, can be used. Additionally, alkyd resins can also be added as fillers. Alkyd resins can comprise a polyol, a polyacid or anhydride, and/or a fatty acid.

Additional contemplated additives include nucleating and clarifying agents for the thermoplastic polymer. Specific examples, suitable for polypropylene, for example, are benzoic acid and derivatives (e.g. sodium benzoate and lithium benzoate), as well as kaolin, talc and zinc glycerolate. Dibenzlidene sorbitol (DBS) is an example of a clarifying agent that can be used. Other nucleating agents that can be used are organocarboxylic acid salts, sodium phosphate and metal salts (for example aluminum dibenzoate).

Contemplated nanoparticles include metals, metal oxides, allotropes of carbon, clays, organically modified clays, sulfates, nitrides, hydroxides, oxy/hydroxides, particulate water-insoluble polymers, silicates, phosphates, and carbonates. Examples include silicon dioxide, carbon black, graphite, graphene, fullerenes, expanded graphite, carbon nanotubes, talc, calcium carbonate, bentonite, montmorillonite, kaolin, zinc glycerolate, silica, aluminosilicates, boron nitride, aluminum nitride, barium sulfate, calcium sulfate, antimony oxide, feldspar, mica, nickel, copper, iron, cobalt, steel, gold, silver, platinum, aluminum, wollastonite, aluminum oxide, zirconium oxide, titanium dioxide, cerium oxide, zinc oxide, magnesium oxide, tin oxide, iron oxides ($Fe_2O_3$, $Fe_3O_4$) and mixtures thereof.

Thermoplastic polymers, and their variations, as disclosed herein can be formed into a film and can comprise many different configurations, depending on the film properties desired. The properties of the film can be manipulated by varying, for example, the thickness, or in the case of multilayered films, the number of layers, the chemistry of the layers, i.e., hydrophobic or hydrophilic, and the types of polymers used to form the polymeric layers. The films disclosed herein can be multi-layer films. The film can have at least two layers (e.g., a first film layer and a second film layer). The first film layer and the second film layer can be layered adjacent to each other to form the multi-layer film. A multi-layer film can have at least three layers (e.g., a first film layer, a second film layer and a third film layer). The second film layer can at least partially overlie at least one of an upper surface or a lower surface of the first film layer. The third film layer can at least partially overlie the second film layer such that the second film layer forms a core layer. It is contemplated that multi-layer films can include additional layers (e.g., binding layers, non-permeable layers, etc.). It will be appreciated that multi-layer films can comprise from about 2 layers to about 1000 layers; in certain embodiments from about 3 layers to about 200 layers; and in certain embodiments from about 5 layers to about 100 layers, or any integer value for number of layers, in any of these ranges. For multi-layer films, each respective layer can be made from any material disclosed herein or known in the art, in any manner disclosed herein or known in the art.

A multi-layer film can include a 3-layer arrangement wherein a first film layer and a third film layer form the skin layers and a second film layer is formed between the first film layer and the third film layer to form a core layer. The third film layer can be the same or different from the first film layer, such that the third film layer can comprise a composition as described herein. It will be appreciated that similar film layers could be used to form multi-layer films having more than 3 layers. One embodiment for using multi-layer films is to control the location of the oil. For example, in a 3 layer film, the core layer may contain the oil while the outer layer do not. Alternatively, the inner layer may not contain oil and the outer layers do contain oil.

If incompatible layers are to be adjacent in a multi-layer film, a tie layer can be positioned between them. The purpose of the tie layer is to provide a transition and adequate adhesion between incompatible materials. An adhesive or tie layer is typically used between layers of layers that exhibit delamination when stretched, distorted, or deformed. The delamination can be either microscopic separation or macroscopic separation. In either event, the performance of the film may be compromised by this delamination. Consequently, a tie layer that exhibits adequate adhesion between the layers is used to limit or eliminate this delamination.

A tie layer is generally useful between incompatible materials. For instance, when a polyolefin and a copoly (ester-ether) are the adjacent layers, a tie layer is generally useful.

The tie layer is chosen according to the nature of the adjacent materials, and is compatible with and/or identical to one material (e.g. nonpolar and hydrophobic layer) and a reactive group which is compatible or interacts with the second material (e.g. polar and hydrophilic layer).

Suitable backbones for the tie layer include polyethylene (low density—LDPE, linear low density—LLDPE, high density—HDPE, and very low density—VLDPE) and polypropylene.

The reactive group may be a grafting monomer that is grafted to this backbone, and is or contains at least one alpha- or beta-ethylenically unsaturated carboxylic acid or anhydrides, or a derivative thereof. Examples of such carboxylic acids and anhydrides, which may be mono-, di-, or polycarboxylic acids, are acrylic acid, methacrylic acid, maleic acid, fumaric acid, itaconic acid, crotonic acid, itaconic anhydride, maleic anhydride, and substituted malic anhydride, e.g. dimethyl maleic anhydride. Examples of derivatives of the unsaturated acids are salts, amides, imides and esters e.g. mono- and disodium maleate, acrylamide, maleimide, and diethyl fumarate.

A particularly tie layer is a low molecular weight polymer of ethylene with about 0.1 to about 30 weight percent of one or more unsaturated monomers which can be copolymerized with ethylene, e.g., maleic acid, fumaric acid, acrylic acid, methacrylic acid, vinyl acetate, acrylonitrile, methacrylonitrile, butadiene, carbon monoxide, etc. Exemplary embodiments are acrylic esters, maleic anhydride, vinyl acetate, and methyacrylic acid. Anhydrides can be used as grafting monomers, for example maleic anhydride can be used.

An exemplary class of materials suitable for use as a tie layer is a class of materials known as anhydride modified ethylene vinyl acetate sold by DuPont under the tradename Bynel®, e.g., Bynel® 3860. Another material suitable for use as a tie layer is an anhydride modified ethylene methyl acrylate also sold by DuPont under the tradename Bynel®, e.g., Bynel® 2169. Maleic anhydride graft polyolefin polymers suitable for use as tie layers are also available from Elf Atochem North America, Functional Polymers Division, of Philadelphia, Pa. as Orevac™.

Alternatively, a polymer suitable for use as a tie layer material can be incorporated into the composition of one or more of the layers of the films as disclosed herein. By such incorporation, the properties of the various layers are modified so as to improve their compatibility and reduce the risk of delamination.

Other intermediate layers besides tie layers can be used in the multi-layer film disclosed herein. For example, a layer of a polyolefin composition can be used between two outer layers of a hydrophilic resin to provide additional mechanical strength to the extruded web. Any number of intermediate layers may be used.

Examples of suitable thermoplastic materials for use in forming intermediate layers include polyethylene resins such as low density polyethylene (LDPE), linear low density polyethylene (LLDPE), ethylene vinyl acetate (EVA), ethylene methyl acrylate (EMA), polypropylene, and poly (vinyl chloride). Polymeric layers of this type can have mechanical properties that are substantially equivalent to those described above for the hydrophobic layer.

In addition to being formed from the compositions described herein, the films can further include additional additives. For example, opacifying agents can be added to one or more of the film layers. Such opacifying agents can include iron oxides, carbon black, aluminum, aluminum oxide, titanium dioxide, talc and combinations thereof. These opacifying agents can comprise about 0.1% to about 5% by weight of the film; and in certain embodiments, the opacifying agents can comprise about 0.3% to about 3% of the film. It will be appreciated that other suitable opacifying agents can be employed and in various concentrations. Examples of opacifying agents are described in U.S. Pat. No. 6,653,523.

Furthermore, the films can comprise other additives, such as other polymers materials (e.g., a polypropylene, a polyethylene, a ethylene vinyl acetate, a polymethylpentene any combination thereof, or the like), a filler (e.g., glass, talc, calcium carbonate, or the like), a mold release agent, a flame retardant, an electrically conductive agent, an anti-static agent, a pigment, an antioxidant, an impact modifier, a stabilizer (e.g., a UV absorber), wetting agents, dyes, a film anti-static agent or any combination thereof. Film antistatic agents include cationic, anionic, and/or, nonionic agents. Cationic agents include ammonium, phosphonium and sulphonium cations, with alkyl group substitutions and an associated anion such as chloride, methosulphate, or nitrate. Anionic agents contemplated include alkylsulphonates. Nonionic agents include polyethylene glycols, organic stearates, organic amides, glycerol monostearate (GMS), alkyl di-ethanolamides, and ethoxylated amines. Other filler materials can comprise fibers, structural reinforcing agents, and all types of biosourced materials such as oils (hydrogenated soy bean oil), fats, starch, etc.

For any of the flexible materials, materials that are safe/approved for food contact may be selected. Additionally, materials that are approved for medical usage, or materials that can be sterilized through retort, autoclave, or radiation treatment, or other sterilization processes known in the art, may be used.

In various embodiments, part, parts, or all of a flexible material can be coated or uncoated, treated or untreated, processed or unprocessed, in any manner known in the art. In various embodiments, parts, parts, or about all, or approximately all, or substantially all, or nearly all, or all of a flexible material can made of sustainable, bio-sourced, recycled, recyclable, and/or biodegradable material. Part, parts, or about all, or approximately all, or substantially all, or nearly all, or all of any of the flexible materials described herein can be partially or completely translucent, partially or completely transparent, or partially or completely opaque.

With regard to films and elastomers for use as flexible materials, these can be formed in any manner known in the art, such as casting, extruding (blown or flat; singly or with coextrusion), calendering, depositing solution(s), skiving, etc. then slitting, cutting, and/or converting the films and/or elastomers into the desired sizes or shapes, as sheets or webs, as will be understood by one skilled in the art. With regard to blown films, multiple processes can be used including: collapsed bubble to create a blocked film, and double and or triple bubble processes. Flexible materials may further be subjected to any number or orienting, tenter frame, tenter hook, stretching, or activation processes. With regard to foamed sheets for use as flexible materials, these can be formed in any manner known in the art, by mixing base ingredients, adding the foaming mixture to a mold or shaping apparatus, then curing, cutting, and/or converting the foam into the desired sizes or shapes, as sheets or webs. With regard to nonwoven fabrics, these can be formed in any manner known in the art using spunbonded fibers and/or meltblown fibers, staple-length and/or continuous fibers, with any layering, mixing, or other combination known in the art. Other materials listed herein for use as flexible materials can be made in any manner known in the art.

The flexible materials used to make the containers disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these.

As used herein, when referring to a flexible container, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, when referring to a flexible container, the term "fluent product" refers to one or more liquids and/or pourable solids, and combinations thereof. Examples of fluent products include one or more of any of the following: bites, bits, creams, chips, chunks, crumbs, crystals, emulsions, flakes, gels, grains, granules, jellies, kibbles, liquid solutions, liquid suspensions, lotions, nuggets, ointments, particles, particulates, pastes, pieces, pills, powders, salves, shreds, sprinkles, and the like, either individually or in any combination. Throughout the present disclosure the terms "fluent product" and "flowable product" are used interchangeably and are intended to have the same meaning. Any of the product volumes disclosed herein can be configured to include one or more of any fluent product disclosed herein, or known in the art, in any combination.

As used herein, when referring to a flexible container, the term "formed" refers to the state of one or more materials that are configured to be formed into a product volume, after the product volume is provided with its defined three-dimensional space.

As used herein, the term "graphic" refers to a visual element intended to provide a decoration or to communicate information. Examples of graphics include one or more of any of the following: colors, patterns, designs, images, and the like. For any of the embodiments of flexible containers, disclosed herein, in various embodiments, any surface of the flexible container can include one or more graphics of any size, shape, or configuration, disclosed herein or known in the art, in any combination.

As used herein, when referring to a flexible container, the term "height area ratio" refers to a ratio for the container, with units of per centimeter ($cm^{-1}$), which is equal to the value for the overall height of the container (with all of its product volume(s) filled 100% with water, and with overall height measured in centimeters) divided by the value for the effective base contact area of the container (with all of its product volume(s) filled 100% with water, and with effective base contact area measured in square centimeters). For any of the embodiments of flexible containers, disclosed herein, in various embodiments, any of the flexible containers, can be configured to have a height area ratio from 0.3 to 3.0 per centimeter, or any value in increments of 0.05 $cm^{-1}$ between 0.3 and 3.0 per centimeter, or within any range formed by any of the preceding values, such as: from 0.35 to 2.0 $cm^{-1}$, from 0.4 to 1.5 $cm^{-1}$, from 0.4 to 1.2 $cm^{-1}$, or from 0.45 to 0.9 $cm^{-1}$, etc.

As used herein, the term "indicia" refers to one or more of characters, graphics, branding, or other visual elements, in any combination. For any of the embodiments of flexible containers, disclosed herein, in various embodiments, any surface of the flexible container can include one or more indicia of any size, shape, or configuration, disclosed herein or known in the art, in any combination.

As used herein, the term "indirectly connected" refers to a configuration wherein elements are attached to each other with one or more intermediate elements therebetween.

As used herein, the term "joined" refers to a configuration wherein elements are either directly connected or indirectly connected.

As used herein, the term "lateral" refers to a direction, orientation, or measurement that is parallel to a lateral centerline of a container, when the container is standing upright on a horizontal support surface, as described herein. A lateral orientation may also be referred to a "horizontal" orientation, and a lateral measurement may also be referred to as a "width."

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered. Like-numbered elements can have labels with a differing first digit, wherein that first digit matches the number for its figure; as an example, an element of FIG. 3 labeled 320 and an element of FIG. 4 labeled 420 are like-numbered. Like-numbered elements can have labels with a suffix (i.e. the portion of the label following the dash symbol) that is the same or possibly different (e.g. corresponding with a particular embodiment); for example, a first embodiment of an element in FIG. 3A labeled 320-*a* and a second embodiment of an element in FIG. 3B labeled 320-*b*, are like numbered.

As used herein, the term "longitudinal" refers to a direction, orientation, or measurement that is parallel to a longitudinal centerline of a container, when the container is standing upright on a horizontal support surface, as described herein. A longitudinal orientation may also be referred to a "vertical" orientation. When expressed in relation to a horizontal support surface for a container, a longitudinal measurement may also be referred to as a "height", measured above the horizontal support surface.

As used herein, when referring to a flexible container, the term "middle" refers to the portion of the container that is located in between the top of the container and the bottom of the container. As used herein, the term middle can be modified by describing the term middle with reference to a particular percentage value for the top and/or a particular percentage value for the bottom. For any of the embodiments of flexible containers, disclosed herein, a reference to the middle of the container can, in various alternate embodiments, refer to the portion of the container that is located between any particular percentage value for the top, disclosed herein, and/or any particular percentage value for the bottom, disclosed herein, in any combination.

As used herein, the term "mixing volume" refers to a type product volume that is configured to receive one or more fluent product(s) from one or more product volumes and/or from the environment outside of the container.

As used herein, when referring to a product volume, the term "multiple dose" refers to a product volume that is sized to contain a particular amount of product that is about equal to two or more units of typical consumption, application, or use by an end user. Any of the embodiments of flexible containers, disclosed herein, can be configured to have one or more multiple dose product volumes. A container with only one product volume, which is a multiple dose product volume, is referred to herein as a "multiple dose container."

As used herein, the term "nearly" modifies a particular value, by referring to a range equal to the particular value, plus or minus five percent (+/−5%). For any of the embodiments of flexible containers, disclosed herein, any disclosure of a particular value, can, in various alternate embodiments, also be understood as a disclosure of a range equal to approximately that particular value (i.e. +/−5%).

As used herein, when referring to a flexible container, the term "non-durable" refers to a container that is temporarily reusable, or disposable, or single use.

As used herein, when referring to a flexible container, the term "non-fluent product" refers to materials, products, and/or articles that are not liquids, pourable solids, or combinations or liquids and pourable solids. Any of the flexible containers disclosed herein can be configured for packaging one or more of any non-fluent product disclosed herein, or known in the art, in any combination. When used for non-fluent products, flexible containers, as disclosed herein, can provide benefits associated with partly or fully supporting and/or enclosing the non-fluent product with primary and/or secondary packaging that includes one or more structural support volumes, one or more structural support members, and/or one or more structural support frames; for example, so the non-fluent product can be supported and/or enclosed by packaging that is self-supporting and/or standing upright, as will be understood by one skilled in the art.

As used herein, when referring to a flexible container, the term "nonstructural panel" refers to a layer of one or more adjacent sheets of flexible material, the layer having an outermost major surface that faces outward, toward the environment outside of the flexible container, and an innermost major surface that faces inward, toward product volume(s) disposed within the flexible container; a nonstructural panel is configured such that, the layer, does not independently provide substantial support in making the container self-supporting and/or standing upright.

As used herein, when referring to a flexible container, the term "overall height" refers to a distance that is measured while the container is standing upright on a horizontal support surface, the distance measured vertically from the upper side of the support surface to a point on the top of the container, which is farthest away from the upper side of the support surface. Any of the embodiments of flexible containers, disclosed herein, can be configured to have an overall height from 2.0 cm to 100.0 cm, or any value in increments of 0.1 cm between 2.0 and 100.0 cm, or within any range formed by any of the preceding values, such as: from 4.0 to 90.0 cm, from 5.0 to 80.0 cm, from 6.0 to 70.0 cm, from 7.0 to 60.0 cm, from 8.0 to 50.0 cm, from 9.0 to 40.0 cm, or from 10.0 to 30.0, etc.

As used herein, when referring to a sheet of flexible material, the term "overall thickness" refers to a linear dimension measured perpendicular to the outer major surfaces of the sheet, when the sheet is lying flat. For any of the embodiments of flexible containers, disclosed herein, in various embodiments, any of the flexible materials can be configured to have an overall thickness 5-500 micrometers (μm), or any integer value for micrometers from 5-500, or within any range formed by any of these values, such as 10-500 μm, 20-400 μm, 30-300 μm, 40-200 μm, 50-100 μm, or 50-150 μm, etc.

As used herein, the term "pre-expansion headspace" refers to the amount of volume in a sealed product volume, before structural support volumes are expanded, that is not occupied by a product, but occupied by a gas, either the environment in which the product is packed, or any other gas, such as modified atmosphere (e.g. nitrogen gas, carbon dioxide or carbon monoxide, etc.). In various embodiments, the pre-expansion headspace can be reduced from an initial, first pre-expansion headspace at the time of filling to a second pre-expansion headspace by application of an external force on the flexible package before the product volume is sealed. The value selected for the second pre-expansion headspace along with the product fill volume together determine whether the product volume will be under pressure (greater than atmospheric), at atmospheric pressure, or under a vacuum (pressure less than atmospheric) upon expansion of the one or more structural support volume that at least partially extends into the product volume.

As used herein, the term "post-expansion headspace" refers to the amount of volume in a sealed product volume, after the structure support volumes are expanded, that is not occupied by a product, but occupied by a gas, either the environment in which the product is packed, or any other gas, such as modified atmosphere (e.g. nitrogen gas, carbon dioxide or carbon monoxide, etc.).

As used herein, the term "product fill volume" refers to the amount of product introduced into the product volume of a container. This value does not change after the process of filling the product volume is complete.

As used herein, the term "product receiving volume" refers to an available volume of the product volume for receiving a product. The product receiving volume of a flexible container can change depending on the state of the structural support volume (expanded or unexpanded) and the amount of headspace provided for in the product volume. When the structural support volume is in an unexpanded state, the product receiving volume is equal to the maximum total volume of the flexible container. In this state, the product receiving volume is also referred to herein as the "first product receiving volume." The maximum total volume of the flexible container is a constant as determined by the geometry and amount of flexible material used to create the container. In various embodiments, product is introduced into the product volume when the structural support volume is in an unexpanded state. During filling the product is introduced into the product volume to a determined product fill volume, which is less than the maximum total volume. The remaining portion of the maximum total volume is consumed by the first (initial) pre-expansion headspace. In various embodiments, an external force can be applied to the flexible container to reduce the product receiving volume, which in turn reduces the first pre-expansion headspace to the second pre-expansion headspace. The reduced product receiving volume resulting from application of the external force is also referred to herein as the "second product receiving volume." At least one structural support volume can be arranged such that upon expansion, at least a portion of the structural support volume extends into the product volume, thereby changing the product receiving volume. The product receiving volume after expansion of the at least one structural support volume is also referred to herein as a "third product receiving volume" or a "final product receiving volume." The third (final) product receiving volume is equal to the product fill volume plus a post-expansion headspace. In the product filled and structural volume expanded state, the sum of the volume of the expanded structural support volume extending into the product volume, the product fill volume, and the product receiving volume is equal to the maximum product volume.

As used herein, the term "product volume" refers to an enclosable three-dimensional space that is configured to receive and directly contain one or more fluent product(s), wherein that space is defined by one or more materials that form a barrier that prevents the fluent product(s) from escaping the product volume. By directly containing the one or more fluent products, the fluent products come into contact with the materials that form the enclosable three-dimensional space; there is no intermediate material or container, which prevents such contact. Throughout the present disclosure the terms "product volume" and "product receiving volume" are used interchangeably and are intended to have the same meaning. Any of the embodiments of flexible containers, disclosed herein, can be configured to have any number of product volumes including one product volume, two product volumes, three product volumes, four product volumes, five product volumes, six product volumes, or even more product volumes. In some embodiments, one or more product volumes can be enclosed within another product volume. Any of the product volumes disclosed herein can have a product volume of any size, including from 0.001 liters to 100.0 liters, or any value in increments of 0.001 liters between 0.001 liters and 3.0 liters, or any value in increments of 0.01 liters between 3.0 liters and 10.0 liters, or any value in increments of 1.0 liters between 10.0 liters and 100.0 liters, or within any range formed by any of the preceding values, such as: from 0.001 to 2.2 liters, 0.01 to 2.0 liters, 0.05 to 1.8 liters, 0.1 to 1.6 liters, 0.15 to 1.4 liters, 0.2 to 1.2 liters, 0.25 to 1.0 liters, etc. A product volume can have any shape in any orientation. A product volume can be included in a container that has a structural support frame, and a product volume can be included in a container that does not have a structural support frame.

As used herein, when referring to a flexible container, the term "resting on a horizontal support surface" refers to the container resting directly on the horizontal support surface, without other support.

As used herein, the term "sealed," when referring to a product volume, refers to a state of the product volume wherein fluent products within the product volume are prevented from escaping the product volume (e.g. by one or more materials that form a barrier, and by a seal), and the product volume is hermetically sealed.

As used herein, when referring to a flexible container, the term "self-supporting" refers to a container that includes a product volume and a structural support frame, wherein, when the container is resting on a horizontal support surface, in at least one orientation, the structural support frame is configured to prevent the container from collapsing and to give the container an overall height that is significantly greater than the combined thickness of the materials that form the container, even when the product volume is unfilled. Any of the embodiments of flexible containers, disclosed herein, can be configured to be self-supporting. As examples, self-supporting flexible containers of the present disclosure can be used to form pillow packs, pouches, doy packs, sachets, tubes, boxes, tubs, cartons, flow wraps, gusseted packs, jugs, bottles, jars, bags in boxes, trays, hanging packs, blister packs, or any other forms known in the art.

As used herein, when referring to a flexible container, the term "single use" refers to a closed container which, after being opened by an end user, is not configured to be reclosed. Any of the embodiments of flexible containers, disclosed herein, can be configured to be single use.

As used herein, when referring to a product volume, the term "single dose" refers to a product volume that is sized to contain a particular amount of product that is about equal to one unit of typical consumption, application, or use by an end user. Any of the embodiments of flexible containers, disclosed herein, can be configured to have one or more single dose product volumes. A container with only one product volume, which is a single dose product volume, is referred to herein as a "single dose container."

As used herein, when referring to a flexible container, the terms "stand up," "stands up," "standing up", "stand upright", "stands upright", and "standing upright" refer to a particular orientation of a self-supporting flexible container, when the container is resting on a horizontal support surface. This standing upright orientation can be determined from the structural features of the container and/or indicia on the container. In a first determining test, if the flexible container has a clearly defined base structure that is configured to be used on the bottom of the container, then the container is determined to be standing upright when this base structure is resting on the horizontal support surface. If the first test cannot determine the standing upright orientation, then, in a second determining test, the container is determined to be standing upright when the container is oriented to rest on the horizontal support surface such that the indicia on the flexible container are best positioned in an upright orientation. If the second test cannot determine the standing upright orientation, then, in a third determining test, the container is determined to be standing upright when the container is oriented to rest on the horizontal support surface such that the container has the largest overall height. If the third test cannot determine the standing upright orientation, then, in a fourth determining test, the container is determined to be standing upright when the container is oriented to rest on the horizontal support surface such that the container has the largest height area ratio. If the fourth test cannot determine the standing upright orientation, then, any orientation used in the fourth determining test can be considered to be a standing upright orientation.

As used herein, when referring to a flexible container, the term "stand up container" refers to a self-supporting container, wherein, when the container (with all of its product volume(s) filled 100% with water) is standing up, the container has a height area ratio from 0.4 to 1.5 $cm^{-1}$. Any of the embodiments of flexible containers, disclosed herein, can be configured to be stand up containers.

As used herein, when referring to a flexible container, the term "structural support frame" refers to a rigid structure formed of one or more structural support members, joined together, around one or more sizable empty spaces and/or one or more nonstructural panels, and generally used as a major support for the product volume(s) in the flexible container and in making the container self-supporting and/or standing upright. In each of the embodiments disclosed herein, when a flexible container includes a structural support frame and one or more product volumes, the structural support frame is considered to be supporting the product volumes of the container, unless otherwise indicated.

As used herein, when referring to a flexible container, the term "structural support member" refers to a rigid, physical structure, which includes one or more expanded structural support volumes, and which is configured to be used in a structural support frame, to carry one or more loads (from the flexible container) across a span. A structure that does not include at least one expanded structural support volume, is not considered to be a structural support member, as used herein.

A structural support member has two defined ends, a middle between the two ends, and an overall length from its one end to its other end. A structural support member can have one or more cross-sectional areas, each of which has an overall width that is less than its overall length.

A structural support member can be configured in various forms. A structural support member can include one, two, three, four, five, six or more structural support volumes, arranged in various ways. For example, a structural support member can be formed by a single structural support volume. As another example, a structural support member can be formed by a plurality of structural support volumes, disposed end to end, in series, wherein, in various embodiments, part, parts, or about all, or approximately all, or substantially all, or nearly all, or all of some or all of the structural support volumes can be partly or fully in contact with each other, partly or fully directly connected to each other, and/or partly or fully joined to each other. As a further example, a structural support member can be formed by a plurality of support volumes disposed side by side, in parallel, wherein, in various embodiments, part, parts, or about all, or approximately all, or substantially all, or nearly all, or all of some or all of the structural support volumes can be partly or fully in contact with each other, partly or fully directly connected to each other, and/or partly or fully joined to each other.

In some embodiments, a structural support member can include a number of different kinds of elements. For example, a structural support member can include one or more structural support volumes along with one or more mechanical reinforcing elements (e.g. braces, collars, connectors, joints, ribs, etc.), which can be made from one or more rigid (e.g. solid) materials.

Structural support members can have various shapes and sizes. Part, parts, or about all, or approximately all, or substantially all, or nearly all, or all of a structural support member can be straight, curved, angled, segmented, or other shapes, or combinations of any of these shapes. Part, parts, or about all, or approximately all, or substantially all, or nearly all, or all of a structural support member can have any suitable cross-sectional shape, such as circular, oval, square, triangular, star-shaped, or modified versions of these shapes, or other shapes, or combinations of any of these shapes. A structural support member can have an overall shape that is tubular, or convex, or concave, along part, parts, or about all, or approximately all, or substantially all, or nearly all, or all of a length. A structural support member can have any suitable cross-sectional area, any suitable overall width, and any suitable overall length. A structural support member can be substantially uniform along part, parts, or about all, or approximately all, or substantially all, or nearly all, or all of its length, or can vary, in any way described herein, along part, parts, or about all, or approximately all, or substantially all, or nearly all, or all of its length. For example, a cross-sectional area of a structural support member can increase or decrease along part, parts, or all of its length. Part, parts, or all of any of the embodiments of structural support members of the present disclosure, can be configured according to any embodiment disclosed herein, including any workable combination of structures, features, materials, and/or connections from any number of any of the embodiments disclosed herein.

As used herein, when referring to a flexible container, the term "structural support volume" refers to a fillable space made from one or more flexible materials, wherein the space is configured to be at least partially filled with one or more expansion materials, which create tension in the one or more flexible materials, and form an expanded structural support volume. One or more expanded structural support volumes can be configured to be included in a structural support member. A structural support volume is distinct from structures configured in other ways, such as: structures without a fillable space (e.g. an open space), structures made from inflexible (e.g. solid) materials, structures with spaces that are not configured to be filled with an expansion material (e.g. an unattached area between adjacent layers in a multilayer panel), and structures with flexible materials that are not configured to be expanded by an expansion material (e.g. a space in a structure that is configured to be a non-structural panel). Notably, in various embodiments, any spaces defined by the unattached area between adjacent layers in a multilayer panel may contain any gas or vapor composition of single or multiple chemistries including air, nitrogen or a gas composition comprising, as examples, greater than 80% nitrogen, greater than 20% carbon dioxide, greater than 10% of a noble gas, less than 15% oxygen; the gas or vapor contained in such spaces may include water vapor at a relative humidity of 0-100%, or any integer percentage value in this range. Throughout the present disclosure the terms "structural support volume" and "expandable chamber" are used interchangeably and are intended to have the same meaning.

In some embodiments, a structural support frame can include a plurality of structural support volumes, wherein some of or all of the structural support volumes are in fluid communication with each other. In other embodiments, a structural support frame can include a plurality of structural support volumes, wherein some of or none of the structural support volumes are in fluid communication with each other. Any of the structural support frames of the present disclosure can be configured to have any kind of fluid communication disclosed herein.

As used herein, the term "substantially" modifies a particular value, by referring to a range equal to the particular value, plus or minus ten percent (+/−10%). For any of the embodiments of flexible containers, disclosed herein, any disclosure of a particular value, can, in various alternate embodiments, also be understood as a disclosure of a range equal to approximately that particular value (i.e. +/−10%).

As used herein, when referring to a flexible container, the term "temporarily reusable" refers to a container which, after dispensing a product to an end user, is configured to be refilled with an additional amount of a product, up to ten times, before the container experiences a failure that renders it unsuitable for receiving, containing, or dispensing the product. As used herein, the term temporarily reusable can be further limited by modifying the number of times that the container can be refilled before the container experiences such a failure. For any of the embodiments of flexible containers, disclosed herein, a reference to temporarily reusable can, in various alternate embodiments, refer to temporarily reusable by refilling up to eight times before failure, by refilling up to six times before failure, by refilling up to four times before failure, or by refilling up to two times before failure, or any integer value for refills between one and ten times before failure. Any of the embodiments of flexible containers, disclosed herein, can be configured to be temporarily reusable, for the number of refills disclosed herein.

As used herein, the term "thickness" refers to a measurement that is parallel to a third centerline of a container, when the container is standing upright on a horizontal support surface, as described herein. A thickness may also be referred to as a "depth."

As used herein, when referring to a flexible container, the term "top" refers to the portion of the container that is located in the uppermost 20% of the overall height of the container, that is, from 80-100% of the overall height of the container. As used herein, the term top can be further limited by modifying the term top with a particular percentage value, which is less than 20%. For any of the embodiments of flexible containers, disclosed herein, a reference to the top of the container can, in various alternate embodiments, refer to the top 15% (i.e. from 85-100% of the overall height), the top 10% (i.e. from 90-100% of the overall height), or the top 5% (i.e. from 95-100% of the overall height), or any integer value for percentage between 0% and 20%.

As used herein, when referring to a flexible container, the term "unexpanded" refers to the state of one or more materials that are configured to be formed into a structural support volume, before the structural support volume is made rigid by an expansion material.

As used herein, when referring to a product volume of a flexible container, the term "unfilled" refers to the state of the product volume when it does not contain a fluent product.

As used herein, when referring to a flexible container, the term "unformed" refers to the state of one or more materials that are configured to be formed into a product volume, before the product volume is provided with its defined three-dimensional space. For example, an article of manufacture could be a container blank with an unformed product volume, wherein sheets of flexible material, with portions joined together, are laying flat against each other.

As used herein, the term "unit operation" refers to a transformation of a flexible material when forming a flexible container that is performed while the web or sheet of flexible material is held in registration with a single tool. The unit operation can be performed with one or more tools, but registration of the web or sheet is maintained throughout the unit operation with a single tool despite the use of multiple tools. In an embodiment, the unit operation can be accomplished, for example, using a single tool or apparatus. For example, a sealing and cutting transformation of the web or sheet can occur in a unit operation using a single sealing apparatus having a sealing surface that imparts a sealing surface for both sealing and cutting the sealing apparatus. Additionally, the unit operation could consist of multiple sealing and cutting tools that seal and cut while the film is held in registration with one of the tools, for example the sealing tool, during the entirety of the unit operation. Sealing and cutting may happen within the unit operation simultaneously, nearly simultaneously, or sequentially.

Flexible containers, as described herein, may be used across a variety of industries for a variety of products. For example, any embodiment of flexible containers, as described herein, may be used across the consumer products industry, including any of the following products, any of which can take any workable fluent product form described herein or known in the art: baby care products (e.g. soaps, shampoos, and lotions); beauty care products for cleaning, treating, beautifying, and/or decorating human or animal hair (e.g. hair shampoos, hair conditioners, hair dyes, hair colorants, hair repair products, hair growth products, hair removal products, hair minimization products, etc.); beauty care products for cleaning, treating, beautifying, and/or decorating human or animal skin (e.g. soaps, body washes, body scrubs, facial cleansers, astringents, sunscreens, sun block lotions, lip balms, cosmetics, skin conditioners, cold creams, skin moisturizers, antiperspirants, deodorants, etc.); beauty care products for cleaning, treating, beautifying, and/or decorating human or animal nails (e.g. nail polishes, nail polish removers, etc.); grooming products for cleaning, treating, beautifying, and/or decorating human facial hair (e.g. shaving products, pre-shaving products, after shaving products, etc.); health care products for cleaning, treating, beautifying, and/or decorating human or animal oral cavities (e.g. toothpaste, mouthwash, breath freshening products, anti-plaque products, tooth whitening products, etc.); health care products for treating human and/or animal health conditions (e.g. medicines, medicaments, pharmaceuticals, vitamins, nutraceuticals, nutrient supplements (for calcium, fiber, etc.), cough treatment products, cold remedies, lozenges, treatments for respiratory and/or allergy conditions, pain relievers, sleep aids, gastrointestinal treatment products (for heartburn, upset stomach, diarrhea, irritable bowel syndrome, etc.), purified water, treated water, etc.); pet care products for feeding and/or caring for animals (e.g. pet food, pet vitamins, pet medicines, pet chews, pet treats, etc.); fabric care products for cleaning, conditioning, refreshing and/or treating fabrics, clothes and/or laundry (e.g. laundry detergents, fabric conditioners, fabric dyes, fabric bleaches, etc.); dish care products for home, commercial, and/or industrial use (e.g. dish soaps and rinse aids for hand-washing and/or machine washing); cleaning and/or deodorizing products for home, commercial, and/or industrial use (e.g. soft surface cleaners, hard surface cleaners, glass cleaners, ceramic tile cleaners, carpet cleaner, wood cleaners, multi-surface cleaners, surface disinfectants, kitchen cleaners, bath cleaners (e.g. sink, toilet, tub, and/or shower cleaners), appliance cleaning products, appliance treatment products, car cleaning products, car deodorizing products, air cleaners, air deodorizers, air disinfectants, etc.), and the like.

As further examples, any embodiment of flexible containers, as described herein, may be used across additional areas of home, commercial, and/or industrial, building and/or grounds, construction and/or maintenance, including any of the following products, any of which can take any workable fluent product form (e.g. liquid, granular, powdered, etc.) described herein or known in the art: products for establishing, maintaining, modifying, treating, and/or improving lawns, gardens, and/or grounds (e.g. grass seeds, vegetable seeds, plant seeds, birdseed, other kinds of seeds, plant food, fertilizer, soil nutrients and/or soil conditions (e.g. nitrogen, phosphate, potash, lime, etc.), soil sterilants, herbicides, weed preventers, pesticides, pest repellents, insecticides, insect repellents, etc.); products for landscaping use (e.g. topsoils, potting soils, general use soils, mulches, wood chips, tree bark nuggets, sands, natural stones and/or rocks (e.g. decorative stones, pea gravel, gravel, etc.) of all kinds, man-made compositions based on stones and rocks (e.g. paver bases, etc.)); products for starting and/or fueling fires in grills, fire pits, fireplaces, etc. (e.g. fire logs, fire starting nuggets, charcoal, lighter fluid, matches, etc.); lighting products (e.g. light bulbs and light tubes or all kinds including: incandescents, compact fluorescents, fluorescents, halogens, light emitting diodes, of all sizes, shapes, and uses); chemical products for construction, maintenance, remodeling, and/or decorating (e.g. concretes, cements, mortars, mix colorants, concrete curers/sealants, concrete protectants, grouts, blacktop sealants, crack filler/repair products, spackles, joint compounds, primers, paints, stains, topcoats, sealants, caulks, adhesives, epoxies, drain cleaning/declogging products, septic treatment products, etc.); chemical products (e.g. thinners, solvents, and strippers/removers including alcohols, mineral spirits, turpentines, linseed oils, etc.); water treatment products (e.g. water softening products such as salts, bacteriostats, fungicides, etc.); fasteners of all kinds (e.g. screws, bolts, nuts, washers, nails, staples, tacks, hangers, pins, pegs, rivets, clips, rings, and the like, for use with/in/on wood, metal, plastic, concrete, concrete, etc.); and the like.

As further examples, any embodiment of flexible containers, as described herein, may be used across the food and beverage industry, including any of the following products, any of which can take any workable fluent product form described herein or known in the art: foods such as basic ingredients (e.g. grains such as rice, wheat, corn, beans, and derivative ingredients made from any of these, as well as nuts, seeds, and legumes, etc.), cooking ingredients (e.g. sugar, spices such as salt and pepper, cooking oils, vinegars, tomato pastes, natural and artificial sweeteners, flavorings, seasonings, etc.), baking ingredients (e.g. baking powders, starches, shortenings, syrups, food colorings, fillings, gelatins, chocolate chips and other kinds of chips, frostings, sprinkles, toppings, etc.), dairy foods (e.g. creams, yogurts, sour creams, wheys, caseins, etc.), spreads (e.g. jams, jellies, etc.), sauces (e.g. barbecue sauces, salad dressings, tomato sauces, etc.), condiments (e.g. ketchups, mustards, relishes, mayonnaises, etc.), processed foods (noodles and pastas, dry cereals, cereal mixes, premade mixes, snack chips and snacks and snack mixes of all kinds, pretzels, crackers, cookies, candies, chocolates of all kinds, marshmallows, puddings, etc.); beverages such as water, milks, juices, flavored and/or carbonated beverages (e.g. soda), sports drinks, coffees, teas, spirits, alcoholic beverages (e.g. beer, wine, etc.), etc.; and ingredients for making or mixing into beverages (e.g. coffee beans, ground coffees, cocoas, tea leaves, dehydrated beverages, powders for making beverages, natural and artificial sweeteners, flavorings, etc.). Further, prepared foods, fruits, vegetables, soups, meats, pastas, microwavable and or frozen foods as well as produce, eggs, milk, and other fresh foods. Any of the embodiments of flexible containers disclosed herein can also be sterilized (e.g. by treatment with ultraviolet light or peroxide-based compositions), to make the containers safe for use in storing food and/or beverage. In any embodiment, the containers can be configured to be suitable for retort processes.

As still further examples, any embodiment of flexible containers, as described herein, may be used across the medical industry, in the areas of medicines, medical devices, and medical treatment, including uses for receiving, containing, storing and/or dispensing, any of the following fluent products, in any form known in the art: bodily fluids from humans and/or animals (e.g. amniotic fluid, aqueous humour, vitreous humour, bile, blood, blood plasma, blood serum, breast milk, cerebrospinal fluid, cerumen (earwax), chyle, chime, endolymph (and perilymph), ejaculate, runny feces, gastric acid, gastric juice, lymph, mucus (including nasal drainage and phlegm), pericardial fluid, peritoneal fluid, pleural fluid, pus, rheum, saliva, sebum (skin oil), semen, sputum, synovial fluid, tears, sweat, vaginal secretion, vomit, urine, etc.); fluids for intravenous therapy to human or animal bodies (e.g. volume expanders (e.g. crystalloids and colloids), blood-based products including blood substitutes, buffer solutions, liquid-based medications (which can include pharmaceuticals), parenteral nutritional formulas (e.g. for intravenous feeding, wherein such formulas can include salts, glucose, amino acids, lipids, supplements, nutrients, and/or vitamins); other medicinal fluids for administering to human or animal bodies (e.g. medicines, medicaments, nutrients, nutraceuticals, pharmaceuticals, etc.) by any suitable method of administration (e.g. orally (in solid, liquid, or pill form), topically, intranasally, by inhalation, or rectally. Any of the embodiments of flexible containers disclosed herein can also be sterilized (e.g. by treatment with ultraviolet light or peroxide-based compositions or through an autoclave or retort process), to make the containers safe for use in sterile medical environments.

As even further examples, any embodiment of flexible containers, as described herein, may be used across any and all industries that use internal combustion engines (such as the transportation industry, the power equipment industry, the power generation industry, etc.), including products for vehicles such as cars, trucks, automobiles, boats, aircraft, etc., with such containers useful for receiving, containing, storing, and/or dispensing, any of the following fluent products, in any form known in the art: engine oil, engine oil additives, fuel additives, brake fluids, transmission fluids, engine coolants, power steering fluids, windshield wiper fluids, products for vehicle care (e.g. for body, tires, wheels, windows, trims, upholsteries, etc.), as well as other fluids configured to clean, penetrate, degrease, lubricate, and/or protect one or more parts of any and all kinds of engines, power equipment, and/or transportation vehicles.

Any embodiment of flexible containers, as described herein, can also be used for receiving, containing, storing, and/or dispensing, non-fluent products, in any of the following categories: Baby Care products, including disposable wearable absorbent articles, diapers, training pants, infant and toddler care wipes, etc. and the like; Beauty Care products including applicators for applying compositions to human or animal hair, skin, and/or nails, etc. and the like; Home Care products including wipes and scrubbers for all kinds of cleaning applications and the like; Family Care products including wet or dry bath tissue, facial tissue, disposable handkerchiefs, disposable towels, wipes, etc. and the like; Feminine Care products including catamenial pads, incontinence pads, interlabial pads, panty liners, pessaries, sanitary napkins, tampons, tampon applicators, wipes, etc. and the like; Health Care products including oral care products such as oral cleaning devices, dental floss, flossing devices, toothbrushes, etc. and the like; Pet Care products including grooming aids, pet training aids, pet devices, pet toys, etc. and the like; Portable Power products including electrochemical cells, batteries, battery current interrupters, battery testers, battery chargers, battery charge monitoring equipment, battery charge/discharge rate controlling equipment, "smart" battery electronics, flashlights, etc. and the like; Small Appliance Products including hair removal appliances (including, e.g. electric foil shavers for men and women, charging and/or cleaning stations, electric hair trimmers, electric beard trimmers, electric epilator devices, cleaning fluid cartridges, shaving conditioner cartridges, shaving foils, and cutter blocks); oral care appliances (including, e.g., electric toothbrushes with accumulator or battery, refill brushheads, interdental cleaners, tongue cleaners, charging stations, electric oral irrigators, and irrigator clip on jets); small electric household appliances (including, e.g., coffee makers, water kettles, handblenders, handmixers, food processors, steam cookers, juicers, citrus presses, toasters, coffee or meat grinders, vacuum pumps, irons, steam pressure stations for irons and in general non electric attachments therefore, hair care appliances (including, e.g., electric hair driers, hairstylers, hair curlers, hair straighteners, cordless gas heated styler/irons and gas cartridges therefore, and air filter attachments); personal diagnostic appliances (including, e.g., blood pressure monitors, ear thermometers, and lensfilters therefore); clock appliances and watch appliances (including, e.g., alarm clocks, travel alarm clocks combined with radios, wall clocks, wristwatches, and pocket calculators), etc. and the like.

FIGS. 1A-1D illustrates various views of an embodiment of a stand up flexible container 100. FIG. 1A illustrates a front view of the container 100. The container 100 is standing upright on a horizontal support surface 101.

In FIG. 1A, a coordinate system 110, provides lines of reference for referring to directions in the figure. The coordinate system 110 is a three-dimensional Cartesian coordinate system with an X-axis, a Y-axis, and a Z-axis, wherein each axis is perpendicular to the other axes, and any two of the axes define a plane. The X-axis and the Z-axis are parallel with the horizontal support surface 101 and the Y-axis is perpendicular to the horizontal support surface 101.

FIG. 1A also includes other lines of reference, for referring to directions and locations with respect to the container 100. A lateral centerline 111 runs parallel to the X-axis. An XY plane at the lateral centerline 111 separates the container 100 into a front half and a back half. An XZ plane at the lateral centerline 111 separates the container 100 into an upper half and a lower half. A longitudinal centerline 114 runs parallel to the Y-axis. A YZ plane at the longitudinal centerline 114 separates the container 100 into a left half and a right half. A third centerline 117 runs parallel to the Z-axis. The lateral centerline 111, the longitudinal centerline 114, and the third centerline 117 all intersect at a center of the container 100.

A disposition with respect to the lateral centerline 111 defines what is longitudinally inboard 112 and longitudinally outboard 113. When a first location is nearer to the lateral centerline 111 than a second location, the first location is considered to be disposed longitudinally inboard 112 to the second location. And, the second location is considered to be disposed longitudinally outboard 113 from the first location. The term lateral refers to a direction, orientation, or measurement that is parallel to the lateral centerline 111. A lateral orientation may also be referred to a horizontal orientation, and a lateral measurement may also be referred to as a width.

A disposition with respect to the longitudinal centerline 114 defines what is laterally inboard 115 and laterally outboard 116. When a first location is nearer to the longitudinal centerline 114 than a second location, the first location is considered to be disposed laterally inboard 115 to the second location. And, the second location is considered to be disposed laterally outboard 116 from the first location. The term longitudinal refers to a direction, orientation, or measurement that is parallel to the longitudinal centerline 114. A longitudinal orientation may also be referred to a vertical orientation.

A longitudinal direction, orientation, or measurement may also be expressed in relation to a horizontal support surface for the container 100. When a first location is nearer to the support surface than a second location, the first location can be considered to be disposed lower than, below, beneath, or under the second location. And, the second location can be considered to be disposed higher than, above, or upward from the first location. A longitudinal measurement may also be referred to as a height, measured above the horizontal support surface 100.

A measurement that is made parallel to the third centerline 117 is referred to a thickness or depth. A disposition in the direction of the third centerline 117 and toward a front 102-1 of the container is referred to as forward 118 or in front of. A disposition in the direction of the third centerline 117 and toward a back 102-2 of the container is referred to as backward 119 or behind.

These terms for direction, orientation, measurement, and disposition, as described above, are used for all of the embodiments of the present disclosure, whether or not a support surface, reference line, or coordinate system is shown in a figure.

The container 100 includes a top 104, a middle 106, and a bottom 108, the front 102-1, the back 102-2, and left and right sides 109. The top 104 is separated from the middle 106 by a reference plane 105, which is parallel to the XZ plane. The middle 106 is separated from the bottom 108 by a reference plane 107, which is also parallel to the XZ plane. The container 100 has an overall height of 100-oh. In the embodiment of FIG. 1A, the front 102-1 and the back 102-2 of the container are joined together at a seal 129, which extends around the outer periphery of the container 100, across the top 104, down the side 109, and then, at the bottom of each side 109, splits outward to follow the front and back portions of the base 190, around their outer extents.

The container 100 includes a structural support frame 140, a product volume 150, a dispenser 160, panels 180-1 and 180-2, and a base structure 190. A portion of panel 180-1 is illustrated as broken away, in order to show the product volume 150. The product volume 150 is configured to contain one or more fluent products. The dispenser 160 allows the container 100 to dispense these fluent product(s) from the product volume 150 through a flow channel 159 then through the dispenser 160, to the environment outside of the container 100. In the embodiment of FIGS. 1A-1D, the dispenser 160 is disposed in the center of the uppermost part of the top 104, however, in various alternate embodiments, the dispenser 160 can be disposed anywhere else on the top 140, middle 106, or bottom 108, including anywhere on either of the sides 109, on either of the panels 180-1 and 180-2, and on any part of the base 190 of the container 100. The structural support frame 140 supports the mass of fluent product(s) in the product volume 150, and makes the container 100 stand upright. The panels 180-1 and 180-2 are relatively flat surfaces, overlaying the product volume 150, and are suitable for displaying any kind of indicia. However, in various embodiments, part, parts, or about all, or approximately all, or substantially all, or nearly all, or all of either or both of the panels 180-1 and 180-2 can include one or more curved surfaces. The base structure 190 supports the structural support frame 140 and provides stability to the container 100 as it stands upright.

The structural support frame 140 is formed by a plurality of structural support members. The structural support frame 140 includes top structural support members 144-1 and 144-2, middle structural support members 146-1, 146-2, 146-3, and 146-4, as well as bottom structural support members 148-1 and 148-2.

The top structural support members 144-1 and 144-2 are disposed on the upper part of the top 104 of the container 100, with the top structural support member 144-1 disposed in the front 102-1 and the top structural support member 144-2 disposed in the back 102-2, behind the top structural support member 144-1. The top structural support members 144-1 and 144-2 are adjacent to each other and can be in contact with each other along the laterally outboard portions of their lengths. In various embodiments, the top structural support members 144-1 and 144-2 can be in contact with each other at one or more relatively smaller locations and/or at one or more relatively larger locations, along part, or parts, or about all, or approximately all, or substantially all, or nearly all, or all of their overall lengths, so long as there is a flow channel 159 between the top structural support members 144-1 and 144-2, which allows the container 100 to dispense fluent product(s) from the product volume 150 through the flow channel 159 then through the dispenser 160. The top structural support members 144-1 and 144-2 are not directly connected to each other. However, in various alternate embodiments, the top structural support members 144-1 and 144-2 can be directly connected and/or joined together along part, or parts, or about all, or approximately all, or substantially all, or nearly all, or all of their overall lengths.

The top structural support members 144-1 and 144-2 are disposed substantially above the product volume 150. Overall, each of the top structural support members 144-1 and 144-2 is oriented about horizontally, but with its ends curved slightly downward. And, overall each of the top structural support members 144-1 and 144-2 has a cross-sectional area that is substantially uniform along its length; however the cross-sectional area at their ends are slightly larger than the cross-sectional area in their middles.

The middle structural support members 146-1, 146-2, 146-3, and 146-4 are disposed on the left and right sides 109, from the top 104, through the middle 106, to the bottom 108. The middle structural support member 146-1 is disposed in the front 102-1, on the left side 109; the middle structural support member 146-4 is disposed in the back 102-2, on the left side 109, behind the middle structural support member 146-1. The middle structural support members 146-1 and 146-4 are adjacent to each other and can be in contact with each other along substantially all of their lengths. In various embodiments, the middle structural support members 146-1 and 146-4 can be in contact with each other at one or more relatively smaller locations and/or at one or more relatively larger locations, along part, or parts, or about all, or approximately all, or substantially all, or nearly all, or all of their overall lengths. The middle structural support members 146-1 and 146-4 are not directly connected to each other. However, in various alternate embodiments, the middle structural support members 146-1 and 146-4 can be directly connected and/or joined together along part, or parts, or about all, or approximately all, or substantially all, or nearly all, or all of their overall lengths.

The middle structural support member 146-2 is disposed in the front 102-1, on the right side 109; the middle structural support member 146-3 is disposed in the back 102-2, on the right side 109, behind the middle structural support member 146-2. The middle structural support members 146-2 and 146-3 are adjacent to each other and can be in contact with each other along substantially all of their lengths. In various embodiments, the middle structural support members 146-2 and 146-3 can be in contact with each other at one or more relatively smaller locations and/or at one or more relatively larger locations, along part, or parts, or about all, or approximately all, or substantially all, or nearly all, or all of their overall lengths. The middle structural support members 146-2 and 146-3 are not directly connected to each other. However, in various alternate embodiments, the middle structural support members 146-2 and 146-3 can be directly connected and/or joined together along part, or parts, or about all, or approximately all, or substantially all, or nearly all, or all of their overall lengths.

The middle structural support members 146-1, 146-2, 146-3, and 146-4 are disposed substantially laterally outboard from the product volume 150. Overall, each of the middle structural support members 146-1, 146-2, 146-3, and 146-4 is oriented about vertically, but angled slightly, with its upper end laterally inboard to its lower end. And, overall each of the middle structural support members 146-1, 146-2, 146-3, and 146-4 has a cross-sectional area that changes along its length, increasing in size from its upper end to its lower end.

The bottom structural support members 148-1 and 148-2 are disposed on the bottom 108 of the container 100, with the bottom structural support member 148-1 disposed in the front 102-1 and the bottom structural support member 148-2 disposed in the back 102-2, behind the top structural support member 148-1. The bottom structural support members 148-1 and 148-2 are adjacent to each other and can be in contact with each other along substantially all of their lengths. In various embodiments, the bottom structural support members 148-1 and 148-2 can be in contact with each other at one or more relatively smaller locations and/or at one or more relatively larger locations, along part, or parts, or about all, or approximately all, or substantially all, or nearly all, or all of their overall lengths. The bottom structural support members 148-1 and 148-2 are not directly connected to each other. However, in various alternate embodiments, the bottom structural support members 148-1 and 148-2 can be directly connected and/or joined together along part, or parts, or about all, or approximately all, or substantially all, or nearly all, or all of their overall lengths.

The bottom structural support members 148-1 and 148-2 are disposed substantially below the product volume 150, but substantially above the base structure 190. Overall, each of the bottom structural support members 148-1 and 148-2 is oriented about horizontally, but with its ends curved slightly upward. And, overall each of the bottom structural support members 148-1 and 148-2 has a cross-sectional area that is substantially uniform along its length.

In the front portion of the structural support frame 140, the left end of the top structural support member 144-1 is joined to the upper end of the middle structural support member 146-1; the lower end of the middle structural support member 146-1 is joined to the left end of the bottom structural support member 148-1; the right end of the bottom structural support member 148-1 is joined to the lower end of the middle structural support member 146-2; and the upper end of the middle structural support member 146-2 is joined to the right end of the top structural support member 144-1. Similarly, in the back portion of the structural support frame 140, the left end of the top structural support member 144-2 is joined to the upper end of the middle structural support member 146-4; the lower end of the middle structural support member 146-4 is joined to the left end of the bottom structural support member 148-2; the right end of the bottom structural support member 148-2 is joined to the lower end of the middle structural support member 146-3; and the upper end of the middle structural support member 146-3 is joined to the right end of the top structural support member 144-2. In the structural support frame 140, the ends of the structural support members, which are joined together, are directly connected, all around the periphery of their walls. However, in various alternative embodiments, any of the structural support members 144-1, 144-2, 146-1, 146-2, 146-3, 146-4, 148-1, and 148-2 can be joined together in any way described herein or known in the art.

In alternative embodiments of the structural support frame 140, adjacent structural support members can be combined into a single structural support member, wherein the combined structural support member can effectively substitute for the adjacent structural support members, as their functions and connections are described herein. In other alternative embodiments of the structural support frame 140, one or more additional structural support members can be added to the structural support members in the structural support frame 140, wherein the expanded structural support frame can effectively substitute for the structural support frame 140, as its functions and connections are described herein. Also, in some alternative embodiments, a flexible container may not include a base structure.

Figure 1B:
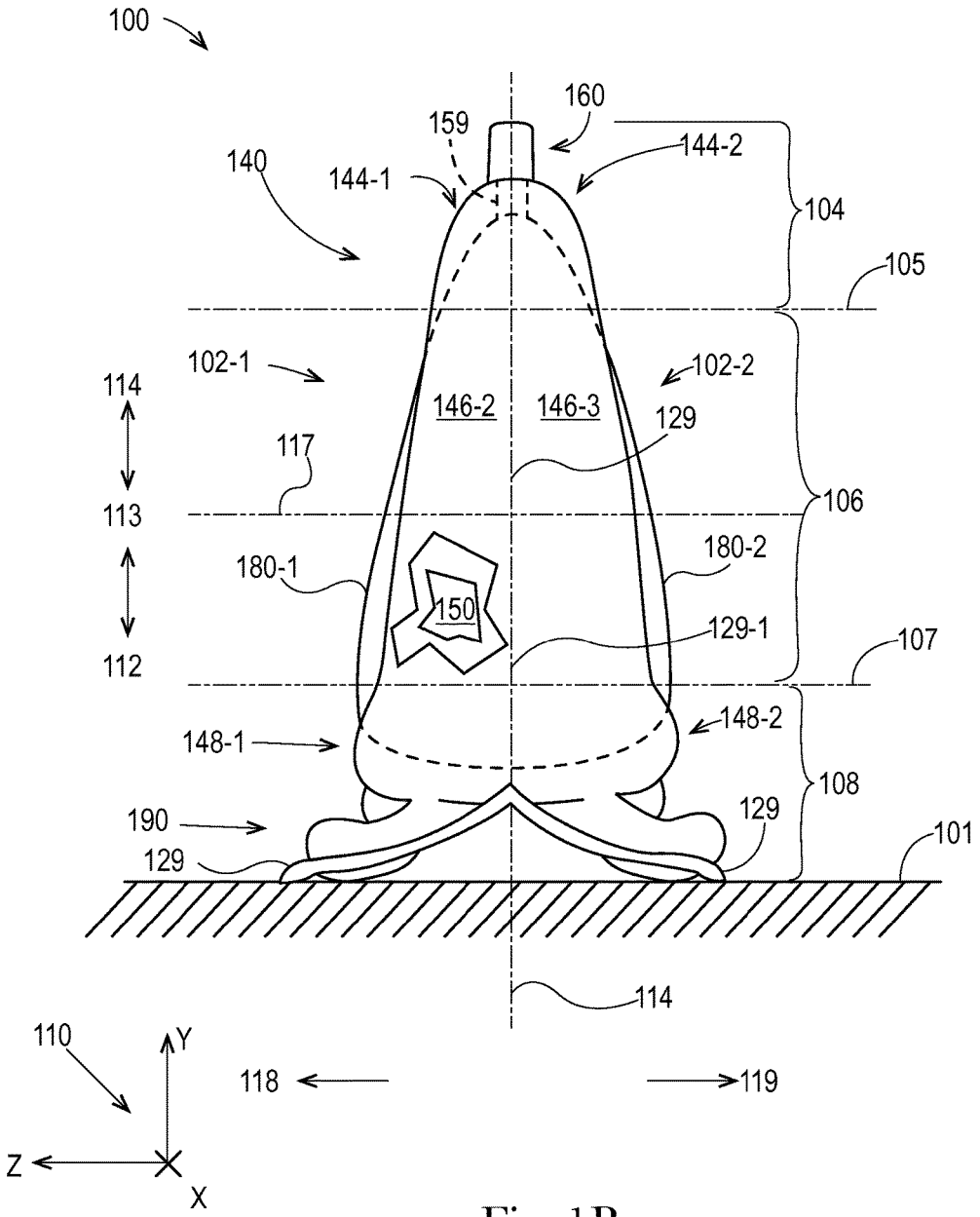
FIG. 1B illustrates a side view of the stand up flexible container of FIG. 1A.

FIG. 1B illustrates a side view of the stand up flexible container 100 of FIG. 1A.

Figure 1C:
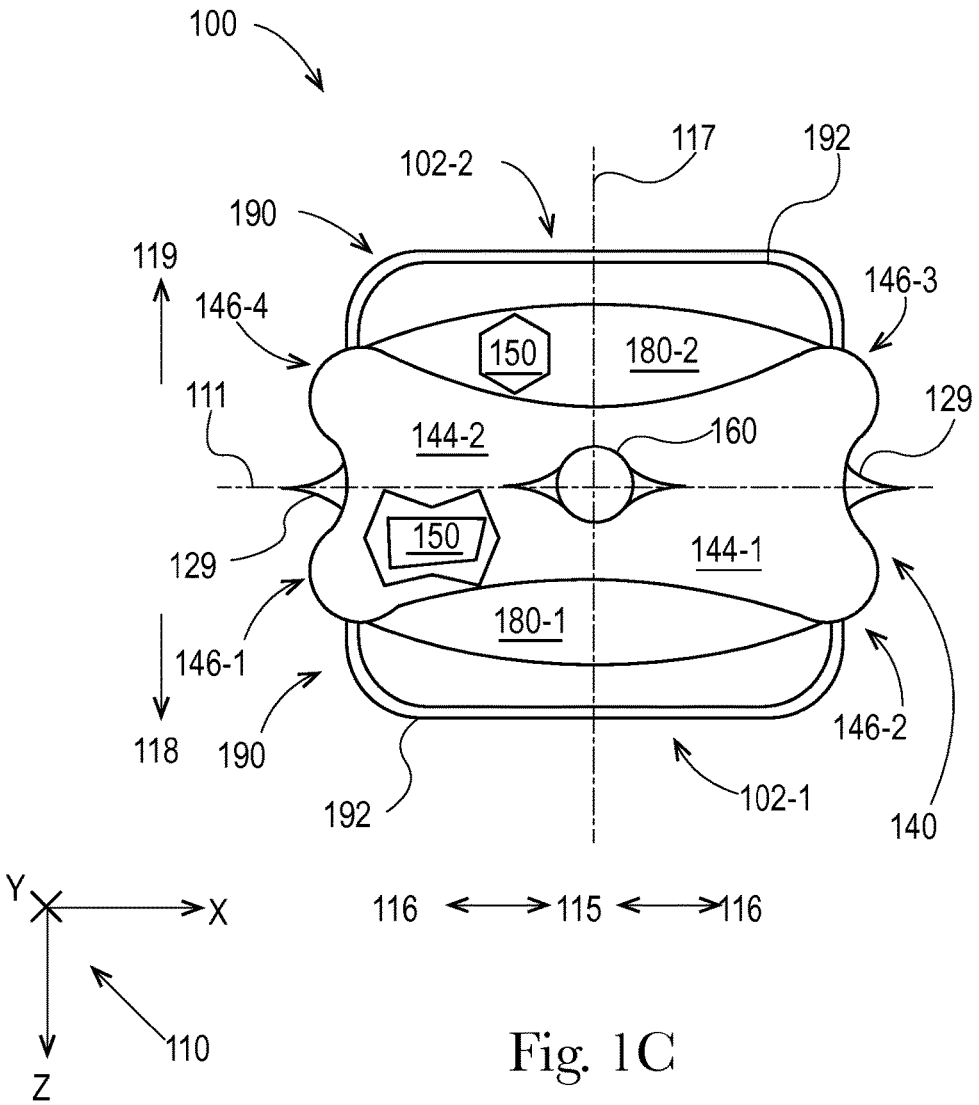
FIG. 1C illustrates a top view of the stand up flexible container of FIG. 1A.

FIG. 1C illustrates a top view of the stand up flexible container 100 of FIG. 1A.

Figure 1D:
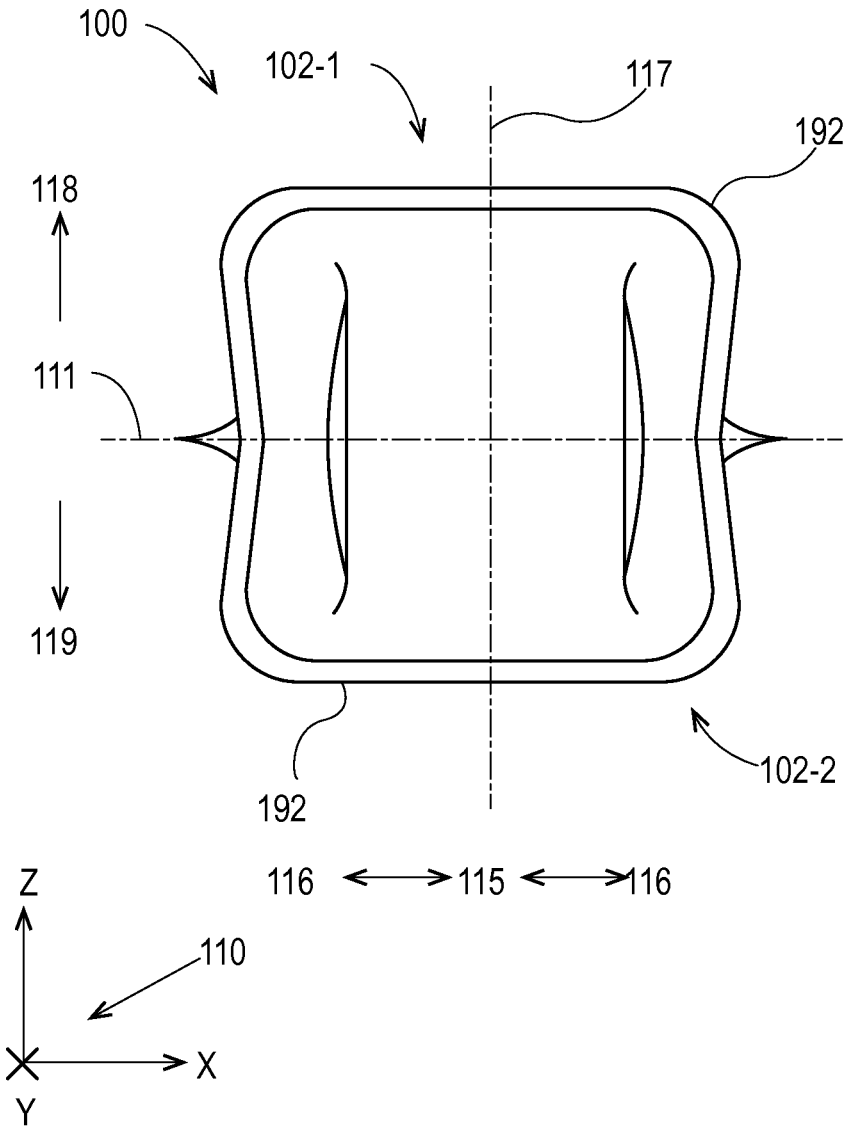
FIG. 1D illustrates a bottom view of the stand up flexible container of FIG. 1A.

FIG. 1D illustrates a bottom view of the stand up flexible container 100 of FIG. 1A.

Figure 1E:
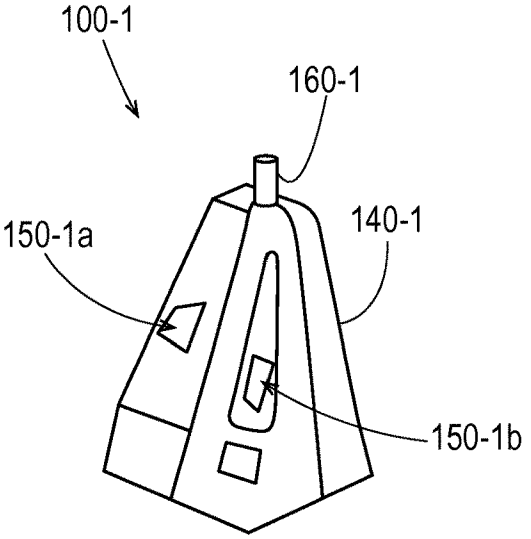
FIG. 1E illustrates a perspective view of an alternative embodiment of the stand up flexible container of FIG. 1A, including an asymmetric structural support frame.

FIG. 1E illustrates a perspective view of a container 100-1, which is an alternative embodiment of the stand up flexible container 100 of FIG. 1A, including an asymmetric structural support frame 140-1, a first portion of the product volume 150-1*b*, a second portion of the product volume 150-1*a*, and a dispenser 160-1. The embodiment of FIG. 1E is similar to the embodiment of FIG. 1A with like-numbered terms configured in the same way, except that the frame 140-1 extends around about half of the container 100-1, directly supporting a first portion of the product volume 150-1*b*, which is disposed inside of the frame 140-1, and indirectly supporting a second portion of the product volume 150-1*a*, which is disposed outside of the frame 140-1. In various embodiments, any stand-up flexible container of the present disclosure can be modified in a similar way, such that: the frame extends around only part or parts of the container, and/or the frame is asymmetric with respect to one or more centerlines of the container, and/or part or parts of one or more product volumes of the container are disposed outside of the frame, and/or part or parts of one or more product volumes of the container are indirectly supported by the frame.

Figure 1F:
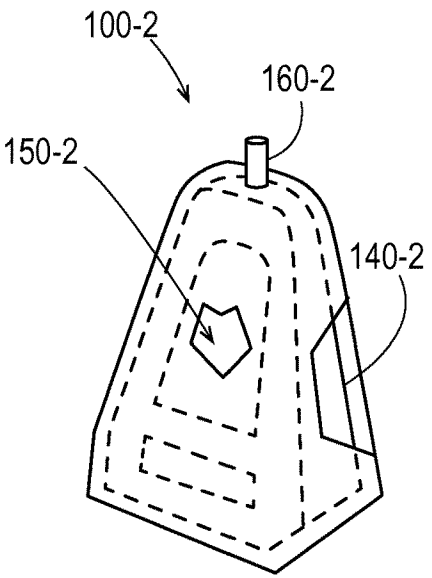
FIG. 1F illustrates a perspective view of an alternative embodiment of the stand up flexible container of FIG. 1A, including an internal structural support frame.

FIG. 1F illustrates a perspective view of a container 100-2, which is an alternative embodiment of the stand up flexible container 100 of FIG. 1A, including an internal structural support frame 140-2, a product volume 150-2, and a dispenser 160-2. The embodiment of FIG. 1F is similar to the embodiment of Figure 1A with like-numbered terms configured in the same way, except that the frame 140-2 is internal to the product volume 150-2. In various embodiments, any stand-up flexible container of the present disclosure can be modified in a similar way, such that: part, parts, or all of the frame (including part, parts, or all of one or more of any structural support members that form the frame) are about, approximately, substantially, nearly, or completely enclosed by one or more product volumes.

Figure 1G:
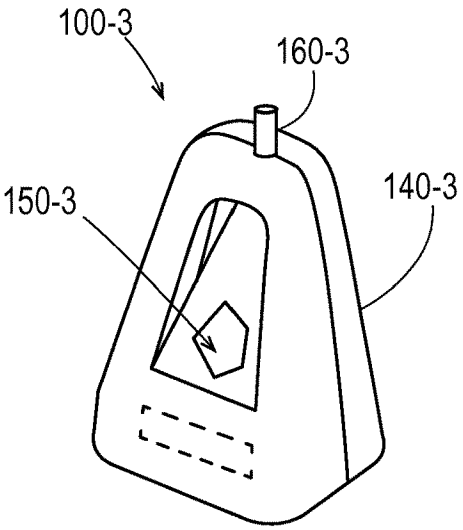
FIG. 1G illustrates a perspective view of an alternative embodiment of the stand up flexible container of FIG. 1A, including an external structural support frame.

FIG. 1G illustrates a perspective view of a container 100-3, which is an alternative embodiment of the stand up flexible container 100 of FIG. 1A, including an external structural support frame 140-3, a product volume 150-3, and a dispenser 160-3. The embodiment of FIG. 1G is similar to the embodiment of FIG. 1A with like-numbered terms configured in the same way, except that the product volume 150-3 is not integrally connected to the frame 140-3 (that is, not simultaneously made from the same web of flexible materials), but rather the product volume 150-3 is separately made and then joined to the frame 140-3. The product volume 150-3 can be joined to the frame in any convenient manner disclosed herein or known in the art. In the embodiment of FIG. 1G, the product volume 150-3 is disposed within the frame 140-3, but the product volume 150-3 has a reduced size and a somewhat different shape, when compared with the product volume 150 of FIG. 1A; however, these differences are made to illustrate the relationship between the product volume 150-3 and the frame 140-3, and are not required. In various embodiments, any stand-up flexible container of the present disclosure can be modified in a similar way, such that one or more the product volumes are not integrally connected to the frame.

FIGS. 2A-8G illustrate embodiments of stand up flexible containers having various overall shapes. Any of the embodiments of FIGS. 2A-8G can be configured according to any of the embodiments disclosed herein, including the embodiments of FIGS. 1A-1G. Any of the elements (e.g. structural support frames, structural support members, panels, dispensers, etc.) of the embodiments of FIGS. 2A-8G, can be configured according to any of the embodiments disclosed herein. While each of the embodiments of FIGS. 2A-8G illustrates a container with one dispenser, in various embodiments, each container can include multiple dispensers, according to any embodiment described herein. FIGS. 2A-8G illustrate exemplary additional/alternate locations for dispenser with phantom line outlines. Part, parts, or about all, or approximately all, or substantially all, or nearly all, or all of each of the panels in the embodiments of FIGS. 2A-8G is suitable to display any kind of indicia. Each of the side panels in the embodiments of FIGS. 2A-8G is configured to be a nonstructural panel, overlaying product volume(s) disposed within the flexible container, however, in various embodiments, one or more of any kind of decorative or structural element (such as a rib, protruding from an outer surface) can be joined to part, parts, or about all, or approximately all, or substantially all, or nearly all, or all of any of these side panels. For clarity, not all structural details of these flexible containers are shown in FIGS. 2A-8G, however any of the embodiments of FIGS. 2A-8G can be configured to include any structure or feature for flexible containers, disclosed herein. For example, any of the embodiments of FIGS. 2A-8G can be configured to include any kind of base structure disclosed herein.

Figure 2A:
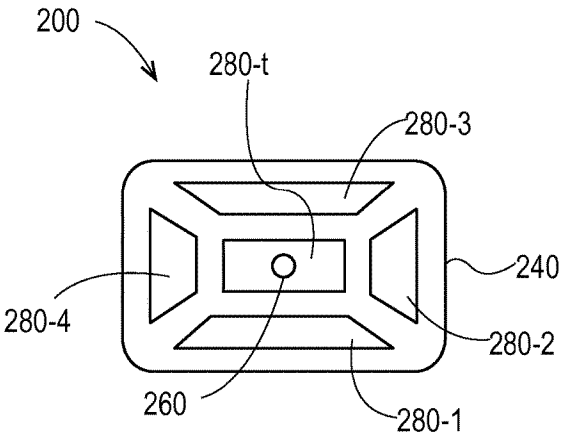
FIG. 2A illustrates a top view of a stand up flexible container having a structural support frame that has an overall shape like a frustum.
Figure 2B:
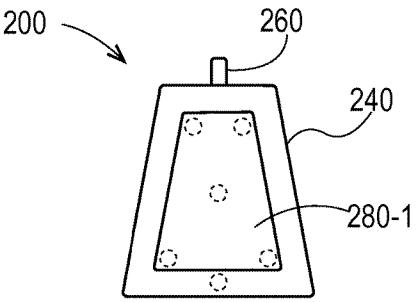
FIG. 2B illustrates a front view of the container of FIG. 2A.
Figure 2C:
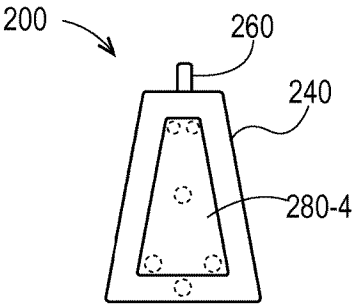
FIG. 2C illustrates a side view of the container of FIG. 2A.
Figure 2D:
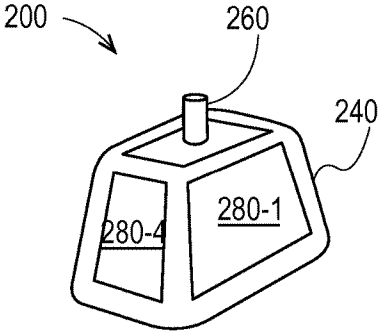
FIG. 2D illustrates an isometric view of the container of FIG. 2A.

FIG. 2A illustrates a front view of a stand up flexible container 200 having a structural support frame 240 that has an overall shape like a frustum. In the embodiment of FIG. 2A, the frustum shape is based on a four-sided pyramid, however, in various embodiments, the frustum shape can be based on a pyramid with a different number of sides, or the frustum shape can be based on a cone. The support frame 240 is formed by structural support members disposed along the edges of the frustum shape and joined together at their ends. The structural support members define a rectangular shaped top panel 280-*t*, trapezoidal shaped side panels 280-1, 280-2, 280-3, and 280-4, and a rectangular shaped bottom panel (not shown). Each of the side panels 280-1, 280-2, 280-3, and 280-4 is about flat, however in various embodiments, part, parts, or about all, or approximately all, or substantially all, or nearly all, or all of any of the side panels can be approximately flat, substantially flat, nearly flat, or completely flat. The container 200 includes a dispenser 260, which is configured to dispense one or more fluent products from one or more product volumes disposed within the container 200. In the embodiment of FIG. 2A, the dispenser 260 is disposed in the center of the top panel 280-*t*, however, in various alternate embodiments, the dispenser 260 can be disposed anywhere else on the top, sides, or bottom, of the container 200, according to any embodiment described or illustrated herein. FIG. 2B illustrates a front view of the container 200 of FIG. 2A, including exemplary additional/alternate locations for a dispenser, any of which can also apply to the back of the container. FIG. 2C illustrates a side view of the container 200 of FIG. 2A, including exemplary additional/alternate locations for a dispenser (shown as phantom lines), any of which can apply to either side of the container. FIG. 2D illustrates an isometric view of the container 200 of FIG. 2A.

Figure 2G:
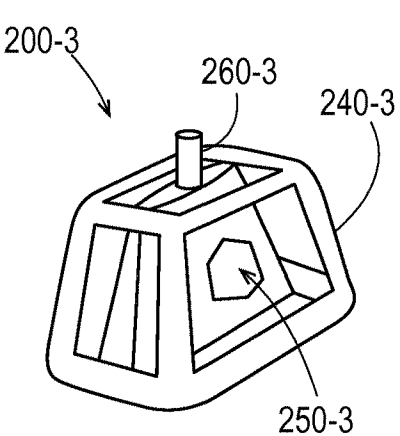
FIG. 2G illustrates a perspective view of an alternative embodiment of the stand up flexible container of FIG. 2A, including an external structural support frame.
Figure 2F:
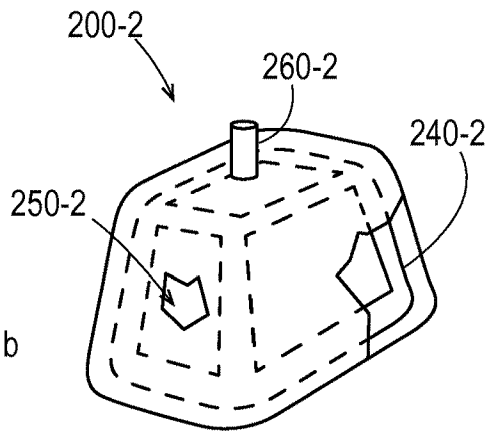
FIG. 2F illustrates a perspective view of an alternative embodiment of the stand up flexible container of FIG. 1A, including an internal structural support frame.
Figure 2E:
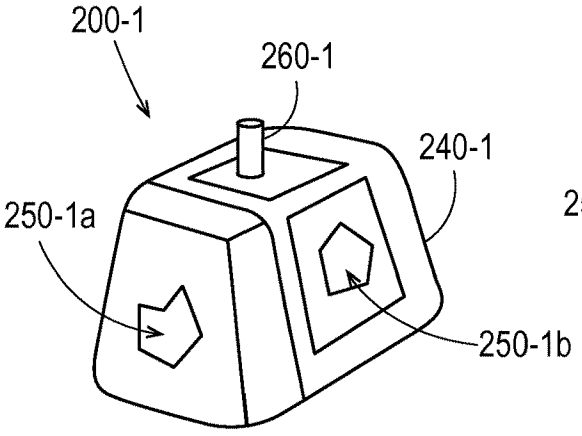
FIG. 2E illustrates a perspective view of an alternative embodiment of the stand up flexible container of FIG. 2A, including an asymmetric structural support frame.

FIG. 2E illustrates a perspective view of a container 200-1, which is an alternative embodiment of the stand up flexible container 200 of FIG. 2A, including an asymmetric structural support frame 240-1, a first portion of the product volume 250-1*b*, a second portion of the product volume 250-1*a*, and a dispenser 260-1, configured in the same manner as the embodiment of FIG. 1E, except based on the container 200. FIG. 2F illustrates a perspective view of a container 200-2, which is an alternative embodiment of the stand up flexible container 200 of FIG. 2A, including an internal structural support frame 240-2, a product volume 250-2, and a dispenser 260-2, configured in the same manner as the embodiment of FIG. 1F, except based on the container 200. FIG. 2G illustrates a perspective view of a container 200-3, which is an alternative embodiment of the stand up flexible container 200 of FIG. 2A, including an external structural support frame 240-3, a non-integral product volume 250-3 joined to and disposed within the frame 240-3, and a dispenser 260-3, configured in the same manner as the embodiment of FIG. 1G, except based on the container 200.

Figure 3A:
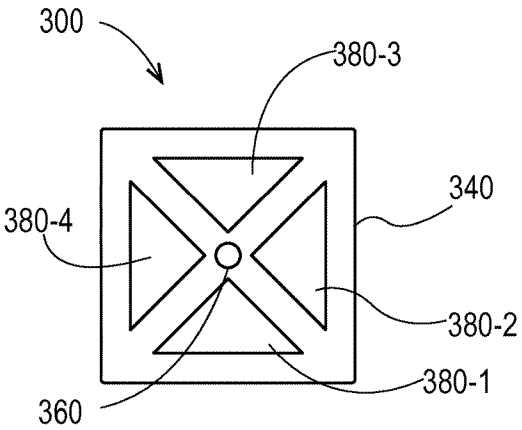
FIG. 3A illustrates a top view of a stand up flexible container having a structural support frame that has an overall shape like a pyramid.
Figure 3B:
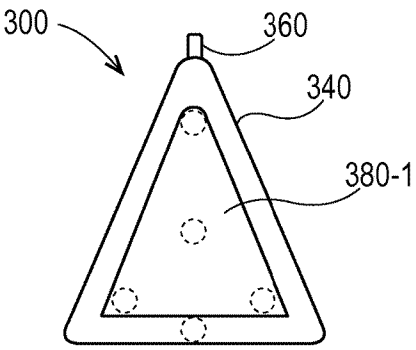
FIG. 3B illustrates a front view of the container of FIG. 3A.
Figure 3C:
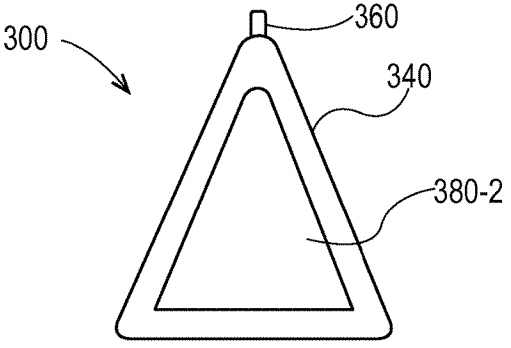
FIG. 3C illustrates a side view of the container of FIG. 3A.
Figure 3D:
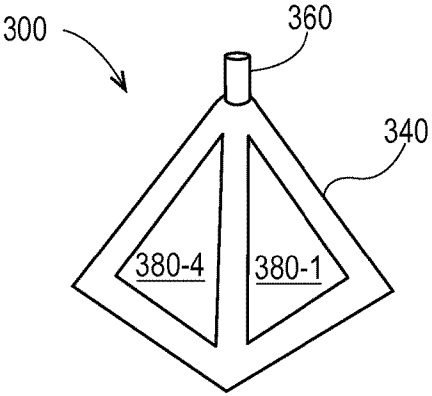
FIG. 3D illustrates an isometric view of the container of FIG. 3A.

FIG. 3A illustrates a front view of a stand up flexible container 300 having a structural support frame 340 that has an overall shape like a pyramid. In the embodiment of FIG. 3A, the pyramid shape is based on a four-sided pyramid, however, in various embodiments, the pyramid shape can be based on a pyramid with a different number of sides. The support frame 340 is formed by structural support members disposed along the edges of the pyramid shape and joined together at their ends. The structural support members define triangular shaped side panels 380-1, 380-2, 380-3, and 380-4, and a square shaped bottom panel (not shown). Each of the side panels 380-1, 380-2, 380-3, and 380-4 is about flat, however in various embodiments, part, parts, or about all, or approximately all, or substantially all, or nearly all, or all of any of the side panels can be approximately flat, substantially flat, nearly flat, or completely flat. The container 300 includes a dispenser 360, which is configured to dispense one or more fluent products from one or more product volumes disposed within the container 300. In the embodiment of FIG. 3A, the dispenser 360 is disposed at the apex of the pyramid shape, however, in various alternate embodiments, the dispenser 360 can be disposed anywhere else on the top, sides, or bottom, of the container 300. FIG. 3B illustrates a front view of the container 300 of FIG. 3A, including exemplary additional/alternate locations for a dispenser (shown as phantom lines), any of which can also apply to any side of the container. FIG. 3C illustrates a side view of the container 300 of FIG. 3A. FIG. 3D illustrates an isometric view of the container 300 of FIG. 3A.

Figure 3G:
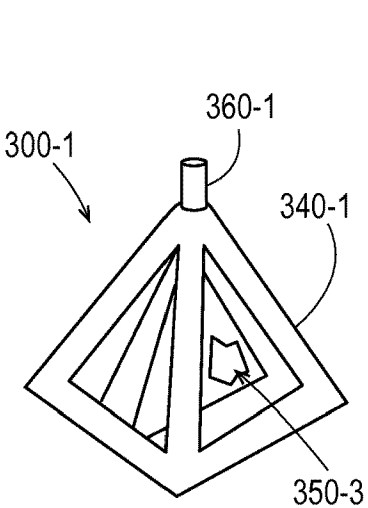
FIG. 3G illustrates a perspective view of an alternative embodiment of the stand up flexible container of FIG. 3A, including an external structural support frame.
Figure 3F:
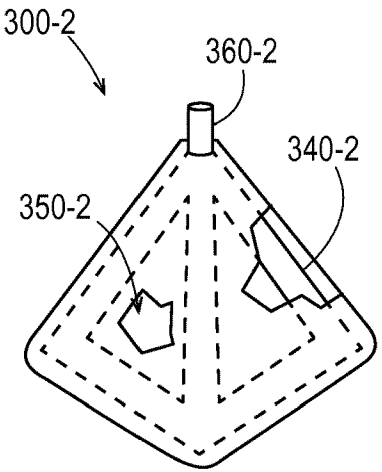
FIG. 3F illustrates a perspective view of an alternative embodiment of the stand up flexible container of FIG. 3A, including an internal structural support frame.
Figure 3E:
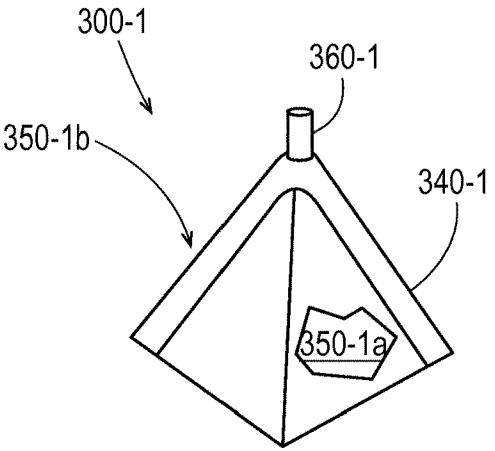
FIG. 3E illustrates a perspective view of an alternative embodiment of the stand up flexible container of FIG. 3A, including an asymmetric structural support frame.

FIG. 3E illustrates a perspective view of a container 300-1, which is an alternative embodiment of the stand up flexible container 300 of FIG. 3A, including an asymmetric structural support frame 340-1, a first portion of the product volume 350-1*b*, a second portion of the product volume 350-1*a*, and a dispenser 360-1, configured in the same manner as the embodiment of FIG. 1E, except based on the container 300. FIG. 3F illustrates a perspective view of a container 300-2, which is an alternative embodiment of the stand up flexible container 300 of FIG. 3A, including an internal structural support frame 340-2, a product volume 350-2, and a dispenser 360-2, configured in the same manner as the embodiment of FIG. 1F, except based on the container 300. FIG. 3G illustrates a perspective view of a container 300-3, which is an alternative embodiment of the stand up flexible container 300 of FIG. 3A, including an external structural support frame 340-3, a non-integral product volume 350-3 joined to and disposed within the frame 340-3, and a dispenser 360-3, configured in the same manner as the embodiment of FIG. 1G, except based on the container 300.

Figure 4B:
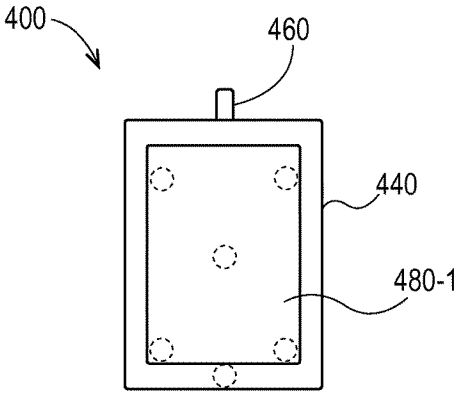
FIG. 4B illustrates a front view of the container of FIG. 4A.
Figure 4A:
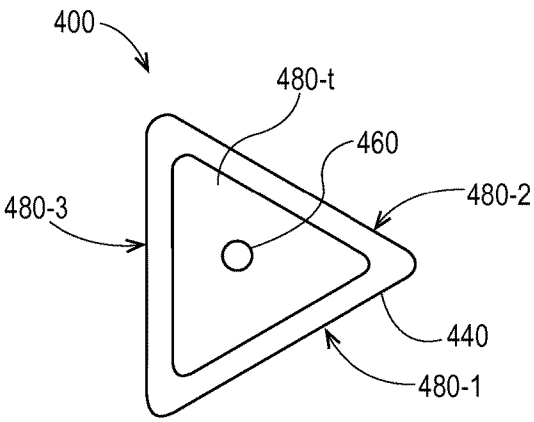
FIG. 4A illustrates a top view of a stand up flexible container having a structural support frame that has an overall shape like a trigonal prism.
Figure 4D:
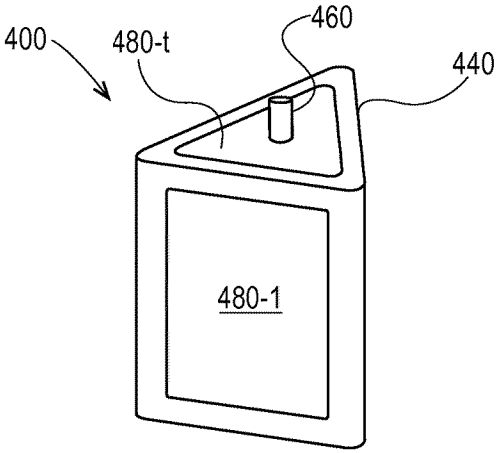
FIG. 4D illustrates an isometric view of the container of FIG. 4A.
Figure 4C:
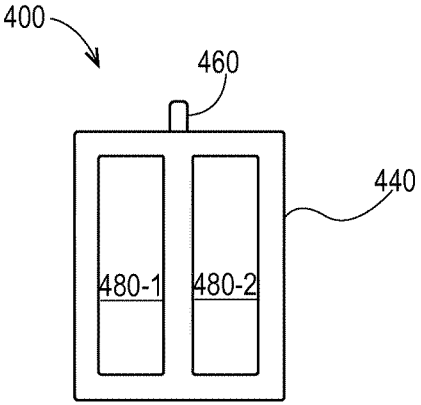
FIG. 4C illustrates a side view of the container of FIG. 4A.

FIG. 4A illustrates a front view of a stand up flexible container 400 having a structural support frame 440 that has an overall shape like a trigonal prism. In the embodiment of FIG. 4A, the prism shape is based on a triangle. The support frame 440 is formed by structural support members disposed along the edges of the prism shape and joined together at their ends. The structural support members define a triangular shaped top panel 480-*t*, rectangular shaped side panels 480-1, 480-2, and 480-3, and a triangular shaped bottom panel (not shown). Each of the side panels 480-1, 480-2, and 480-3 is about flat, however in various embodiments, part, parts, or about all, or approximately all, or substantially all, or nearly all, or all of the side panels can be approximately flat, substantially flat, nearly flat, or completely flat. The container 400 includes a dispenser 460, which is configured to dispense one or more fluent products from one or more product volumes disposed within the container 400. In the embodiment of FIG. 4A, the dispenser 460 is disposed in the center of the top panel 480-*t*, however, in various alternate embodiments, the dispenser 460 can be disposed anywhere else on the top, sides, or bottom, of the container 400. FIG. 4B illustrates a front view of the container 400 of FIG. 4A, including exemplary additional/alternate locations for a dispenser (shown as phantom lines), any of which can also apply to any side of the container 400. FIG. 4C illustrates a side view of the container 400 of FIG. 4A. FIG. 4D illustrates an isometric view of the container 400 of FIG. 4A.

Figure 4G:
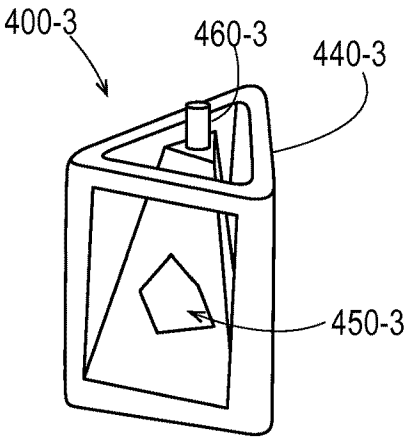
FIG. 4G illustrates a perspective view of an alternative embodiment of the stand up flexible container of FIG. 4A, including an external structural support frame.
Figure 4F:
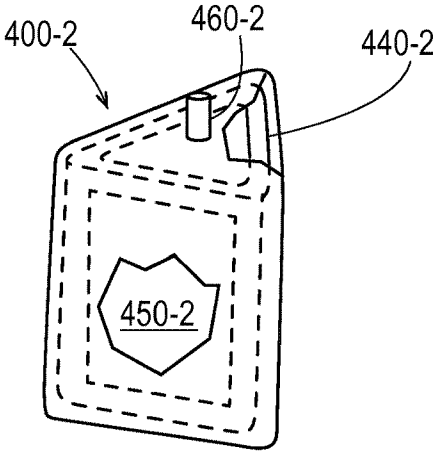
FIG. 4F illustrates a perspective view of an alternative embodiment of the stand up flexible container of FIG. 4A, including an internal structural support frame.
Figure 4E:
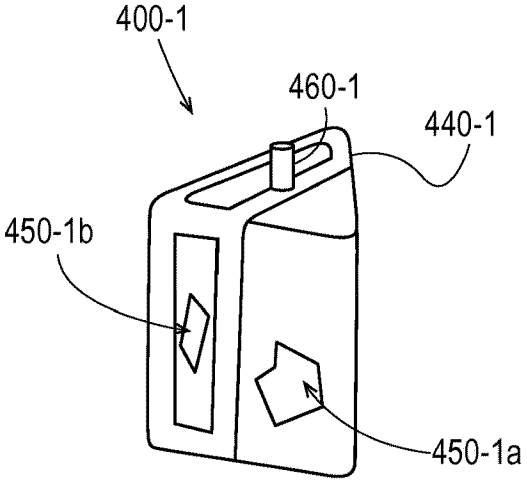
FIG. 4E illustrates a perspective view of an alternative embodiment of the stand up flexible container of FIG. 4A, including an asymmetric structural support frame.

FIG. 4E illustrates a perspective view of a container 400-1, which is an alternative embodiment of the stand up flexible container 400 of FIG. 4A, including an asymmetric structural support frame 440-1, a first portion of the product volume 450-1*b*, a second portion of the product volume 450-1*a*, and a dispenser 460-1, configured in the same manner as the embodiment of FIG. 1E, except based on the container 400. FIG. 4F illustrates a perspective view of a container 400-2, which is an alternative embodiment of the stand up flexible container 400 of FIG. 4A, including an internal structural support frame 440-2, a product volume 450-2, and a dispenser 460-2, configured in the same manner as the embodiment of FIG. 1F, except based on the container 400. FIG. 4G illustrates a perspective view of a container 400-3, which is an alternative embodiment of the stand up flexible container 400 of FIG. 4A, including an external structural support frame 440-3, a non-integral product volume 450-3 joined to and disposed within the frame 440-3, and a dispenser 460-3, configured in the same manner as the embodiment of FIG. 1G, except based on the container 400.

Figure 5B:
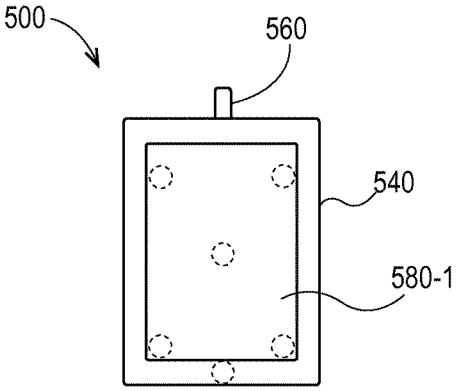
FIG. 5B illustrates a front view of the container of FIG. 5A.
Figure 5A:
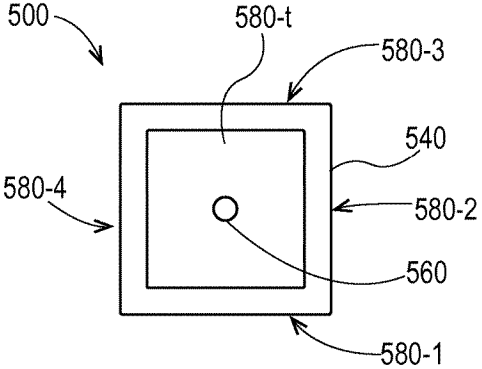
FIG. 5A illustrates a top view of a stand up flexible container having a structural support frame that has an overall shape like a tetragonal prism.
Figure 5D:
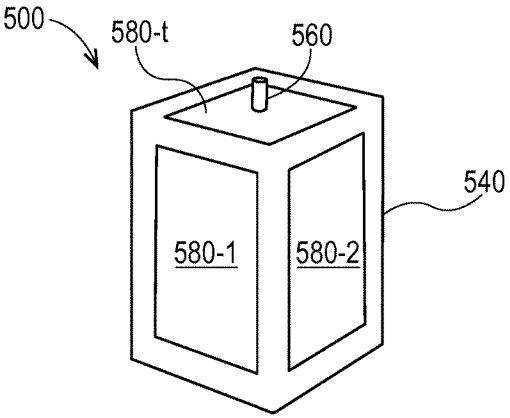
FIG. 5D illustrates an isometric view of the container of FIG. 5A.
Figure 5C:
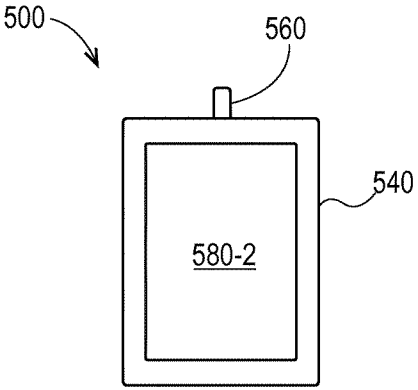
FIG. 5C illustrates a side view of the container of FIG. 5A.

FIG. 5A illustrates a front view of a stand up flexible container 500 having a structural support frame 540 that has an overall shape like a tetragonal prism. In the embodiment of FIG. 5A, the prism shape is based on a square. The support frame 540 is formed by structural support members disposed along the edges of the prism shape and joined together at their ends. The structural support members define a square shaped top panel 580-*t*, rectangular shaped side panels 580-1, 580-2, 580-3, and 580-4, and a square shaped bottom panel (not shown). Each of the side panels 580-1, 580-2, 580-3, and 580-4 is about flat, however in various embodiments, part, parts, or about all, or approximately all, or substantially all, or nearly all, or all of any of the side panels can be approximately flat, substantially flat, nearly flat, or completely flat. The container 500 includes a dispenser 560, which is configured to dispense one or more fluent products from one or more product volumes disposed within the container 500. In the embodiment of FIG. 5A, the dispenser 560 is disposed in the center of the top panel 580-*t*, however, in various alternate embodiments, the dispenser 560 can be disposed anywhere else on the top, sides, or bottom, of the container 500. FIG. 5B illustrates a front view of the container 500 of FIG. 5A, including exemplary additional/alternate locations for a dispenser (shown as phantom lines), any of which can also apply to any side of the container 500. FIG. 5C illustrates a side view of the container 500 of FIG. 5A. FIG. 5D illustrates an isometric view of the container 500 of FIG. 5A.

Figure 5G:
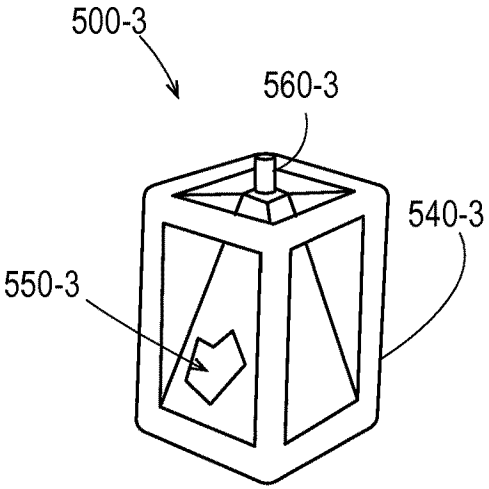
FIG. 5G illustrates a perspective view of an alternative embodiment of the stand up flexible container of FIG. 5A, including an external structural support frame.
Figure 5F:
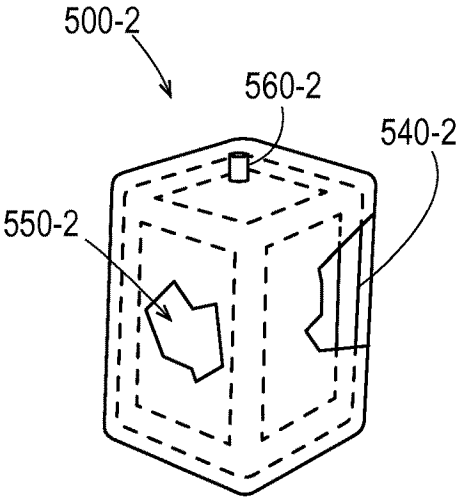
FIG. 5F illustrates a perspective view of an alternative embodiment of the stand up flexible container of FIG. 5A, including an internal structural support frame.
Figure 5E:
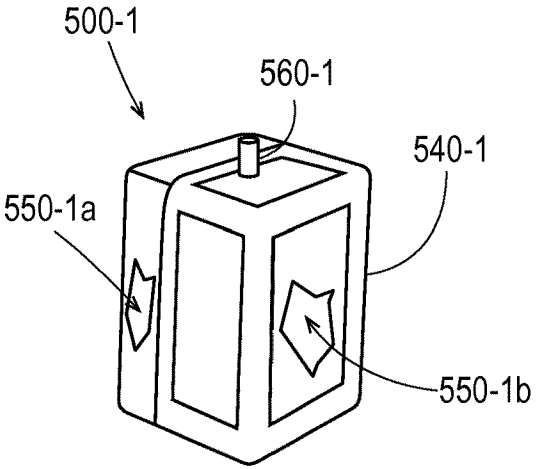
FIG. 5E illustrates a perspective view of an alternative embodiment of the stand up flexible container of FIG. 5A, including an asymmetric structural support frame.

FIG. 5E illustrates a perspective view of a container 500-1, which is an alternative embodiment of the stand up flexible container 500 of FIG. 5A, including an asymmetric structural support frame 540-1, a first portion of the product volume 550-1*b*, a second portion of the product volume 550-1*a*, and a dispenser 560-1, configured in the same manner as the embodiment of FIG. 1E, except based on the container 500. FIG. 5F illustrates a perspective view of a container 500-2, which is an alternative embodiment of the stand up flexible container 500 of FIG. 5A, including an internal structural support frame 540-2, a product volume 550-2, and a dispenser 560-2, configured in the same manner as the embodiment of FIG. 1F, except based on the container 500. FIG. 5G illustrates a perspective view of a container 500-3, which is an alternative embodiment of the stand up flexible container 500 of FIG. 5A, including an external structural support frame 540-3, a non-integral product volume 550-3 joined to and disposed within the frame 540-3, and a dispenser 560-3, configured in the same manner as the embodiment of FIG. 1G, except based on the container 500.

Figure 6B:
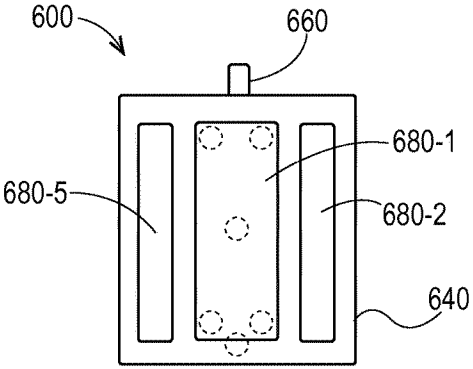
FIG. 6B illustrates a front view of the container of FIG. 6A.
Figure 6D:
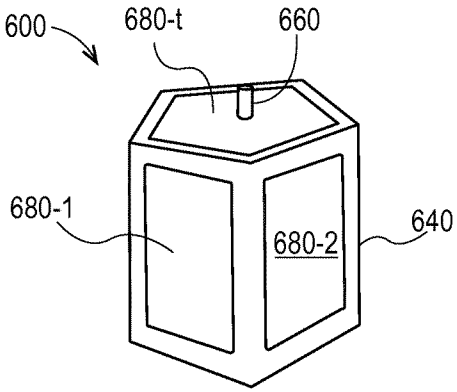
FIG. 6D illustrates an isometric view of the container of FIG. 6A.
Figure 6A:
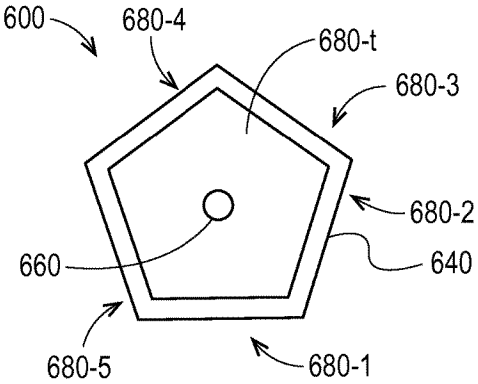
FIG. 6A illustrates a top view of a stand up flexible container having a structural support frame that has an overall shape like a pentagonal prism.
Figure 6C:
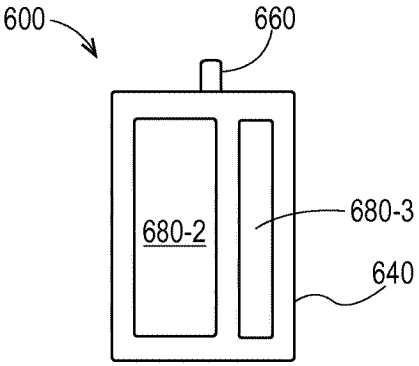
FIG. 6C illustrates a side view of the container of FIG. 6A.

FIG. 6A illustrates a front view of a stand up flexible container 600 having a structural support frame 640 that has an overall shape like a pentagonal prism. In the embodiment of FIG. 6A, the prism shape is based on a pentagon. The support frame 640 is formed by structural support members disposed along the edges of the prism shape and joined together at their ends. The structural support members define a pentagon shaped top panel 680-*t*, rectangular shaped side panels 680-1, 680-2, 680-3, 680-4, and 680-5, and a pentagon shaped bottom panel (not shown). Each of the side panels 680-1, 680-2, 680-3, 680-4, and 680-5 is about flat, however in various embodiments, part, parts, or about all, or approximately all, or substantially all, or nearly all, or all of any of the side panels can be approximately flat, substantially flat, nearly flat, or completely flat. The container 600 includes a dispenser 660, which is configured to dispense one or more fluent products from one or more product volumes disposed within the container 600. In the embodiment of FIG. 6A, the dispenser 660 is disposed in the center of the top panel 680-*t*, however, in various alternate embodiments, the dispenser 660 can be disposed anywhere else on the top, sides, or bottom, of the container 600. FIG. 6B illustrates a front view of the container 600 of FIG. 6A, including exemplary additional/alternate locations for a dispenser (shown as phantom lines), any of which can also apply to any side of the container 600. FIG. 6C illustrates a side view of the container 600 of FIG. 6A. FIG. 6D illustrates an isometric view of the container 600 of FIG. 6A.

Figure 6G:
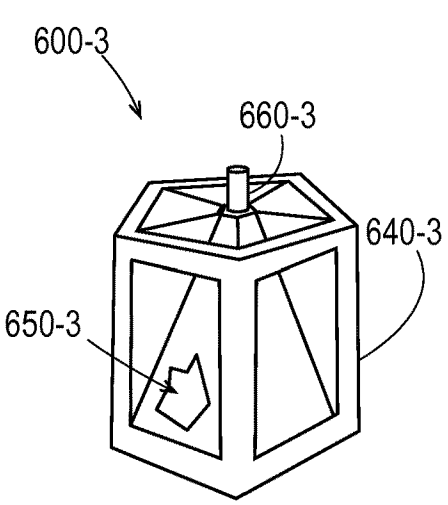
FIG. 6G illustrates a perspective view of an alternative embodiment of the stand up flexible container of FIG. 6A, including an external structural support frame.
Figure 6F:
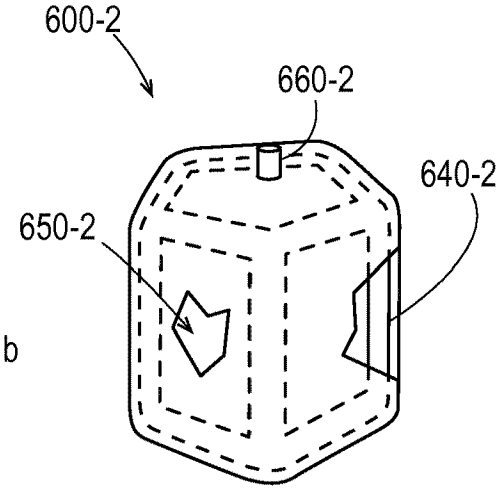
FIG. 6F illustrates a perspective view of an alternative embodiment of the stand up flexible container of FIG. 6A, including an internal structural support frame.
Figure 6E:
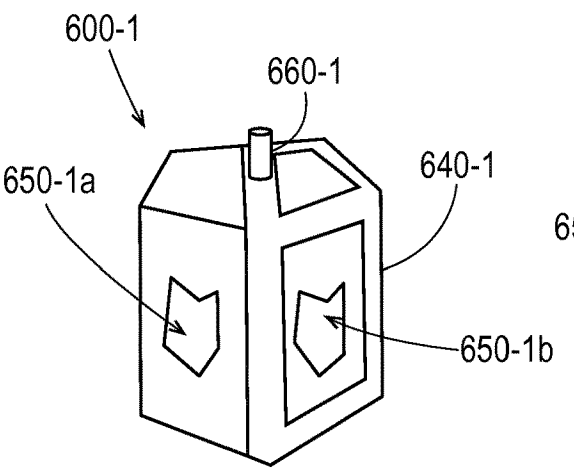
FIG. 6E illustrates a perspective view of an alternative embodiment of the stand up flexible container of FIG. 6A, including an asymmetric structural support frame.

FIG. 6E illustrates a perspective view of a container 600-1, which is an alternative embodiment of the stand up flexible container 600 of FIG. 6A, including an asymmetric structural support frame 640-1, a first portion of the product volume 650-1*b*, a second portion of the product volume 650-1*a*, and a dispenser 660-1, configured in the same manner as the embodiment of FIG. 1E, except based on the container 600. FIG. 6F illustrates a perspective view of a container 600-2, which is an alternative embodiment of the stand up flexible container 600 of FIG. 6A, including an internal structural support frame 640-2, a product volume 650-2, and a dispenser 660-2, configured in the same manner as the embodiment of FIG. 1F, except based on the container 600. FIG. 6G illustrates a perspective view of a container 600-3, which is an alternative embodiment of the stand up flexible container 600 of FIG. 6A, including an external structural support frame 640-3, a non-integral product volume 650-3 joined to and disposed within the frame 640-3, and a dispenser 660-3, configured in the same manner as the embodiment of FIG. 1G, except based on the container 600.

Figure 7A:
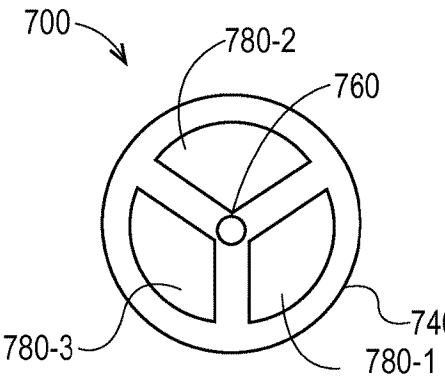
FIG. 7A illustrates a top view of a stand up flexible container having a structural support frame that has an overall shape like a cone.
Figure 7B:
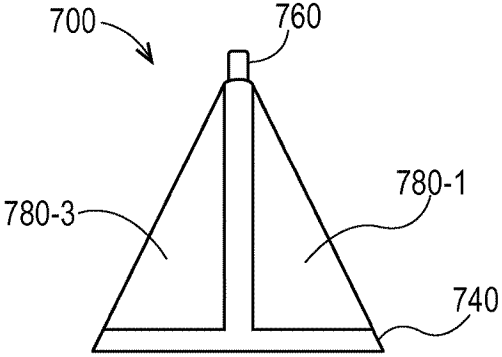
FIG. 7B illustrates a front view of the container of FIG. 7A.
Figure 7C:
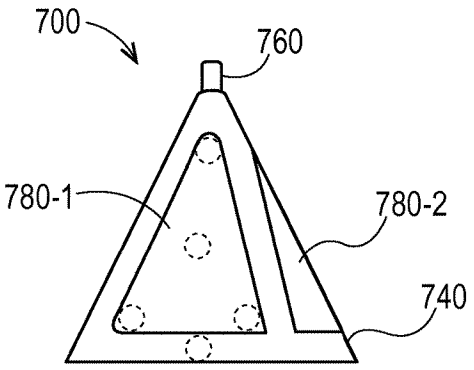
FIG. 7C illustrates a side view of the container of FIG. 7A.
Figure 7D:
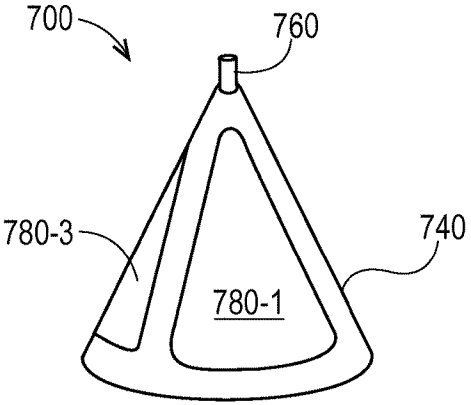
FIG. 7D illustrates an isometric view of the container of FIG. 7A.

FIG. 7A illustrates a front view of a stand up flexible container 700 having a structural support frame 740 that has an overall shape like a cone. The support frame 740 is formed by curved structural support members disposed around the base of the cone and by straight structural support members extending linearly from the base to the apex, wherein the structural support members are joined together at their ends. The structural support members define curved somewhat triangular shaped side panels 780-1, 780-2, and 780-3, and a circular shaped bottom panel (not shown). Each of the side panels 780-1, 780-2, and 780-3, is curved, however in various embodiments, part, parts, or about all, or approximately all, or substantially all, or nearly all, or all of any of the side panels can be approximately flat, substantially flat, nearly flat, or completely flat. The container 700 includes a dispenser 760, which is configured to dispense one or more fluent products from one or more product volumes disposed within the container 700. In the embodiment of FIG. 7A, the dispenser 760 is disposed at the apex of the conical shape, however, in various alternate embodiments, the dispenser 760 can be disposed anywhere else on the top, sides, or bottom, of the container 700. FIG. 7B illustrates a front view of the container 700 of FIG. 7A. FIG. 7C illustrates a side view of the container 700 of FIG. 7A, including exemplary additional/alternate locations for a dispenser (shown as phantom lines), any of which can also apply to any side panel of the container 700. FIG. 7D illustrates an isometric view of the container 700 of FIG. 7A.

Figure 7G:
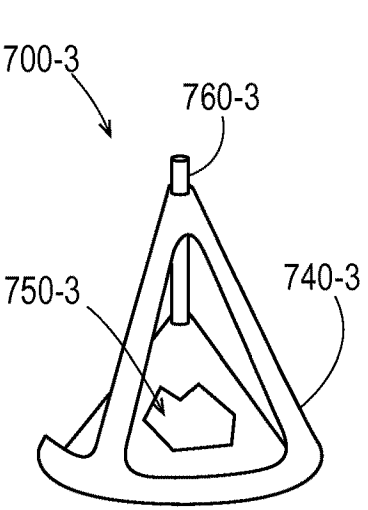
FIG. 7G illustrates a perspective view of an alternative embodiment of the stand up flexible container of FIG. 7A, including an external structural support frame.
Figure 7F:
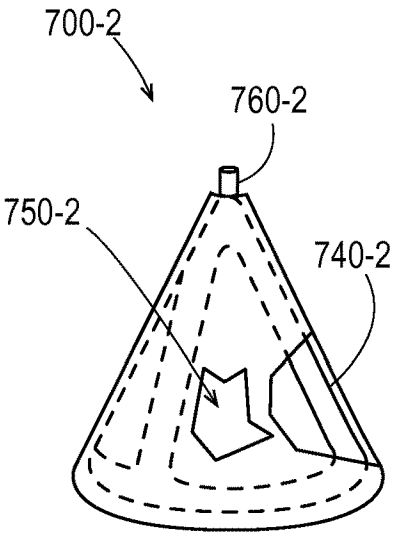
FIG. 7F illustrates a perspective view of an alternative embodiment of the stand up flexible container of FIG. 7A, including an internal structural support frame.
Figure 7E:
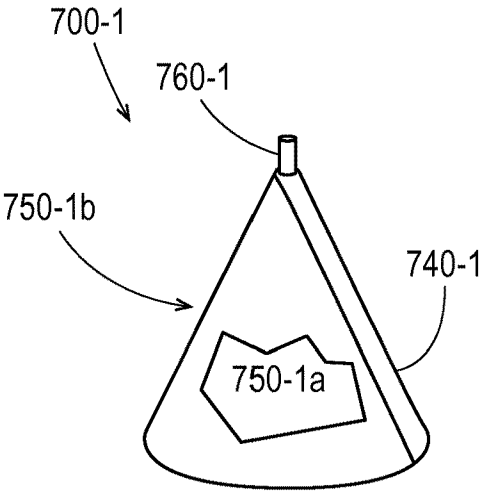
FIG. 7E illustrates a perspective view of an alternative embodiment of the stand up flexible container of FIG. 7A, including an asymmetric structural support frame.

FIG. 7E illustrates a perspective view of a container 700-1, which is an alternative embodiment of the stand up flexible container 700 of FIG. 7A, including an asymmetric structural support frame 740-1, a first portion of the product volume 750-1*b*, a second portion of the product volume 750-1*a*, and a dispenser 760-1, configured in the same manner as the embodiment of FIG. 1E, except based on the container 700. FIG. 7F illustrates a perspective view of a container 700-2, which is an alternative embodiment of the stand up flexible container 700 of FIG. 7A, including an internal structural support frame 740-2, a product volume 750-2, and a dispenser 760-2, configured in the same manner as the embodiment of FIG. 1F, except based on the container 700. FIG. 7G illustrates a perspective view of a container 700-3, which is an alternative embodiment of the stand up flexible container 700 of FIG. 7A, including an external structural support frame 740-3, a non-integral product volume 750-3 joined to and disposed within the frame 740-3, and a dispenser 760-3, configured in the same manner as the embodiment of FIG. 1G, except based on the container 700.

Figure 8B:
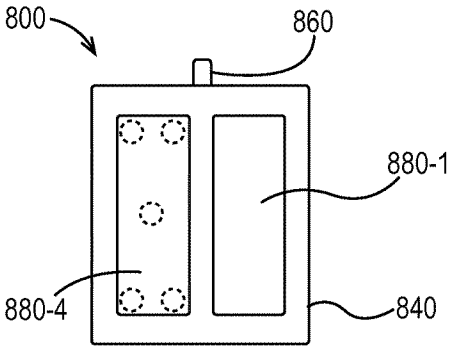
FIG. 8B illustrates a front view of the container of FIG. 8A.
Figure 8A:
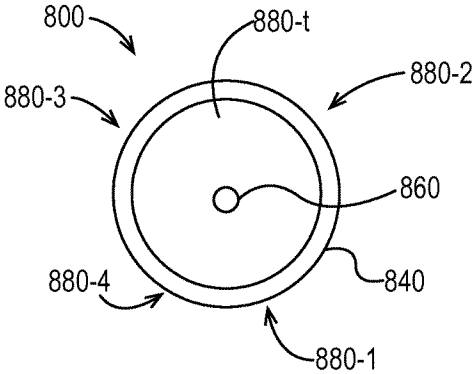
FIG. 8A illustrates a top view of a stand up flexible container having a structural support frame that has an overall shape like a cylinder.
Figure 8D:
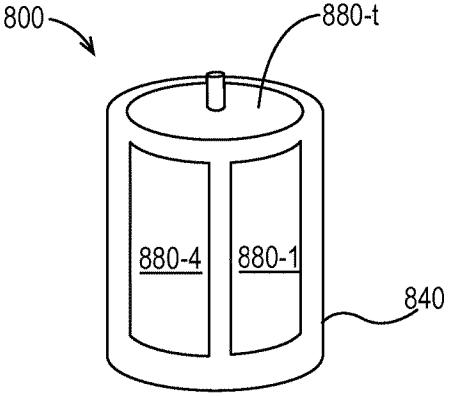
FIG. 8D illustrates an isometric view of the container of FIG. 8A.
Figure 8C:
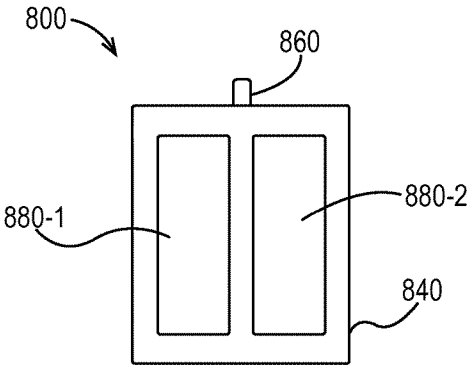
FIG. 8C illustrates a side view of the container of FIG. 8A.

FIG. 8A illustrates a front view of a stand up flexible container 800 having a structural support frame 840 that has an overall shape like a cylinder. The support frame 840 is formed by curved structural support members disposed around the top and bottom of the cylinder and by straight structural support members extending linearly from the top to the bottom, wherein the structural support members are joined together at their ends. The structural support members define a circular shaped top panel 880-*t*, curved somewhat rectangular shaped side panels 880-1, 880-2, 880-3, and 880-4, and a circular shaped bottom panel (not shown). Each of the side panels 880-1, 880-2, 880-3, and 880-4, is curved, however in various embodiments, part, parts, or about all, or approximately all, or substantially all, or nearly all, or all of any of the side panels can be approximately flat, substantially flat, nearly flat, or completely flat. The container 800 includes a dispenser 860, which is configured to dispense one or more fluent products from one or more product volumes disposed within the container 800. In the embodiment of FIG. 8A, the dispenser 860 is disposed in the center of the top panel 880-*t*, however, in various alternate embodiments, the dispenser 860 can be disposed anywhere else on the top, sides, or bottom, of the container 800. FIG. 8B illustrates a front view of the container 800 of FIG. 8A, including exemplary additional/alternate locations for a dispenser (shown as phantom lines), any of which can also apply to any side panel of the container 800. FIG. 8C illustrates a side view of the container 800 of FIG. 8A. FIG. 8D illustrates an isometric view of the container 800 of FIG. 8A.

Figure 8G:
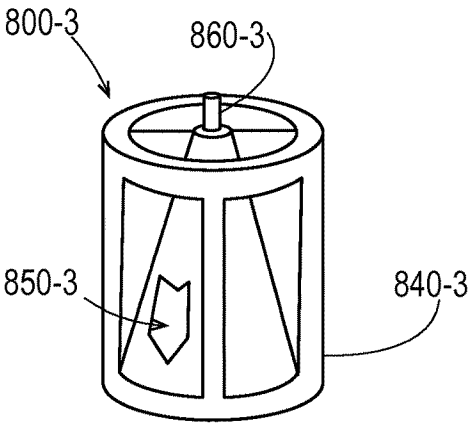
FIG. 8G illustrates a perspective view of an alternative embodiment of the stand up flexible container of FIG. 8A, including an external structural support frame.
Figure 8F:
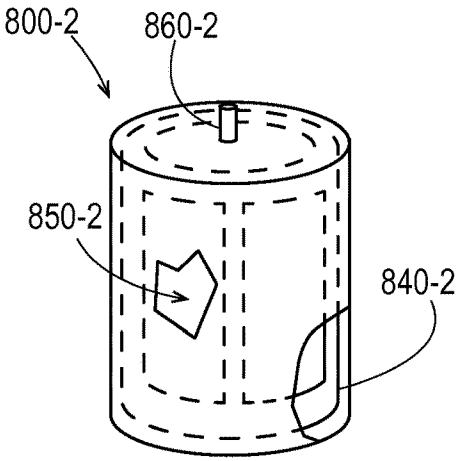
FIG. 8F illustrates a perspective view of an alternative embodiment of the stand up flexible container of FIG. 8A, including an internal structural support frame.
Figure 8E:
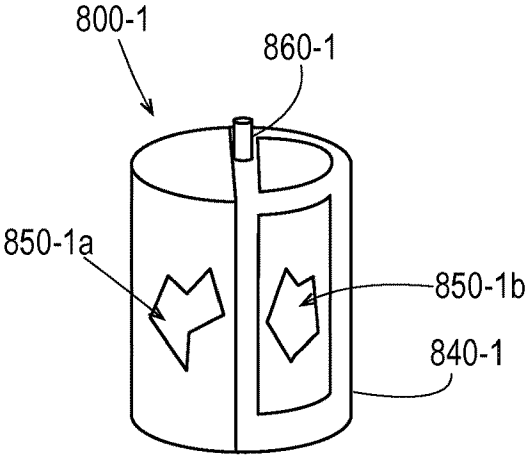
FIG. 8E illustrates a perspective view of an alternative embodiment of the stand up flexible container of FIG. 8A, including an asymmetric structural support frame.

FIG. 8E illustrates a perspective view of a container 800-1, which is an alternative embodiment of the stand up flexible container 800 of FIG. 8A, including an asymmetric structural support frame 840-1, a first portion of the product volume 850-1*b*, a second portion of the product volume 850-1*a*, and a dispenser 860-1, configured in the same manner as the embodiment of FIG. 1E, except based on the container 800. FIG. 8F illustrates a perspective view of a container 800-2, which is an alternative embodiment of the stand up flexible container 800 of FIG. 8A, including an internal structural support frame 840-2, a product volume 850-2, and a dispenser 860-2, configured in the same manner as the embodiment of FIG. 1F, except based on the container 800. FIG. 8G illustrates a perspective view of a container 800-3, which is an alternative embodiment of the stand up flexible container 800 of FIG. 8A, including an external structural support frame 840-3, a non-integral product volume 850-3 joined to and disposed within the frame 840-3, and a dispenser 860-3, configured in the same manner as the embodiment of FIG. 1G, except based on the container 800.

In additional embodiments, any stand up flexible container with a structural support frame, as disclosed herein, can be configured to have an overall shape that corresponds with any other known three-dimensional shape, including any kind of polyhedron, any kind of prismatoid, and any kind of prism (including right prisms and uniform prisms).

Figure 9B:
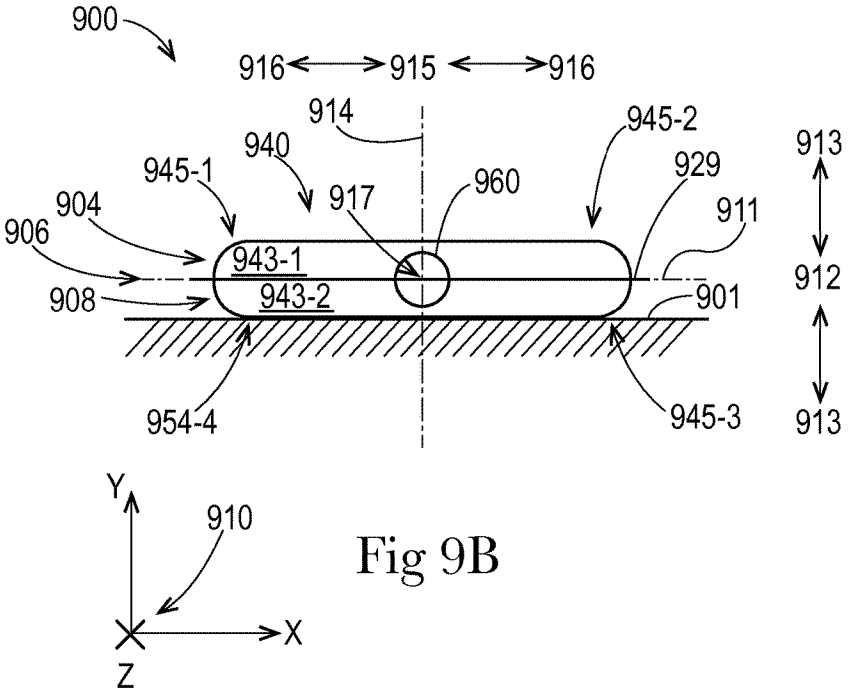
FIG. 9B illustrates an end view of the flexible container of FIG. 9A.
Figure 9A:
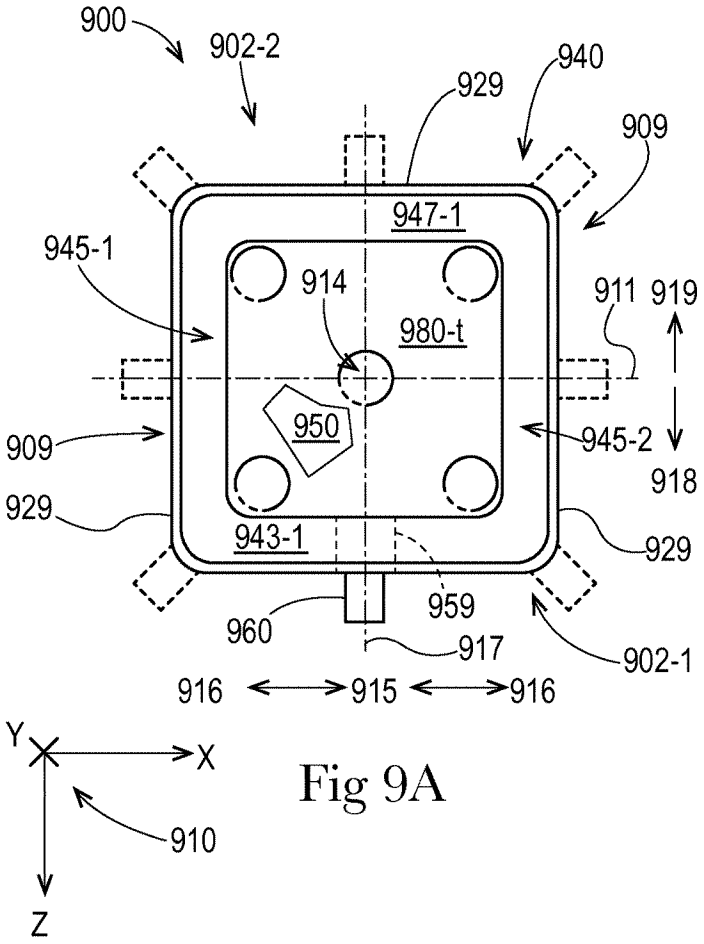
FIG. 9A illustrates a top view of an embodiment of a self-supporting flexible container, having an overall shape like a square.

FIG. 9A illustrates a top view of an embodiment of a self-supporting flexible container 900, having an overall shape like a square. FIG. 9B illustrates an end view of the flexible container 900 of FIG. 9A. The container 900 is resting on a horizontal support surface 901.

In FIG. 9B, a coordinate system 910, provides lines of reference for referring to directions in the figure. The coordinate system 910 is a three-dimensional Cartesian coordinate system, with an X-axis, a Y-axis, and a Z-axis. The X-axis and the Z-axis are parallel with the horizontal support surface 901 and the Y-axis is perpendicular to the horizontal support surface 901.

FIG. 9A also includes other lines of reference, for referring to directions and locations with respect to the container 100. A lateral centerline 911 runs parallel to the X-axis. An XY plane at the lateral centerline 911 separates the container 100 into a front half and a back half. An XZ plane at the lateral centerline 911 separates the container 100 into an upper half and a lower half. A longitudinal centerline 914 runs parallel to the Y-axis. A YZ plane at the longitudinal centerline 914 separates the container 900 into a left half and a right half. A third centerline 917 runs parallel to the Z-axis. The lateral centerline 911, the longitudinal centerline 914, and the third centerline 917 all intersect at a center of the container 900. These terms for direction, orientation, measurement, and disposition, in the embodiment of FIGS. 9A-9B are the same as the like-numbered terms in the embodiment of FIGS. 1A-1D.

The container 900 includes a top 904, a middle 906, and a bottom 908, the front 902-1, the back 902-2, and left and right sides 909. In the embodiment of FIGS. 9A-9B, the upper half and the lower half of the container are joined together at a seal 929, which extends around the outer periphery of the container 900. The bottom of the container 900 is configured in the same way as the top of the container 900.

The container 900 includes a structural support frame 940, a product volume 950, a dispenser 960, a top panel 980-*t* and a bottom panel (not shown). A portion of the top panel 980-*t* is illustrated as broken away, in order to show the product volume 950. The product volume 950 is configured to contain one or more fluent products. The dispenser 960 allows the container 900 to dispense these fluent product(s) from the product volume 950 through a flow channel 959 then through the dispenser 960, to the environment outside of the container 900. The structural support frame 940 supports the mass of fluent product(s) in the product volume 950. The top panel 980-*t* and the bottom panel are relatively flat surfaces, overlaying the product volume 950, and are suitable for displaying any kind of indicia.

The structural support frame 940 is formed by a plurality of structural support members. The structural support frame 940 includes front structural support members 943-1 and 943-2, intermediate structural support members 945-1, 945-2, 945-3, and 945-4, as well as back structural support members 947-1 and 947-2. Overall, each of the structural support members in the container 900 is oriented horizontally. And, each of the structural support members in the container 900 has a cross-sectional area that is substantially uniform along its length, although in various embodiments, this cross-sectional area can vary.

Upper structural support members 943-1, 945-1, 945-2, and 947-1 are disposed in an upper part of the middle 906 and in the top 904, while lower structural support members 943-2, 945-4, 945-3, and 947-2 are disposed in a lower part of the middle 906 and in the bottom 908. The upper structural support members 943-1, 945-1, 945-2, and 947-1 are disposed above and adjacent to the lower structural support members 943-2, 945-4, 945-3, and 947-2, respectively.

In various embodiments, adjacent upper and lower structural support members can be in contact with each other at one or more relatively smaller locations and/or at one or more relatively larger locations, along part, or parts, or about all, or approximately all, or substantially all, or nearly all, or all of their overall lengths, so long as there is a gap in the contact for the flow channel 959, between the structural support members 943-1 and 943-2. In the embodiment of FIGS. 9A-9B, the upper and lower structural support members are not directly connected to each other. However, in various alternate embodiments, adjacent upper and lower structural support members can be directly connected and/or joined together along part, or parts, or about all, or approximately all, or substantially all, or nearly all, or all of their overall lengths.

The ends of structural support members 943-1, 945-2, 947-1, and 945-1 are joined together to form a top square that is outward from and surrounding the product volume 950, and the ends of structural support members 943-2, 945-3, 947-2, and 945-4 are also joined together to form a bottom square that is outward from and surrounding the product volume 950. In the structural support frame 940, the ends of the structural support members, which are joined together, are directly connected, all around the periphery of their walls. However, in various alternative embodiments, any of the structural support members of the embodiment of FIGS. 9A-9B can be joined together in any way described herein or known in the art.

In alternative embodiments of the structural support frame 940, adjacent structural support members can be combined into a single structural support member, wherein the combined structural support member can effectively substitute for the adjacent structural support members, as their functions and connections are described herein. In other alternative embodiments of the structural support frame 940, one or more additional structural support members can be added to the structural support members in the structural support frame 940, wherein the expanded structural support frame can effectively substitute for the structural support frame 940, as its functions and connections are described herein.

Figure 9E:
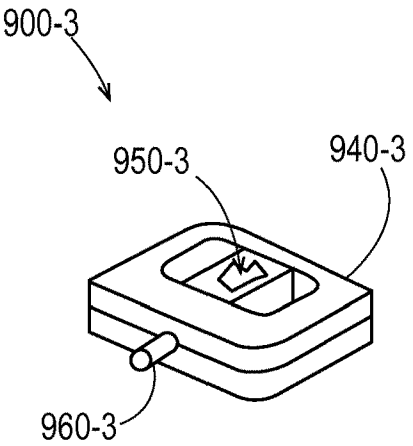
FIG. 9E illustrates a perspective view of an alternative embodiment of the self-supporting flexible container of FIG. 9A, including an external structural support frame.
Figure 9D:
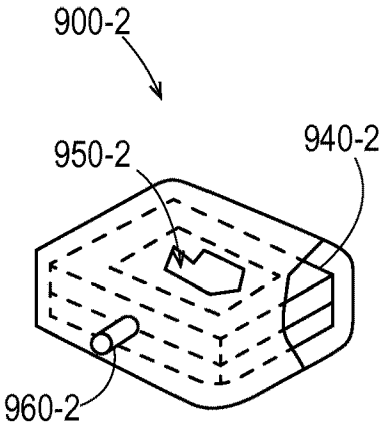
FIG. 9D illustrates a perspective view of an alternative embodiment of the self-supporting flexible container of FIG. 9A, including an internal structural support frame.
Figure 9C:
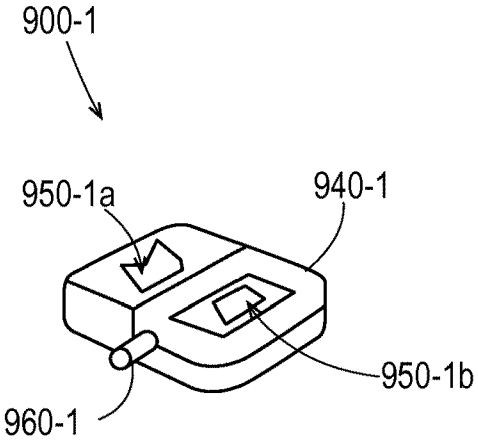
FIG. 9C illustrates a perspective view of an alternative embodiment of the self-supporting flexible container of FIG. 9A, including an asymmetric structural support frame.

FIG. 9C illustrates a perspective view of a container 900-1, which is an alternative embodiment of the self-supporting flexible container 900 of FIG. 1A, including an asymmetric structural support frame 940-1, a first portion of the product volume 950-1*b*, a second portion of the product volume 950-1*a*, and a dispenser 960-1. The embodiment of FIG. 9C is similar to the embodiment of FIG. 9A with like-numbered terms configured in the same way, except that the frame 940-1 extends around about half of the container 900-1, directly supporting a first portion of the product volume 950-1*b*, which is disposed inside of the frame 940-1, and indirectly supporting a second portion of the product volume 950-1*a*, which is disposed outside of the frame 940-1. In various embodiments, any self-supporting flexible container of the present disclosure can be modified in a similar way, such that: the frame extends around only part or parts of the container, and/or the frame is asymmetric with respect to one or more centerlines of the container, and/or part or parts of one or more product volumes of the container are disposed outside of the frame, and/or part or parts of one or more product volumes of the container are indirectly supported by the frame.

FIG. 9D illustrates a perspective view of a container 900-2, which is an alternative embodiment of the self-supporting flexible container 900 of FIG. 9A, including an internal structural support frame 940-2, a product volume 950-2, and a dispenser 960-2. The embodiment of FIG. 9D is similar to the embodiment of FIG. 9A with like-numbered terms configured in the same way, except that the frame 940-2 is internal to the product volume 950-2. In various embodiments, any self-supporting flexible container of the present disclosure can be modified in a similar way, such that: part, parts, or all of the frame (including part, parts, or all of one or more of any structural support members that form the frame) are about, approximately, substantially, nearly, or completely enclosed by one or more product volumes.

FIG. 9E illustrates a perspective view of a container 900-3, which is an alternative embodiment of the stand up flexible container 900 of FIG. 9A, including an external structural support frame 940-3, a product volume 950-3, and a dispenser 960-3. The embodiment of FIG. 9E is similar to the embodiment of FIG. 9A with like-numbered terms configured in the same way, except that the product volume 950-3 is not integrally connected to the frame 940-3 (that is, not simultaneously made from the same web of flexible materials), but rather the product volume 950-3 is separately made and then joined to the frame 940-3. The product volume 950-3 can be joined to the frame in any convenient manner disclosed herein or known in the art. In the embodiment of FIG. 9E, the product volume 950-3 is disposed within the frame 940-3, but the product volume 950-3 has a reduced size and a somewhat different shape, when compared with the product volume 950 of FIG. 9A; however, these differences are made to illustrate the relationship between the product volume 950-3 and the frame 940-3, and are not required. In various embodiments, any self-supporting flexible container of the present disclosure can be modified in a similar way, such that one or more the product volumes are not integrally connected to the frame.

FIGS. 10A-11E illustrate embodiments of self-supporting flexible containers (that are not stand up containers) having various overall shapes. Any of the embodiments of FIGS. 10A-11E can be configured according to any of the embodiments disclosed herein, including the embodiments of FIGS. 9A-9E. Any of the elements (e.g. structural support frames, structural support members, panels, dispensers, etc.) of the embodiments of FIGS. 10A-11E, can be configured according to any of the embodiments disclosed herein. While each of the embodiments of FIGS. 10A-11E illustrates a container with one dispenser, in various embodiments, each container can include multiple dispensers, according to any embodiment described herein. Part, parts, or about all, or approximately all, or substantially all, or nearly all, or all of each of the panels in the embodiments of FIGS. 10A-11E is suitable to display any kind of indicia. Each of the top and bottom panels in the embodiments of FIGS. 10A-11E is configured to be a nonstructural panel, overlaying product volume(s) disposed within the flexible container, however, in various embodiments, one or more of any kind of decorative or structural element (such as a rib, protruding from an outer surface) can be joined to part, parts, or about all, or approximately all, or substantially all, or nearly all, or all of any of these panels. For clarity, not all structural details of these flexible containers are shown in FIGS. 10A-11E, however any of the embodiments of FIGS. 10A-11E can be configured to include any structure or feature for flexible containers, disclosed herein.

Figure 10B:
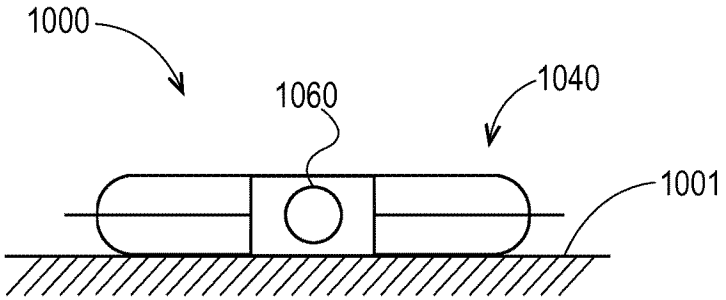
FIG. 10B illustrates an end view of the flexible container of FIG. 10A.
Figure 10A:
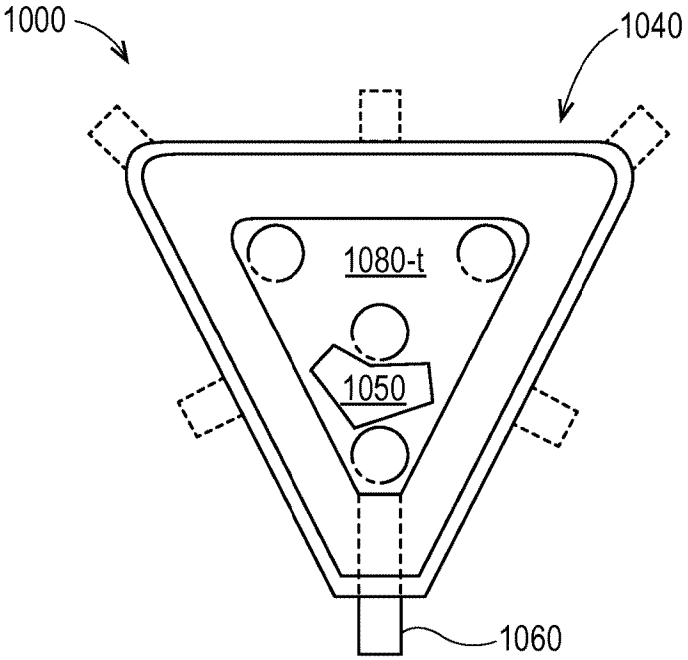
FIG. 10A illustrates a top view of an embodiment of a self-supporting flexible container, having an overall shape like a triangle.

FIG. 10A illustrates a top view of an embodiment of a self-supporting flexible container 1000 (that is not a stand up flexible container) having a product volume 1050 and an overall shape like a triangle. However, in various embodiments, a self-supporting flexible container can have an overall shape like a polygon having any number of sides. The support frame 1040 is formed by structural support members disposed along the edges of the triangular shape and joined together at their ends. The structural support members define a triangular shaped top panel 1080-*t*, and a triangular shaped bottom panel (not shown). The top panel 1080-*t* and the bottom panel are about flat, however in various embodiments, part, parts, or about all, or approximately all, or substantially all, or nearly all, or all of any of the side panels can be approximately flat, substantially flat, nearly flat, or completely flat. The container 1000 includes a dispenser 1060, which is configured to dispense one or more fluent products from one or more product volumes disposed within the container 1000. In the embodiment of FIG. 10A, the dispenser 1060 is disposed in the center of the front, however, in various alternate embodiments, the dispenser 1060 can be disposed anywhere else on the top, sides, or bottom, of the container 1000. FIG. 10A includes exemplary additional/alternate locations for a dispenser (shown as phantom lines). FIG. 10B illustrates an end view of the flexible container 1000 of FIG. 10B, resting on a horizontal support surface 1001.

Figure 10E:
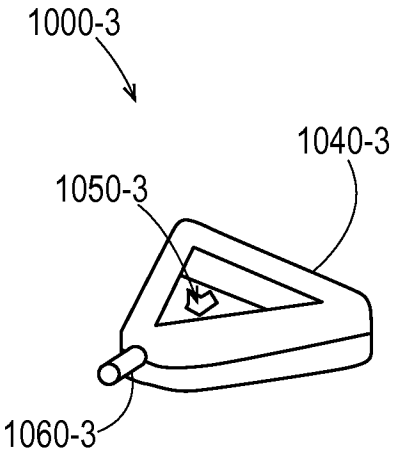
FIG. 10E illustrates a perspective view of an alternative embodiment of the self-supporting flexible container of FIG. 10A, including an external structural support frame.
Figure 10D:
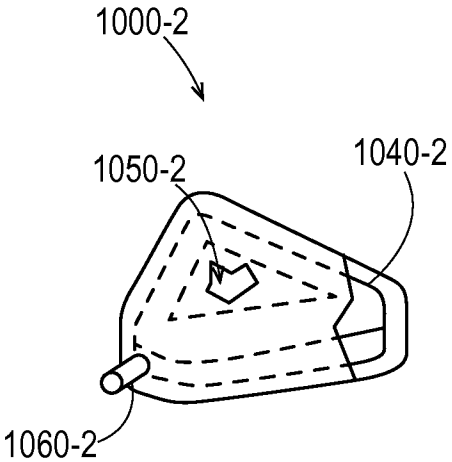
FIG. 10D illustrates a perspective view of an alternative embodiment of the self-supporting flexible container of FIG. 10A, including an internal structural support frame.
Figure 10C:
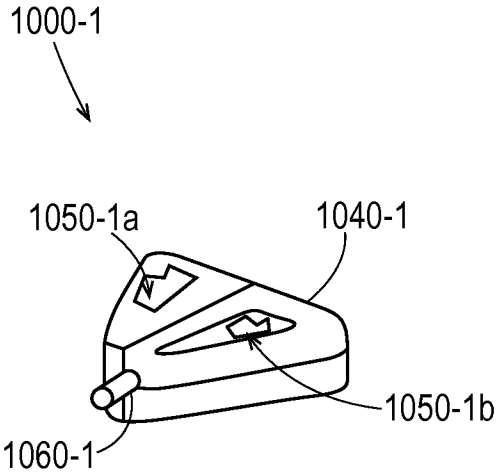
FIG. 10C illustrates a perspective view of an alternative embodiment of the self-supporting flexible container of FIG. 10A, including an asymmetric structural support frame.

FIG. 10C illustrates a perspective view of a container 1000-1, which is an alternative embodiment of the self-supporting flexible container 1000 of FIG. 10A, including an asymmetric structural support frame 1040-1, a first portion of the product volume 1050-1*b*, a second portion of the product volume 1050-1*a*, and a dispenser 1060-1, configured in the same manner as the embodiment of FIG. 9C, except based on the container 1000. FIG. 10D illustrates a perspective view of a container 1000-2, which is an alternative embodiment of the self-supporting flexible container 1000 of FIG. 10A, including an internal structural support frame 1040-2, a product volume 1050-2, and a dispenser 1060-2, configured in the same manner as the embodiment of FIG. 9D, except based on the container 1000. FIG. 10E illustrates a perspective view of a container 1000-3, which is an alternative embodiment of the self-supporting flexible container 1000 of FIG. 10A, including an external structural support frame 1040-3, a non-integral product volume 1050-3 joined to and disposed within the frame 1040-3, and a dispenser 1060-3, configured in the same manner as the embodiment of FIG. 9E, except based on the container 1000.

Figure 11B:
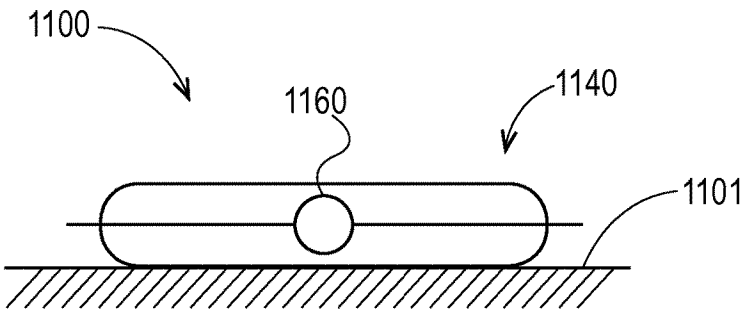
FIG. 11B illustrates an end view of the flexible container of FIG. 11A.
Figure 11A:
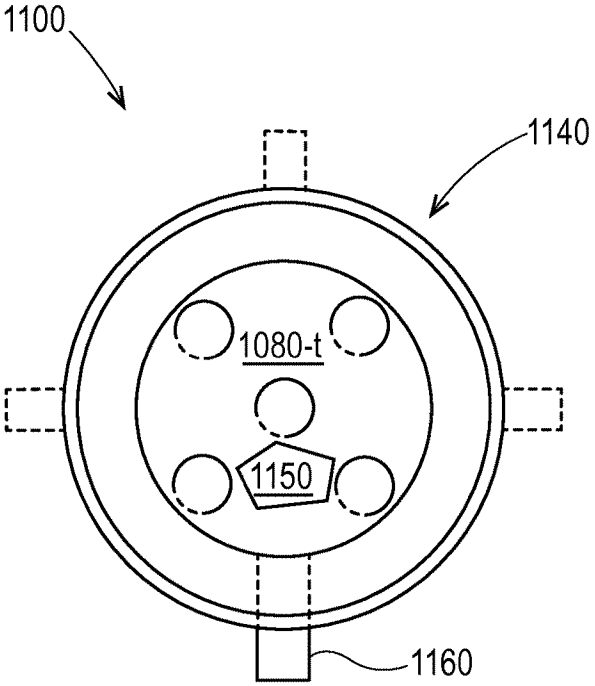
FIG. 11A illustrates a top view of an embodiment of a self-supporting flexible container, having an overall shape like a circle.

FIG. 11A illustrates a top view of an embodiment of a self-supporting flexible container 1100 (that is not a stand up flexible container) having a product volume 1150 and an overall shape like a circle. The support frame 1140 is formed by structural support members disposed around the circumference of the circular shape and joined together at their ends. The structural support members define a circular shaped top panel 1180-*t*, and a circular shaped bottom panel (not shown). The top panel 1180-*t* and the bottom panel are about flat, however in various embodiments, part, parts, or about all, or approximately all, or substantially all, or nearly all, or all of any of the side panels can be approximately flat, substantially flat, nearly flat, or completely flat. The container 1100 includes a dispenser 1160, which is configured to dispense one or more fluent products from one or more product volumes disposed within the container 1100. In the embodiment of FIG. 11A, the dispenser 1160 is disposed in the center of the front, however, in various alternate embodiments, the dispenser 1160 can be disposed anywhere else on the top, sides, or bottom, of the container 1100. FIG. 11A includes exemplary additional/alternate locations for a dispenser (shown as phantom lines). FIG. 11B illustrates an end view of the flexible container 1100 of FIG. 10B, resting on a horizontal support surface 1101.

Figure 11E:
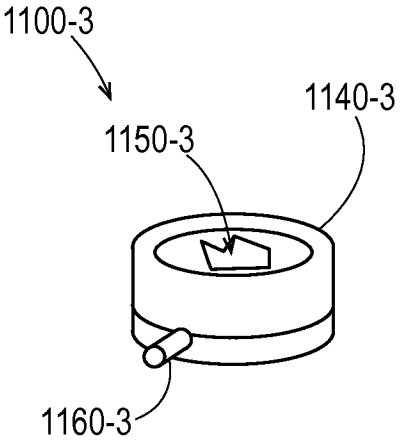
FIG. 11E illustrates a perspective view of an alternative embodiment of the self-supporting flexible container of FIG. 11A, including an external structural support frame.
Figure 11D:
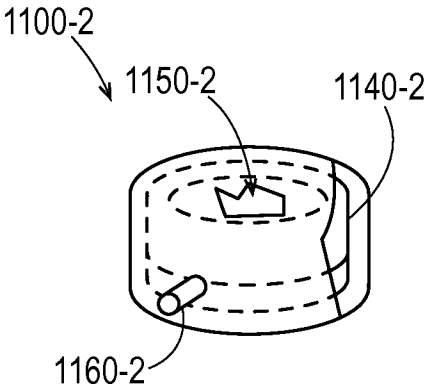
FIG. 11D illustrates a perspective view of an alternative embodiment of the self-supporting flexible container of FIG. 11A, including an internal structural support frame.
Figure 11C:
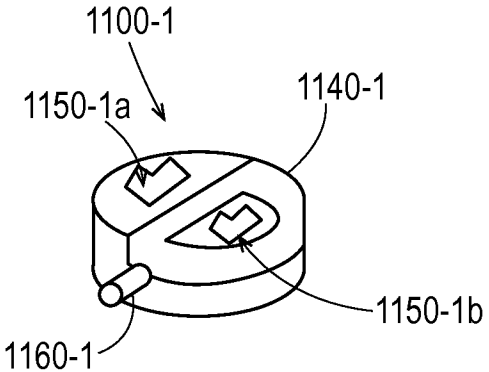
FIG. 11C illustrates a perspective view of an alternative embodiment of the self-supporting flexible container of FIG. 11A, including an asymmetric structural support frame.

FIG. 11C illustrates a perspective view of a container 1100-1, which is an alternative embodiment of the self-supporting flexible container 1100 of FIG. 11A, including an asymmetric structural support frame 1140-1, a first portion of the product volume 1150-1*b*, a second portion of the product volume 1150-1*a*, and a dispenser 1160-1, configured in the same manner as the embodiment of FIG. 9C, except based on the container 1100. FIG. 11D illustrates a perspective view of a container 1100-2, which is an alternative embodiment of the self-supporting flexible container 1100 of FIG. 11A, including an internal structural support frame 1140-2, a product volume 1150-2, and a dispenser 1160-2, configured in the same manner as the embodiment of FIG. 9D, except based on the container 1100. FIG. 11E illustrates a perspective view of a container 1100-3, which is an alternative embodiment of the self-supporting flexible container 1100 of FIG. 11A, including an external structural support frame 1140-3, a non-integral product volume 1150-3 joined to and disposed within the frame 1140-3, and a dispenser 1160-3, configured in the same manner as the embodiment of FIG. 9E, except based on the container 1100.

In additional embodiments, any self-supporting container with a structural support frame, as disclosed herein, can be configured to have an overall shape that corresponds with any other known three-dimensional shape. For example, any self-supporting container with a structural support frame, as disclosed herein, can be configured to have an overall shape (when observed from a top view) that corresponds with a rectangle, a polygon (having any number of sides), an oval, an ellipse, a star, or any other shape, or combinations of any of these.

Figure 12A:
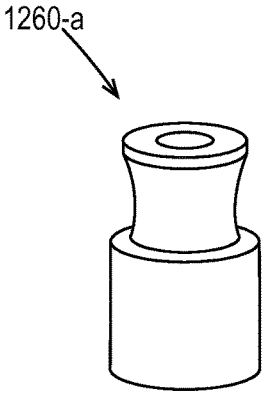
FIG. 12A illustrates an isometric view of push-pull type dispenser.
Figure 12B:
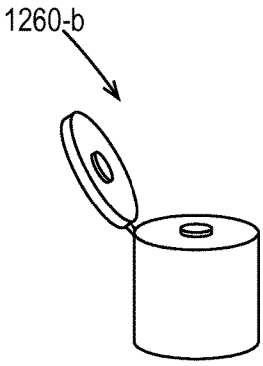
FIG. 12B illustrates an isometric view of dispenser with a flip-top cap.
Figure 12C:
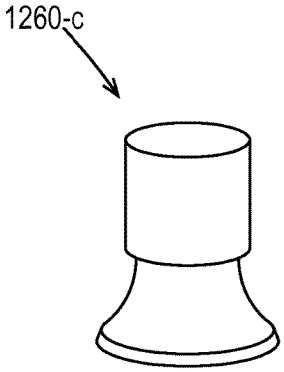
FIG. 12C illustrates an isometric view of dispenser with a screw-on cap.
Figure 12D:
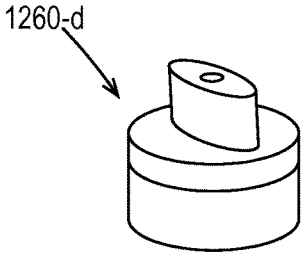
FIG. 12D illustrates an isometric view of rotatable type dispenser.
Figure 12E:
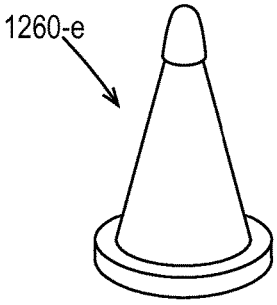
FIG. 12E illustrates an isometric view of nozzle type dispenser with a cap.
Figures 13A, 13B, 13C, 13D:
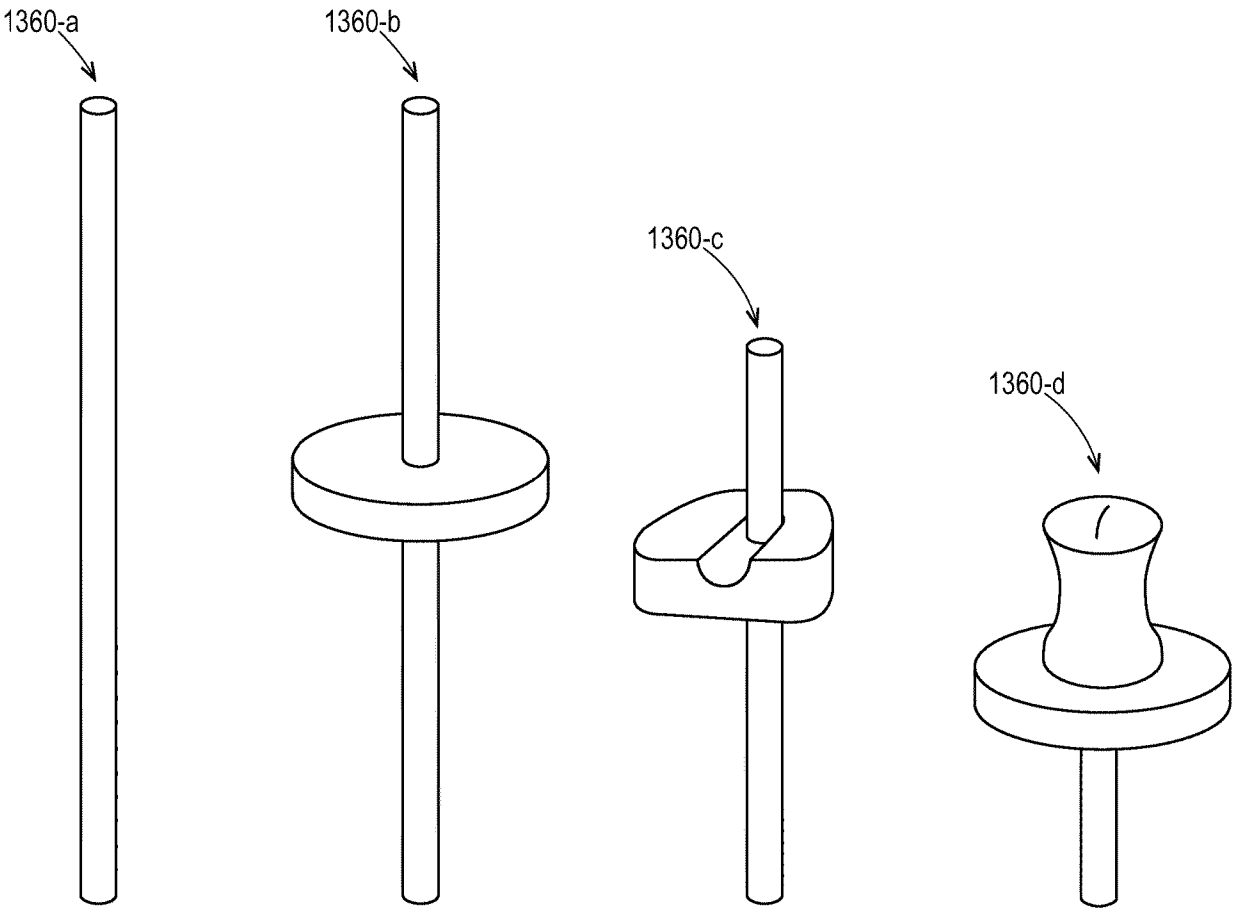
FIG. 13A illustrates an isometric view of straw dispenser.
FIG. 13B illustrates an isometric view of straw dispenser with a lid.
FIG. 13C illustrates an isometric view of flip up straw dispenser.
FIG. 13D illustrates an isometric view of straw dispenser with bite valve.
Figure 14A:
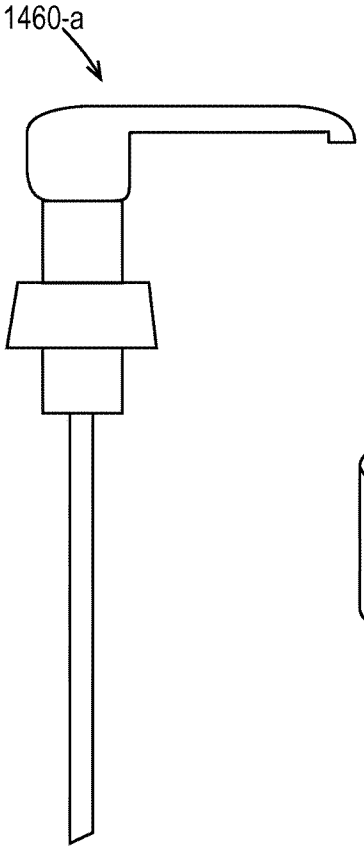
FIG. 14A illustrates an isometric view of pump type dispenser.
Figure 14B:
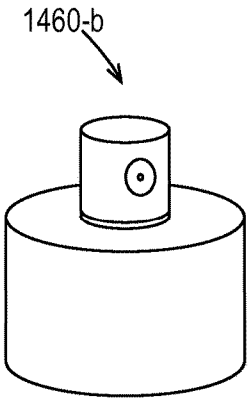
FIG. 14B illustrates an isometric view of pump spray type dispenser.
Figure 14C:
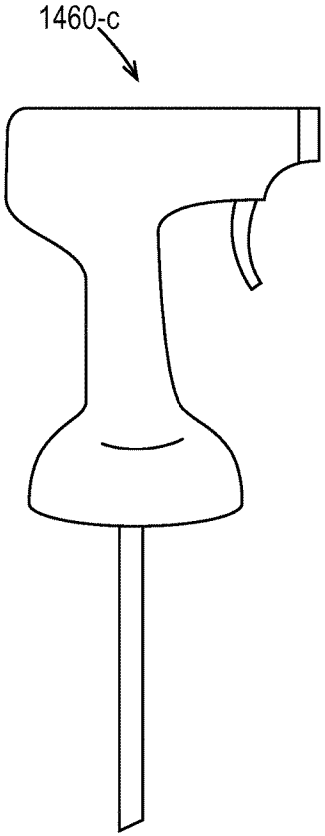
FIG. 14C illustrates an isometric view of trigger spray type dispenser.

FIGS. 12A-14C illustrate various exemplary dispensers, which can be used with the flexible containers disclosed herein. FIG. 12A illustrates an isometric view of push-pull type dispenser 1260-*a*. FIG. 12B illustrates an isometric view of dispenser with a flip-top cap 1260-*b*. FIG. 12C illustrates an isometric view of dispenser with a screw-on cap 1260-*c*. FIG. 12D illustrates an isometric view of rotatable type dispenser 1260-*d*. FIG. 12E illustrates an isometric view of nozzle type dispenser with a cap 1260-*d*. FIG. 13A illustrates an isometric view of straw dispenser 1360-*a*. FIG. 13B illustrates an isometric view of straw dispenser with a lid 1360-*b*. FIG. 13C illustrates an isometric view of flip up straw dispenser 1360-*c*. FIG. 13D illustrates an isometric view of straw dispenser with bite valve 1360-*d*. FIG. 14A illustrates an isometric view of pump type dispenser 1460-*a*, which can, in various embodiments be a foaming pump type dispenser. FIG. 14B illustrates an isometric view of pump spray type dispenser 1460-*b*. FIG. 14C illustrates an isometric view of trigger spray type dispenser 1460-*c*.

Figure 15:
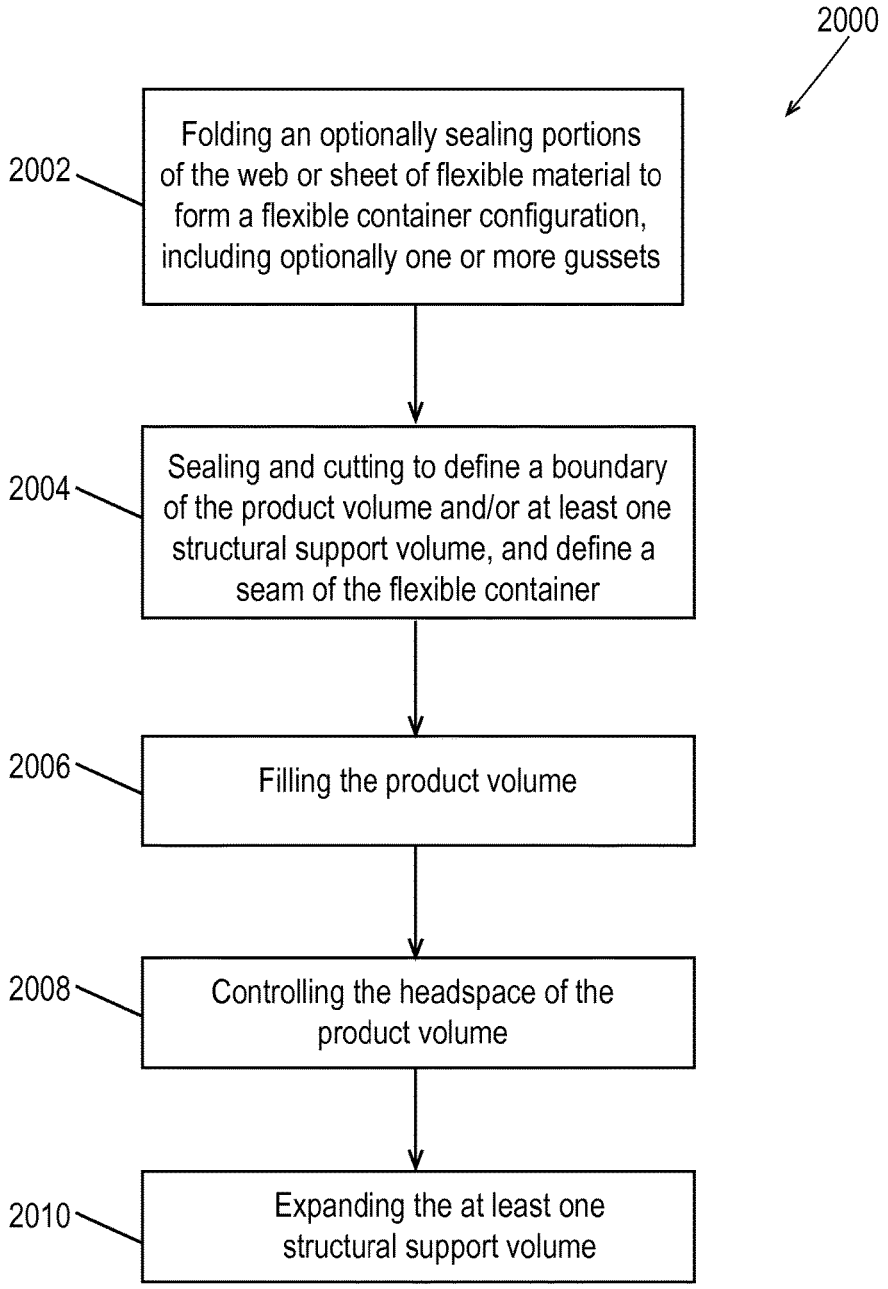
FIG. 15 is a process flow chart of a process of forming a flexible container in accordance with an embodiment of the disclosure.

Referring to FIG. 15, flexible containers in accordance with embodiments of the disclosure can be formed by a series of unit operations, steps, or transformations, including, for example, folding one or more webs or sheets that includes at least two layers of flexible material into the flexible container configuration 2002, sealing and cutting the flexible materials to define the seams of the flexible container 2004, filling the product volume with product 2006, and expanding the at least one structural support volume 2010. The folding process for forming the flexible container configuration 2002 can optionally include one or more sealing steps. The method can also include a headspace reduction step 2008 for controlling the headspace and pressure of the product volume upon expansion of the structural support volume and a final sealing step 2012 in which one or more ports used to fill the product volume and expand the structural support volumes are sealed. Additional steps can be included in the method, including, but not limited to, a sealing step for forming an inner boundary of the at least one structural support volumes, a product volume fill port formation step, a structural support volume expansion port formation step, valve and venting formation steps, and gusset forming, folding, and sealing steps. The gusset forming, folding, and sealing steps can be performed, for example, as part of the folding of the web or sheet into the flexible container configuration.

Figure 16:
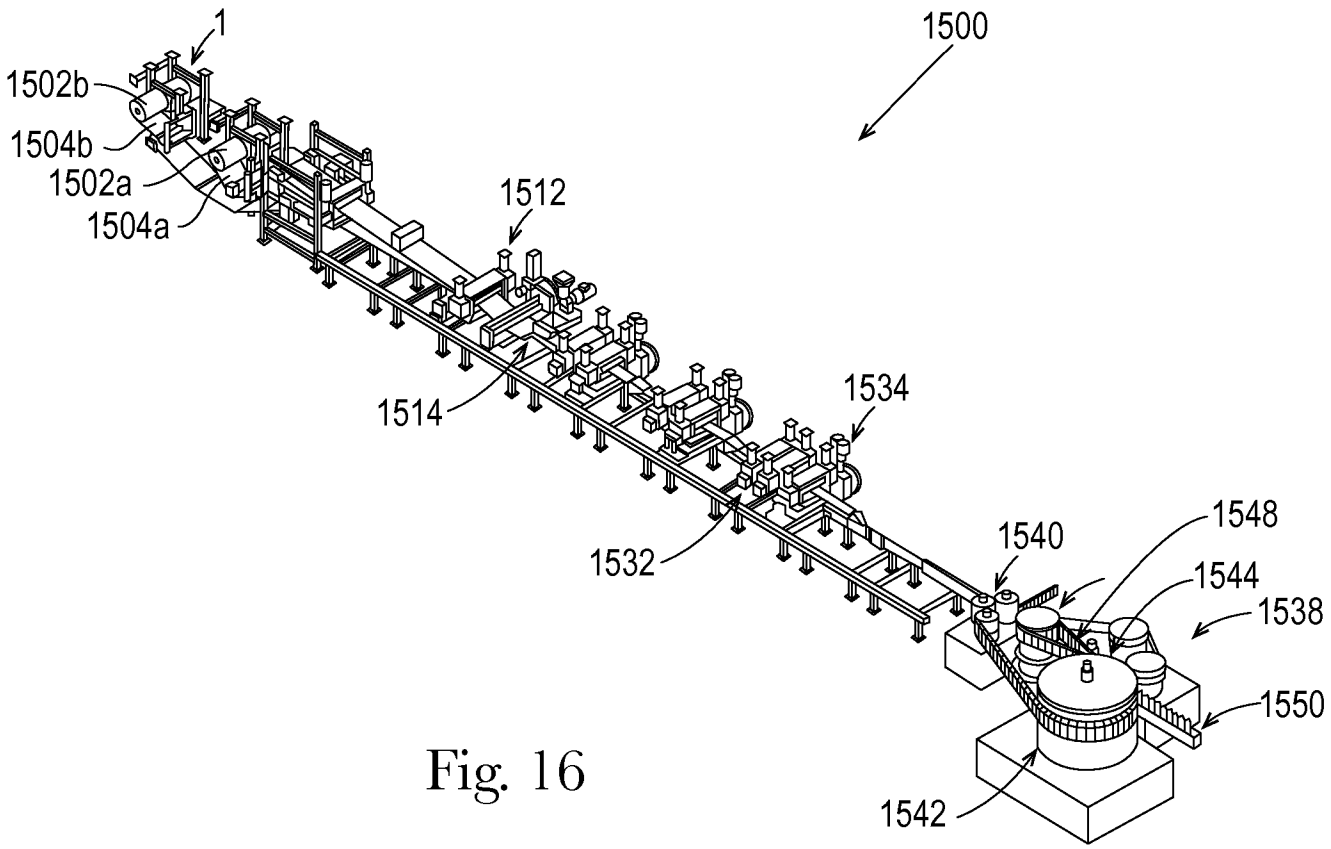
FIG. 16 is a perspective view of a production line layout for a method of forming a flexible container in accordance with an embodiment of the disclosure.

FIG. 16 illustrates an embodiment of a production line 1500 for performing a method of for forming a flexible container and in particular a plurality of flexible containers from a web or sheet. In embodiments utilizing one or more continuous webs, for example, two webs, the product line 1500 can include a pair of unwind stands 1502*a*, 1502*b* for unwinding the first and second webs 1504*a*, 1504*b*, in a controlled manner. The webs can optionally proceed through a sealing station 1512, which can form complex non-linear seals through two or more layers, for example, to define at least a portion of an inner boundary of a structural support volume. The web can then proceed to a folding station 1514 where the web is configured into the flexible container blank. The folding station can optionally include sealing stations within the folding station, for example, used in a process of forming a gusset. The folding station 1514 can be used to form one or more gussets as well as one or more product filling ports and one or more expansion ports. The folded web can then proceed to one or more additional sealing stations 1532, 1534 where a perimeter seal is formed and the package is singulated. The production line can advantageously include at the one or more sealing stations 1532, 1534, a sealing apparatus that can seal and cut the perimeter seal in a single unit operation.

With a fully formed singulated flexible container blank completed, the container can pass through a container blank processing station 1538 where each singulated container can be gripped for further processing. The flexible container is gripped for transport at a gripping station 1540. Next, the flexible container passes through an opening and a filing station 1542 where a fluent product is deposited into the product volume, for example, through a product filling port. The flexible container can then pass through a headspace reduction station 1544 where an external force is applied to the flexible container. Alternatively, the headspace reduction station 1544 can be incorporated into the filling station 1542. Optionally, the product volume can be sealed at the headspace reduction station 1544. The container then passes through an expansion station 1546 where a cryogenic fluid is dispensed into the at least one structural support volume to expand the structural support volume. Optionally, the expansion station 1546 can be incorporated into or disposed such that the headspace reduction station 1544 can maintain the external force on the flexible container during expansion of the structural support volume. The container can then pass through a further sealing station 1548 to seal the product volume if not previously sealed and seal the structural support volume. The processes for filling the product volume, reducing the headspace, and expanding the structural support volumes are described in detail below.

The singulated flexible container blank having a product volume and at least one structural support volume that extends at least partially into the product volume can undergo a process for filling the product volume and expanding the at least one structural support volume. In one embodiment, the product volume is filled prior to expanding the at least one structural support volume. It has been found that filling the product volume before expansion of the at least one structural support volume can be advantageous in providing a simplified and more robust process for filling the product volume and expanding the at least one structural support volume. For example, filling the product volume before expanding the at least one structural support volume can provide a flexible container that is easier to grip during filling and can avoid spillage or overfilling of the product volume with product that can result when filling with the at least one structural support volume expanded. Avoiding such spillage or overfilling can be advantageous in providing a sealing region of the product volume that is free from product. A sealing region that is contaminated with product can be difficult to seal. However, some sealing methods, such as ultrasonic sealing can be used to form and effective seal even with contamination in the sealing region. It is contemplated herein that some contamination of the sealing region may occur during the filling process, even with the product volume being filled prior to expansion of the at least one structural support volume. In such instances, ultrasonic sealing may be used to seal a contaminated seal region.

The process of filing the product volume and expanding the at least one structural support volume generally includes filling the product volume with product, applying an external force to the product volume to reduce the product receiving volume, and expanding the structural support volume. The flexible containers in accordance with embodiments of the disclosure include a structural support volume that at least partially extends into the product volume. Accordingly, the available volume of the product volume capable of receiving or containing product is reduced upon expansion of the at least one structural support volume. The process can include a step of applying an external force to the product volume during filling to reduce the product receiving volume and account for the reduction in the product receiving volume that will result upon expansion of the structural support volume, while considering the pressure desired within the headspace.

The application of the external force to reduce the product receiving volume can allows for the introduction of the product at a lower fill height, which can then adjust a higher fill height in a controlled manner to avoid contamination in the sealing region. The application of the external force can also beneficially allow for control over the desired pressure of the headspace in the product volume while accounting for volume changes resulting from expansion of the structural support volume.

For example, after filling of the product and expansion of the structural support volumes, the flexible containers have a final (third) product receiving volume. In various embodiments, the second product receiving volume can be tailored, through the application of the external force and reduction of the pre-expansion headspace, to be equal to or substantially equal to the final (third) product receiving volume. In such embodiments, the product volume will be at atmospheric pressure after expansion of the structural support volume. In other embodiments, the second product receiving volume can be tailored to provide a desired pressurized or vacuum state of the product volume after expansion of the structural support volume. For example, if the second product receiving volume is selected to be greater than the final (third) product receiving volume, the product volume will be pressurized (i.e. at a pressure greater than atmospheric pressure) after expansion of the structural support volume. If the second product receiving volume is selected to be less than to the final (third) product receiving volume, the product volume will be under vacuum (i.e. at a pressure less than atmospheric pressure) after expansion of the structural support volume.

Figure 17A:
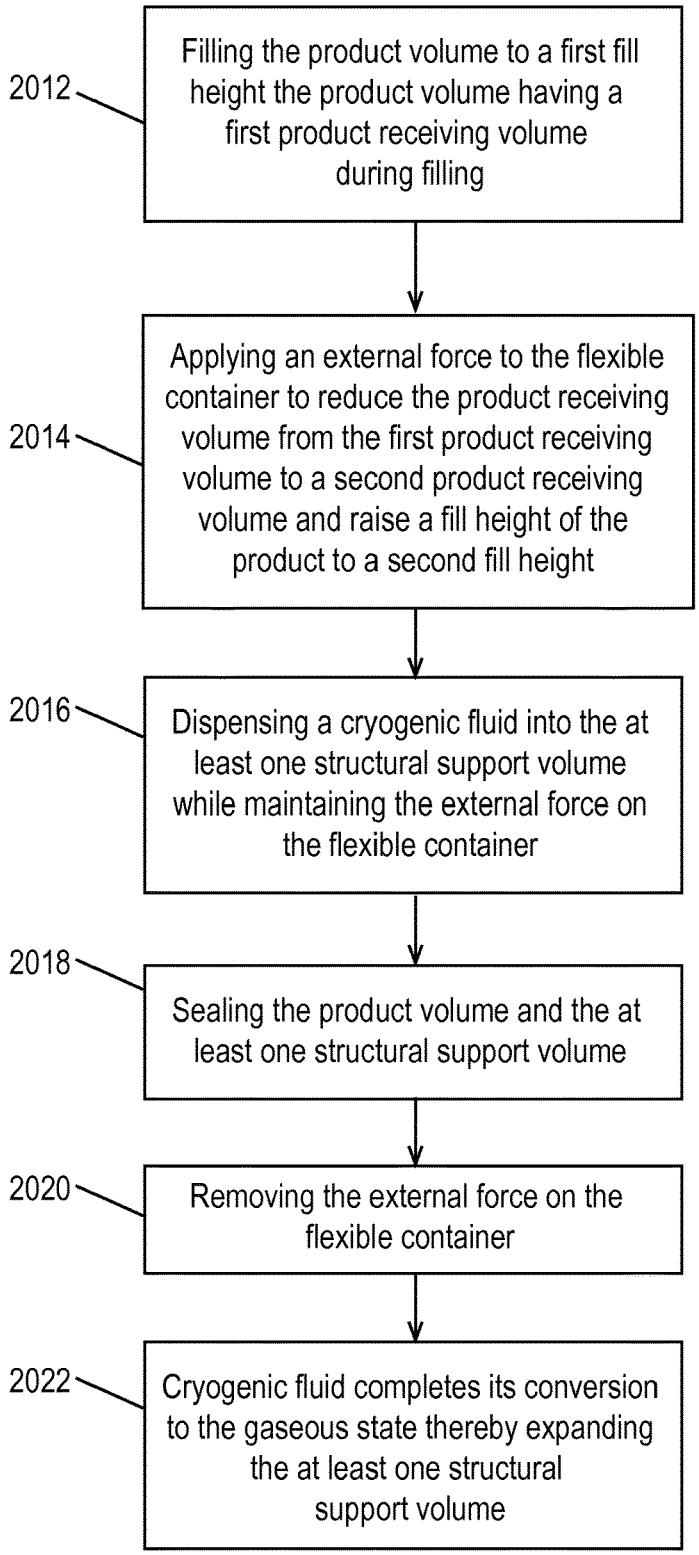
FIG. 17A is a process flow chart of a process of filling a product volume and expanding a structural support volume of a flexible container in accordance with an embodiment of the disclosure.
Figure 17B:
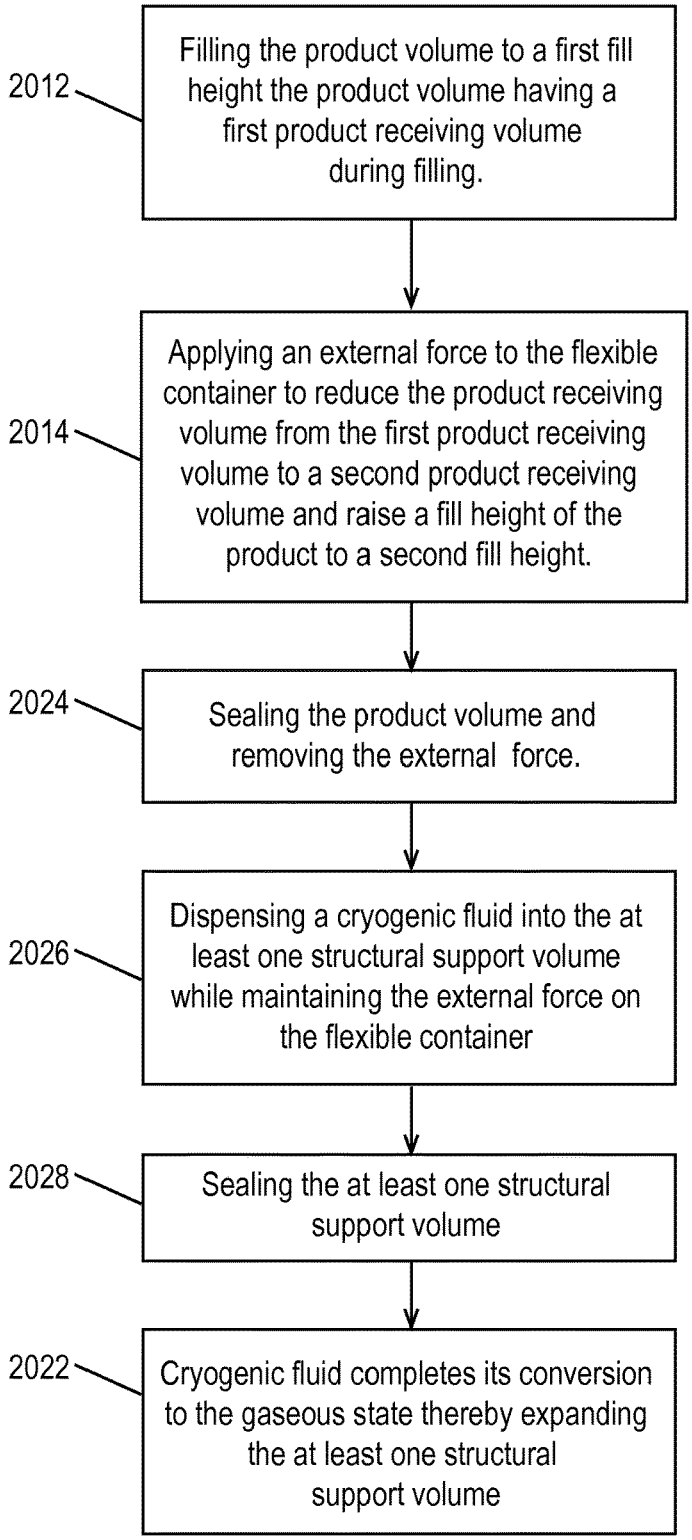
FIG. 17B is a process flow chart of a process of filling a product volume and expanding a structural support volume of a flexible container in accordance with another embodiment of the disclosure.
Figure 18A:
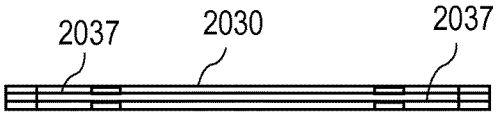
FIG. 18A is a schematic illustration of a flexible container having an unfilled product volume and an unexpanded structural support volume in accordance with an embodiment of the disclosure.
Figure 18B:
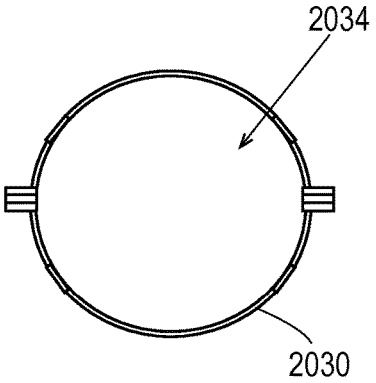
FIG. 18B is a schematic illustration of the flexible container of FIG. 18A having the product volume filled, but an unexpanded structural support volume.
Figure 18C:
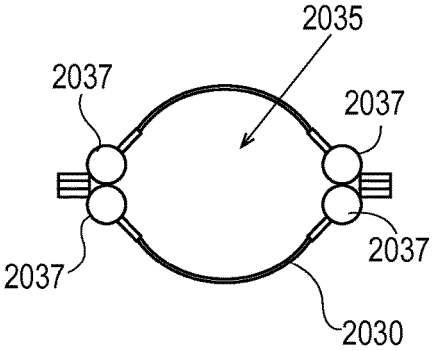
FIG. 18C is a schematic illustration of the flexible container of FIG. 18B after application of an external force to the flexible container to reduce the product receiving volume of the product volume.

Referring to FIGS. 17A and 17B, in an embodiment, the process for filling the product volume and expanding the at least one structural support volume can include filling the product volume with a product, the product volume having a first product receiving volume during filling, and the product being filled to a first fill height 2012. The process can then include applying an external force to the product volume 2014 to reduce the headspace in the product volume and reduce the product receiving volume from the first product receiving volume to the second product receiving volume. If the external force is applied in a region containing the product, the application of the external force will also result in raising the product to a second fill height. As illustrated in FIGS. 18A-18C, the expansion of the structural support volume 2037 causes the product receiving volume in the product volume to be reduced from the first product receiving volume 2034 (shown in FIG. 18B) to the third product receiving volume 2035 (shown in FIG. 18C). Application of the external force prior to expansion of the structural support volume accounts for this reduction as well as controls the pressure of the product volume once the structural support volume is expanded. The application of the external force reduces in the available volume of the product volume for receiving product causing the pre-expansion headspace to be reduced from a first pre-expansion headspace to a second pre-expansion headspace. Additionally, the application of the external force can in some embodiments result in an increase in the fill height of the product. FIG. 18A illustrates the flexible container before filling the product volume.

In the embodiment, as shown in FIG. 17A, the process can then include dispensing a cryogenic fluid into the at least one structural support volume while maintaining the external force on the product volume 2016 to maintain the second product receiving volume. As discussed in detail below, the cryogenic fluid provides a residence time before completely converting to a gas to expand the structural support volume. The product volume and the structural support volume can then be sealed and the external force can be released from the flexible container 2018. Upon sealing of the product volume and the structural support volume, the structural support volume will expand as the cryogenic fluid converts to a gas. Upon expansion, the structural support volume will at least partially extend into the product volume. After expansion of the structural support volume, the product volume has a third product receiving volume and the product has a third fill height. Depending on the location in which the external force is applied, the third fill height can be the same or higher than the first fill height.

In the embodiment illustrated in FIG. 17B, the process can include sealing the product volume before dispensing the cryogenic fluid 2024. The external force can be removed once the product volume is sealed. The process can then include dispensing the cryogenic fluid into the at least one structural support volume 2026 and sealing the structural support volume 2028 to allow for expansion of the structural support volume 2022 by conversion of the cryogenic fluid to a gas.

In any of the embodiments described herein, the structural support volume and optionally the product volume (as in FIG. 17A) can be sealed during or after dispensing the cryogenic fluid. The cryogenic fluid can advantageously provide a residence time to allow for a delay in sealing the structural support volume and optionally the product volume before complete conversion of the cryogenic fluid to a gas.

In any of the embodiments described herein, the product volume and/or the structural support volume can include a product filling port and an expansion port, respectively. The product filling port is in fluid communication with the product volume and the expansion port is in fluid communication with the at least one structural support volume. The product can be filled through the product filling port and into the product volume. The product filling port can provide an interface with a product filling nozzle of a product dispenser to aid the product dispense nozzle in locating the product volume during the filling process. The product filling port can have a size and shape that is complementary with the size and shape of the product filling nozzle or a guide thereon. Similarly, the expansion port can provide an interface between the cryogenic fluid dispensing nozzle and the at least one structural support volume to aid the cryogenic fluid dispenser in locating the at least one structural support volume during the expansion process. The expansion port can have a size and shape that is complementary with a size and shape of the cryogenic fluid dispensing nozzle or a guide provided thereon. In an embodiment, the product filling port and the expansion port are provided at the bottom of the container, such that the product volume is filled from the bottom of the container. In another embodiment, the product filling port and the expansion port are provided at the top of the container such that that the product volume is filled from the top of the container. In other embodiments, the product filling port and expansion port can be provided on opposite sides of the container. It is contemplated herein that the product filling port and the expansion port can be located in any portion of the container and can be on the same or different portions of the container.

The product filling unit can be provided on a rotary system having multiple product dispensing nozzles for filling multiple flexible containers. In one embodiment, the apparatus for applying the external force (also referred to herein as a volume reducer) can be provided on the rotary system. In another embodiment, the flexible container can pass from the rotary filling system in to an apparatus for applying the external force.

Figure 19:
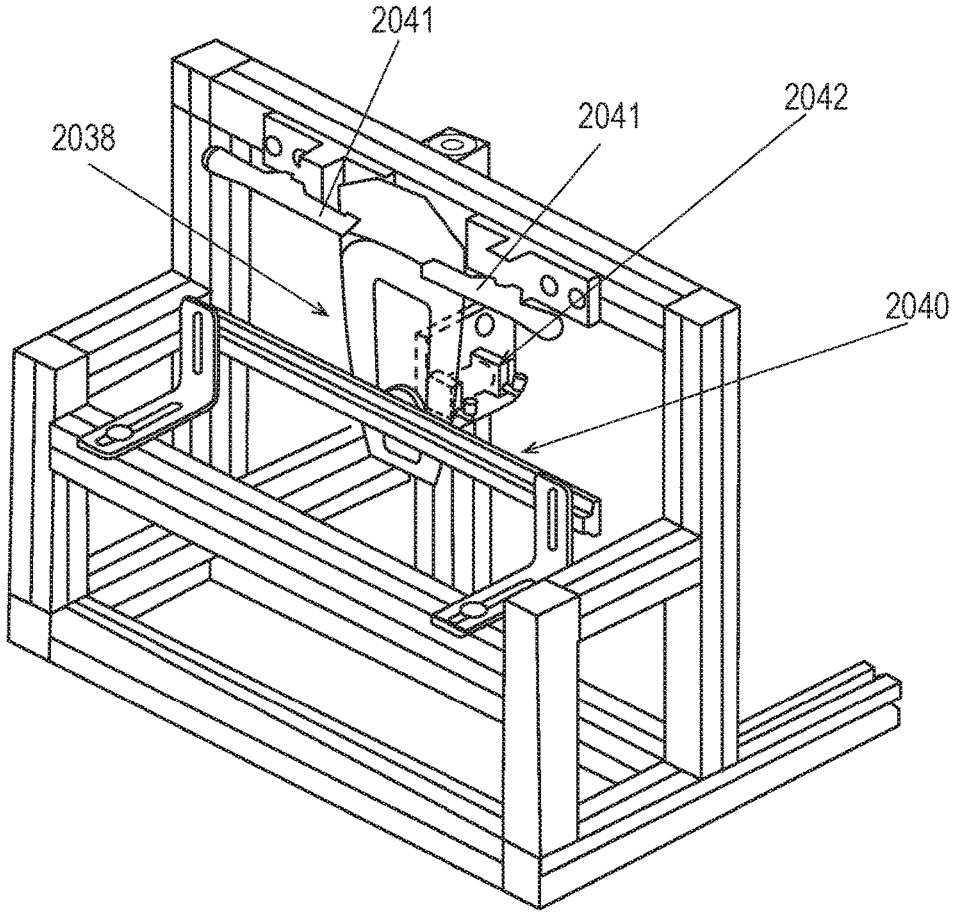
FIG. 19 is a schematic illustration of a volume reducing apparatus in accordance with an embodiment of the disclosure.

The external force for reducing the product receiving volume after filling can be applied by one or more volume reducers, including but not limited to, actuating bars, moving belts, and/or stationary rails having a reduced gap. FIG. 19 illustrates an embodiment of the device in which an actuating bar applies the external force for reducing the product receiving volume. In the embodiment of FIG. 19, a bar 2040 actuates against the container 2038, forcing the container against a stationary member 2042. It is also contemplated that the container 2038 have an external force applied to it by actuating two bars towards each other.

The external force can also or alternatively be applied by passing the flexible container through a gap between opposed stationary rails. The gap between the stationary rails can reduce along the length of the rails, such that greater and greater force is applied to the container as the container passes along the length of the stationary rails.

In yet another embodiment, the external force can be applied by one or more moving belts. For example, a moving belt can be aligned with a stationary rail such that the gap between the moving belt and the stationary rail reduces along the length of the stationary rail. In an embodiment, the container can be connected to the moving belt, for example, using one or more grippers, and the moving belt can manipulate the container down the length of the rail. The external force can also be applied using two moving belts having a gap that reduces along the length of the moving belt.

The external force in various embodiments can be applied in the machine direction.

In addition to the application of an external force, a vacuum can be applied to the product volume to remove all or a portion of the headspace remaining in the product volume after the application of the external force.

FIG. 19 also illustrates gripping members 2041, which grip a portion of the container to maintain control of the container during the formation process. In various embodiments, the flexible container can be formed from a web of material. Prior to the product filling process, the flexible container can be singulated from the web such that individual flexible containers 2038 are provided and manipulated through the remaining formation process, including, product filling and structural support volume expansion. The one or more grippers 2041 can be used to maintain control of the singulated flexible container and guide the container through the formation process. Other devices and gripping locations can also be used.

The external force can be applied in any suitable regions of the product volume, either where product is present or is not present. The external force applied to the container after filling can be about 0.01 psi to about 2 psi, about 0.05 psi to about 1.6 psi, about 0.1 psi, to about 1.4 psi, about 0.5 psi to about 1 psi, and about 1 psi to about 2 psi. Other suitable values include about 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2 psi and any range formed by any of the preceding values In various embodiments, the external force can reduce the first product receiving volume such that the second product receiving volume is about 1% to about 99%, about 10% to about 50%, about 20% to about 40%, about 10% to about 30%, about 25% to about 50%, and about 15% to about 35% less than the first product receiving volume. The second product receiving volume can be, for example, about 1, 2, 3, 4, 5, 6, 7, 8, 9, 10, 12, 14, 16, 18, 20, 22, 24, 25, 26, 28, 30, 32, 34, 36, 38, 40, 42, 44, 46, 48, 50, and any range formed by any of the preceding values, less than the first product receiving volume.

The expansion of the structural support volume result in a third product receiving volume that is about 10% to about 50% about 20% to about 40%, about 10% to about 30%, about 25% to about 50%, and about 15% to about 35% less than the first product receiving volume. The third product receiving volume can be, for example, about 10, 12, 14, 16, 18, 20, 22, 24, 25, 26, 28, 30, 32, 34, 36, 38, 40, 42, 44, 46, 48, 50, and any range formed by any of the preceding values, less than the first product receiving volume.

The second fill height of the product, which can be higher than the first fill height of the product as a result of the application of the external force in a region in which product is present, can be about 1% to about 99%, about 5% to about 50% higher than the first fill height in various embodiments. Other suitable ranges include, about, 5% to about 45%, about 5% to about 25%, about 20% to about 40%, about 25% to about 50%, about 15% to about 35%, about 35% to about 50%, and about 10% to about 30%. For example, the second fill height can be about 1, 2, 3, 4, 5, 6, 7, 8, 9, 10, 12, 14, 16, 18, 20, 22, 24, 26, 28, 30, 32, 34, 36, 38, 40, 42, 44, 46, 48, 50%, and any range formed by any of the preceding values higher than the first fill height.

The external force applied to the flexible container can be monitored during the process and optionally adjusted to account for variations in the initial product fill and/or ensure that the applied external force is consistently being applied to achieve the desired second fill height in each successive container that is processed. In some embodiments, more than one product receiving volume reducing steps may be present, a first course adjustment, and a second finer adjustment for example, or a first fixed force and a second adjustable force. The external force can be monitored for example by monitoring the first fill height and/or the second fill height. Any devices for monitoring a fill height of the flexible container can be used include, for example, one or more of optical probes, ultrasonic measurement device, laser measurement devices, and video analysis devices. Any suitable number of monitoring devices can be used. The one or more measurement devices can be a part of a separate apparatus or can be incorporated into the apparatus for applying the external force. One or more control systems can be incorporated to provide a feedback loop by which the external force can be adjusted if a variation of the fill height is detected by the one or more measurement devices.

As discussed above, the at least one structural support volume can be expanded by dispensing a cryogenic fluid into the at least one structural support volume. The cryogenic fluid evaporates to a gas after dispensing. The at least one structural support volume is sealed before complete conversion of the cryogenic fluid such that the gas entrapped upon sealing the at least one structural support volume expands the structural support volume. The pressure of the at least one structural support volume can be controlled by controlling the amount of cryogenic fluid dispensed into the structural support volume and the amount of time between dispensing the cryogenic fluid and sealing the structural support volume. The structural support volume can be pressurized to a gauge pressure, for example, of about 1 psi to 30 psi, about 2 psi to about 20 psi, about 5 psi to about 15 psi, about 7 psi to about 18 psi, and about 3 psi to about 12 psi. Other suitable gauge pressures include about 1, 2, 3, 4, 5, 6, 7, 8, 9, 10, 12, 14, 16, 18, 20, 22, 24, 26, 28, 30 psi and any range formed by any of the preceding values.

The use of a cryogenic fluid advantageously allows for a residence time of the cryogenic fluid in the structural support volume before the structural support volume is expanded by the conversion of the cryogenic fluid to a gas. This can allow for sealing of the structural support volume in an unexpanded or substantially unexpanded state, which in turn can facilitate in forming a stronger seal and/or a smaller seam. Any suitable cryogenic fluid can be used, including for example, liquid nitrogen, liquid carbon dioxide, liquid helium, liquid argon, and combinations thereof. In various embodiments, a cryogenic solid can be dispensed, such as dry ice in pellet form, crushed form (e.g., a flowable powder), or any other form. For ease of reference, the following description will refer to the dispensing of a cryogenic fluid, however, it should be understood that a cryogenic solid can also or alternatively be dispensed.

The structural support volume and optionally the product volume (as in the embodiment illustrated in FIG. 17A) can be sealed after dispensing of the cryogenic fluid. For example, the structural support volume can be sealed about 0.1 s to about 60 s, about 0.1 s to about 1 s, about 0.5 s to about 40 s, about 1 s to about 10 s, about 10 s to about 60 s, about 0.5 s to about 15 s, about 2 s to about 35 s, about 25 s to about 60 s, and about 5 s to about 45 s after dispensing the cryogenic fluid. Other suitable times include, for example, about 0.1, 0.2, 0.3, 0.4, 0.5, 0.6, 0.7, 0.8, 0.9, 1, 2, 3, 4, 5, 6, 7, 8, 9, 10, 15, 20, 25, 30, 35, 40, 45, 50, 55, 60 and any range formed by any of the preceding values. In various embodiments, the structural support volume can be sealed while the dispensing nozzle or guide is engaged with the structural support volume and/or an expansion port. In various embodiments, the process for filling multiple structural support volumes in separate dispensing steps can include dispensing the cryogenic fluid into a first structural support volume and then dispensing the cryogenic fluid into a second structural support volume. The step of dispensing the cryogenic fluid into the second structural support volume can be performed, in some embodiments, at the same or substantially the same time as sealing the first structural support volume and/or at the same or substantially the same time as expansion of the first structural support volume.

The cryogenic fluid can be dispensed from a cryogenic fluid source through a nozzle. A system for expansion of the at least one structural support volume can include a plurality of cryogenic fluid dispensing nozzles disposed on a rotary die and supplied from one or more sources of cryogenic fluid.

Figure 20A:
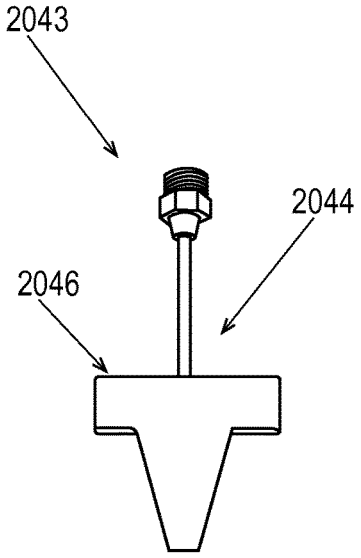
FIG. 20A is a schematic illustration of a nozzle assembly in accordance with an embodiment of the disclosure, the nozzle being in a non-dispensing position.
Figure 20B:
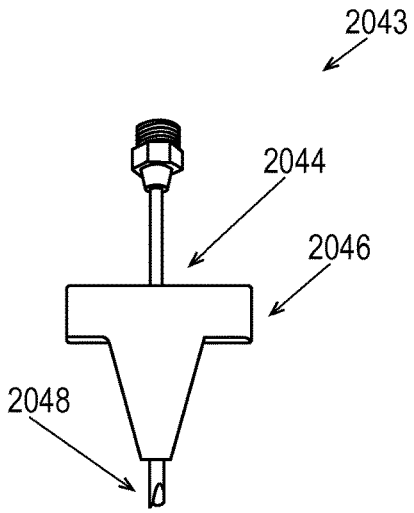
FIG. 20B is a schematic illustration of the nozzle assembly of FIG. 20A with the nozzle in a dispensing position.

FIGS. 20A and 20B illustrate an embodiment of an integrated nozzle assembly for dispensing the cryogenic fluid. The integrated nozzle assembly 2043 includes a nozzle 2044 through which the cryogenic fluid is dispensed. The assembly 2043 also includes a guide 2046 having an aperture through which the nozzle 2044 passes. The nozzle 2044 is adapted to actuate from a non-dispensing position in which a tip 2048 of the nozzle is disposed within the guide 2046 to a dispensing position in which the tip 2048 is extended from the guide 2046. The nozzle 2044 can actuate such that at least the tip 2048 is disposed within the structural support volume when in the dispensing position. Dispensing the cryogenic fluid while the tip is disposed within the structural support volume can reduce the total distance the cryogenic fluid travels inside the structural support volume can improve the efficiency of the process, for example, by reducing an amount of the cryogenic fluids that is lost through early conversion to a gas prior to sealing of the structural support volume. The nozzle 2044 can extend, for example, about 1 mm to about 25 mm, about 5 mm to about 20 mm, about 10 mm to about 15 mm, about 3 mm to about 10 mm, about 5 mm to about 15 mm, or about 12 mm to about 25 mm into the structural support volume. Other suitable distances include about 1, 2, 3, 4, 5, 6, 7, 8, 9, 10, 11, 12, 13, 14, 15, 16, 17, 18, 19, 20, 21, 22, 23, 24, 25 mm, and any range formed by any of the preceding values. In embodiments in which the flexible container includes an expansion port in fluid communication with the structural support volume, the nozzle can extend through the expansion port and into the structural support volume a distance. In such embodiments, the values listed above for the distance at which the nozzle 2044 can extended into the structural support volume can be measured from an interface between the expansion portion and the structural support volume. It is also contemplated herein that the nozzle 2044 can dispense from a distance away from the structural support volume. For example, the nozzle 2044 can be extended into an expansion port, but not into the structural support volume.

Figure 21:
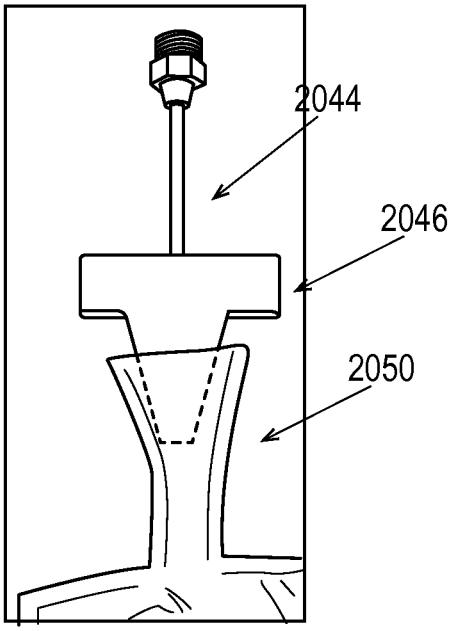
FIG. 21 is a schematic illustration of a nozzle assembly engaged with an expansion portion, the nozzle being in a non-dispensing position.

In various embodiments, the nozzle assembly includes the guide 2046. The guide 2046 can engage a portion of the structural support volume. Alternatively, where the flexible container includes an expansion port, the guide 2046 can engage the expansion port 2050, for example, as shown in FIG. 21. FIG. 21 illustrates the nozzle in the non-dispensing position. The guide 2046 can include a portion having a size and a shape that is complimentary to at least a portion of the expansion port 2050 to facilitate locating the expansion port 2050 while the containers are being process. The guide 2046 by engaging with the expansion portion 2050 can facilitate consistency of the nozzle location during dispensing as successive containers are processed through the cryogenic fluid dispensing step. For example, in one embodiment, the guide 2046 can have a portion having a frusto-conical shape and at least a portion of the expansion port can have a similar shape and be sized such that the guide 2046 can be received within the expansion port 2050. For example, the guide 2046 and the expansion port 2050 can be sized such that opposed walls of the expansion port 2050 contact the guide 2046.

The guide 2046 can also include one or more apertures through which air or compressed gas can be passed. When the guide 2046 is engaged with the expansion port or other portion of the structural support volume, a gas can be passed through the one or more apertures to pre-expand the structural support volume and separate the walls for receiving the cryogenic fluid. Separation of the walls can aid in dispensing the cryogenic fluid into the structural support volume such that the cryogenic fluid travels to a bottom portion of the structural support volume without contacting or substantially without contacting the side walls. Contact with the sidewalls can result in earlier conversion of the cryogenic fluid to a gas, which can be disadvantageous if a delay is needed for the sealing process, and/or require increased amounts of cryogenic fluid to be dispensed to account for the loss of the cryogenic fluid before sealing.

The walls of the structural support volume can also or alternatively be separated using mechanical grippers or application of a suction or vacuum force to the opposed walls.

The guide 2046 can also be controllably heated such that the nozzle is maintained at a constant temperature. Such heating can facilitate in preventing frost and water condensation from the air on the nozzle, which may lead to contamination of the container. The guide 2046 can be heated to a temperature of about 100° C. to about 170° C., about 110° C. to about 160° C., about 115° C. to about 145° C., about 120° C. to about 170° C., about 130° C. to about 180° C., and about 125° C. to about 155° C. Other suitable temperatures include, for example, about 100, 102, 104, 106, 108, 110, 112, 114, 116, 118, 120, 122, 124, 126, 128, 130, 132, 134, 136, 138, 140, 142, 144, 146, 148, 150, 152, 154, 156, 158, 160, 162, 164, 166, 168, 170, and any range formed by any of the preceding values.

Sealing the product volume and/or the structural support volume whether at the same time or at different times can be performed using any known sealing methods, including, for example, heat sealing, laser sealing, ultrasonic sealing, and impulse sealing. In various embodiments in which a seal region of the product volume and/or the structural support volume can be contaminated with product or other contaminate, the seal can be formed by ultrasonic sealing.

In various embodiments, the sealed region can also be cut. Sealing and cutting can occur in a single unit operation or in serial operations. For example, in one embodiment, the flexible container can include a product filling port, a seal can be formed at an interface between the product filling port and the product volume and a portion of the seal can be cut to remove the product filling port. Such sealing and cutting can occur, for example, in a single unit operation. In an embodiment, the flexible contain can include an expansion port in fluid communication with the at least one structural support volume and sealing can include forming a seal at an interface between the expansion port and the structural support volume and a portion of the seal can be cut to remove the expansion port. Such sealing and cutting can occur, for example, in a single unit operation.

While the foregoing generally describes the process of filling the product volume in a single fill process, it is also contemplated herein that the flexible container can include multiple product volumes, and each can be filled with a different product. Filling can be completed in a substantially simultaneous or serial manner.

Additionally, it is contemplated herein that a flexible container can include multiple structural support volumes that are not in fluid communication. In such embodiments, the flexible container can include multiple openings and/or expansion ports through which the cryogenic fluid can be disposed into the separated structural support volumes. The cryogenic fluid dispensing process can occur substantially simultaneously or in a serial manner.

In accordance with embodiments of the disclosure, the method of filling the product volume and/or expanding the structural support volume can be performed in a continuous operation, wherein flexible containers are moved through the filling and expansion processes at a substantially constant rate. In accordance with other embodiments of the disclosure, the method of filling the product volume and/or expanding the structural support volume can be performed in an indexed operation, in which the flexible container blank is stopped for a period of time during the process. For example, the flexible container blank can be stopped for about 0.01 to about 10 seconds, about 0.05 seconds to about 0.1 seconds, about 0.5 seconds to about 3 seconds, about 0.1 seconds to about 3 seconds, about 0.5 seconds to about 2 seconds, about 0.1 seconds to about 1 second, about 1 second to about 3 seconds, about 1 second to about 10 seconds, about 4 seconds to about 8 seconds, about 0.8 seconds to about 2.5 seconds, or about 0.25 seconds to about 0.7 seconds. Other suitable times include about 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.5, 4, 4.5, 5, 5.5, 6, 6.5, 7, 7.5, 8, 8.5, 9, 9.5, 10, seconds, and any range formed by any of the preceding values. In accordance with other embodiments of the disclosure, the method of filling the product volume and/or expanding the structural support volume can be performed in a non-continuous process, such as manually on individual unit operations.

Part, parts, or all of any of the embodiments disclosed herein can be combined with part, parts, or all of other embodiments known in the art of flexible containers, including those described below.

Embodiments of the present disclosure can use any and all embodiments of materials, structures, and/or features for flexible containers, as well as any and all methods of making and/or using such flexible containers, as disclosed in the following patent applications: U.S. non-provisional patent application Ser. No. 13/888,679 filed May 7, 2013, entitled "Flexible Containers" (applicant's case 12464M); U.S. non-provisional patent application Ser. No. 13/888,721 filed May 7, 2013, entitled "Flexible Containers" (applicant's case 12464M2); U.S. non-provisional patent application Ser. No. 13/888,963 filed May 7, 2013, entitled "Flexible Containers" (applicant's case 12465M); U.S. non-provisional patent application Ser. No. 13/888,756 filed May 7, 2013, entitled "Flexible Containers Having a Decoration Panel" (applicant's case 12559M); U.S. non-provisional patent application Ser. No. 13/957,158 filed Aug. 1, 2013, entitled "Methods of Making Flexible Containers" (applicant's case 12579M); U.S. non-provisional patent application Ser. No. 13/957,187 filed Aug. 1, 2013, entitled "Containers Made from Flexible Material" (applicant's case 12579M); U.S. non-provisional patent application Ser. No. 13/889,000 filed May 7, 2013, entitled "Flexible Containers with Multiple Product Volumes" (applicant's case 12785M); U.S. non-provisional patent application Ser. No. 13/889,061 filed May 7, 2013, entitled "Flexible Materials for Flexible Containers" (applicant's case 12786M); U.S. non-provisional patent application Ser. No. 13/889,090 filed May 7, 2013, entitled "Flexible Materials for Flexible Containers" (applicant's case 12786M2); U.S. provisional patent application 61/861,100 filed Aug. 1, 2013, entitled "Disposable Flexible Containers having Surface Elements" (applicant's case 13016P); U.S. provisional patent application 61/861,106 filed Aug. 1, 2013, entitled "Flexible Containers having Improved Seam and Methods of Making the Same" (applicant's case 13017P); U.S. provisional patent application 61/861,118 filed Aug. 1, 2013, entitled "Method of Forming a Flexible Container" (applicant's case 13018P); U.S. provisional patent application 61/861,129 filed Aug. 1, 2013, entitled "Enhancements to Tactile Interaction with Film Walled Packaging Having Air Filled Structural Support Volumes" (applicant's case 13019P); PCT international patent application CN2013/085045 filed Oct. 11, 2013, entitled "Flexible Containers Having a Squeeze Panel" (applicant's case 13036); PCT international patent application CN2013/085065 filed Oct. 11, 2013, entitled "Stable Flexible Containers" (applicant's case 13037); each of which is hereby incorporated by reference.

Embodiments of the present disclosure can use any and all embodiments of materials, structures, and/or features for flexible containers, as well as any and all methods of making and/or using such flexible containers, as disclosed in the following patent documents: Japanese patent application 2008JP-0024845 filed Feb. 5, 2008, entitled "Self-standing Bag" in the name of Shinya, laid open as publication JP2009184690; U.S. patent application Ser. No. 10/312,176 filed Apr. 19, 2002, entitled "Container" in the name of Rosen, published as US2004035865; U.S. Pat. No. 7,585,528 filed Dec. 16, 2002, entitled "Package having an inflated frame" in the name of Ferri, et al., granted on Sep. 8, 2009; U.S. patent application Ser. No. 12/794,286 filed Jun. 4, 2010, entitled "Flexible to Rigid Packaging Article and Method of Use and Manufacture" in the name of Helou, published as US20100308062; U.S. Pat. No. 6,244,466 filed Jul. 8, 1997, entitled "Packaging Container and a Method of its Manufacture" in the name of Naslund, granted Jun. 12, 2001; U.S. nonprovisional patent application Ser. No. 13/379,655 filed Jun. 21, 2010, entitled "Collapsible Bottle, Method Of Manufacturing a Blank For Such Bottle and Beverage-Filled Bottle Dispensing System" in the name of Reidl, published as US2012/0097634; U.S. Pat. No. 5,960,975 filed Mar. 19, 1997, entitled "Packaging material web for a self-supporting packaging container wall, and packaging containers made from the web" in the name of Lennartsson, granted Oct. 5, 1999; and PCT international patent application WO 96/01775 filed Jul. 5, 1995, entitled "Packaging Pouch with Stiffening Air Channels" in the name of Prats; each of which is hereby incorporated by reference.

Part, parts, or all of any of the embodiments disclosed herein also can be combined with part, parts, or all of other embodiments known in the art of containers for fluent products, so long as those embodiments can be applied to flexible containers, as disclosed herein. For example, in various embodiments, a flexible container can include a vertically oriented transparent strip, disposed on a portion of the container that overlays the product volume, and configured to show the level of the fluent product in the product volume.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or patent publication, is hereby incorporated herein by reference in its entirety unless expressly excluded or otherwise limited. The citation of any document is not an admission that it is prior art with respect to any document disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method of expanding a structural support volume of a flexible container, the method comprising:

providing a blank for a flexible container, wherein said flexible container has a top and a bottom, and said flexible container is configured to stand-up with a portion of its bottom resting on a horizontal surface, said blank comprising: a product volume; a plurality of expandable structural support volumes including middle structural support volumes that are configured to be in a substantially vertical orientation when said flexible container is resting on a horizontal surface; an expansion port in fluid communication with at least one structural support volume; and a pair of opposed panels that will form a front and a back of the flexible container, the opposed panels being relatively flat surfaces that overlie the product volume and are free of expandable structural support volumes;

dispensing a cryogenic fluid into the structural support volumes through the expansion port using a nozzle, wherein the nozzle is articulated through the expansion port and at least partially into the structural support volume to dispense the cryogenic fluid, and wherein the nozzle articulates through a guide having a size and a shape that is complementary to that of at least a portion of the expansion port and the guide engages at least a portion of the expansion port during dispensing of the cryogenic fluid; and sealing the structural support volumes such that they have a closed volume before complete conversion of the cryogenic fluid to a gaseous state and expansion of the structural support volumes to an expanded state.

2. The method of claim 1, wherein the nozzle articulates from a non-dispensing position outside of the structural support volume to a dispensing position in which a dispensing end of the nozzle extends at least about 1 mm and at most about 25 mm into the interior of the structural support volume.

3. The method of claim 1, wherein the guide has a frusto-conical shape.

4. The method of claim 1, wherein when expanded the structural support volume has a gauge pressure of about 1 psi to about 30 psi.

5. The method of claim 1, further comprising at least partially expanding at least one structural support volume before dispensing the cryogenic fluid.

6. The method of claim 5, wherein the structural support volume is at least partially expanded prior to dispensing the cryogenic fluid using a gas.

7. The method of claim 1, wherein opposed walls of at least one structural support volume are separated using mechanical grippers prior to dispensing the cryogenic fluid.

8. The method of claim 1, wherein the cryogenic fluid is selected from the group consisting of liquid nitrogen, liquid carbon dioxide, liquid helium, liquid argon, and combinations thereof.

9. The method of claim 1, wherein upon expansion to the pressurized state, at least one structural support volume extends into at least a portion of the product volume and reduces an available product receiving volume of the product volume by about 10% to about 50%.

10. The method of claim 1, wherein the nozzle is heated to a temperature of about 100° C. to about 170° C.

11. The method of claim 1, wherein the product volume is filled with product before dispensing the cryogenic fluid.

12. The method of claim 11, wherein an external force is applied to the product volume after filling to achieve a pre-determined product fill height, the external force is maintained during dispensing of the cryogenic fluid into at least one structural support volume to maintain the pre-determined product fill height, the method further comprising releasing the external force after sealing the at least one structural support volume.

13. The method of claim 1, further comprising sealing the product volume.

14. The method of claim 13, wherein the product volume and the structural support volume are sealed at substantially the same time.

15. The method of claim 13, wherein the product volume and the structural support volume are sealed in a single unit operation.

16. The method of claim 1, wherein the blank is configured so that said middle structural support volumes will be disposed substantially laterally outboard from the product volume.

* * * * *